US009181776B2

(12) United States Patent
Tunget

(10) Patent No.: US 9,181,776 B2
(45) Date of Patent: Nov. 10, 2015

(54) PRESSURE CONTROLLED WELL CONSTRUCTION AND OPERATION SYSTEMS AND METHODS USABLE FOR HYDROCARBON OPERATIONS, STORAGE AND SOLUTION MINING

(76) Inventor: Bruce A. Tunget, Westhill (GB)

( * ) Notice: Subject to any disclaimer, the term of this patent is extended or adjusted under 35 U.S.C. 154(b) by 448 days.

(21) Appl. No.: 13/261,445

(22) PCT Filed: Mar. 1, 2011

(86) PCT No.: PCT/US2011/000372
§ 371 (c)(1),
(2), (4) Date: Sep. 25, 2012

(87) PCT Pub. No.: WO2011/119197
PCT Pub. Date: Sep. 29, 2011

(65) Prior Publication Data

US 2013/0068473 A1 Mar. 21, 2013

(30) Foreign Application Priority Data

| | | |
|---|---|---|
| Mar. 25, 2010 | (GB) | 1004961.7 |
| Jun. 22, 2010 | (GB) | 1010480.0 |
| Jul. 5, 2010 | (GB) | 1011290.2 |

(51) Int. Cl.
*E21B 17/18* (2006.01)
*E21B 34/06* (2006.01)
*E21B 41/00* (2006.01)

(52) U.S. Cl.
CPC ..... *E21B 34/06* (2013.01); *E21B 17/18* (2013.01); *E21B 41/0035* (2013.01)

(58) Field of Classification Search
CPC ..... E21B 17/18; E21B 45/00
See application file for complete search history.

(56) References Cited

U.S. PATENT DOCUMENTS

| | | | | |
|---|---|---|---|---|
| 3,027,901 | A * | 4/1962 | Bottenberg et al. | 137/8 |
| 2003/0201104 | A1 | 10/2003 | Bergman et al. | |
| 2005/0105971 | A1 | 5/2005 | Maduell et al. | |
| 2005/0126822 | A1 | 6/2005 | Campbell et al. | |
| 2010/0155067 | A1 * | 6/2010 | Tunget | 166/285 |
| 2013/0043031 | A1 * | 2/2013 | Tunget | 166/313 |

* cited by examiner

*Primary Examiner* — Giovanna C Wright

(57) ABSTRACT

Apparatus and methods for fluidly communicating between conduit strings and wells through crossovers forming a subterranean manifold string, usable for pressure contained underground hydrocarbon operations, storage and solution mining. Concentric conduits enable fluid communication with one or more subterranean regions through an innermost passageway usable for communicating fluids and devices engagable with a receptacle of the manifold. A wall of the manifold string and/or a selectively placed fluid control device diverts fluid mixture flow streams from one passageway to another radially disposed inward or outward passageway to selectively control pressurized fluid communication, thereby forming a plurality of pressure bathers. The pressure bathers can be used to selectively communicate fluid mixtures to and from a reservoir for hydrocarbon operations, solution mining, and/or control of a storage cushion space during such operations.

30 Claims, 16 Drawing Sheets

CS2
7
20
14
16
6
52
17
47
20
41
20
43
148
42
148
39
149
3, 15
16
51A
17A
1A
52
17

64
25
10A

CO2
CS3
31
7
55
74
24B
76M
24
6
14
16
23
34
128
149
148
23C
24
23F
25
74
23
34
25
23T
47
55
15
22,25A
31
43
2B, 3
34
59
40
39
148
137
40
39
16
149
55
51A
19
25
2
20
34
25
40
2
130
129
38
1A

CS5
CO4
70T
70
2
2A
7
20
14
6
74
149
61
148
15
20
2A
123,
23S
139
55
23S
1A
1
1D
1S
23S
CO4
147
5
2
59
23F
23
52
16
75
23
24
25
2A
17
CS6
70
76N
76
6
14
149
61
23F
23
20
148
3
23T
43
25A
51A
39
137
40
16
19
2
2
55
17
17
5
59

CO5
10A
34
31
CS7
64
7
76N
76
14
20
74
149
34
31
61
23F
23
6
74
148
31
23
25A
23T
34
3,15,43
137
40
55
16
1
1A
17
31
1D
1S
140
117
5
1C
147
34
117
1B
17
1G
59
132
133

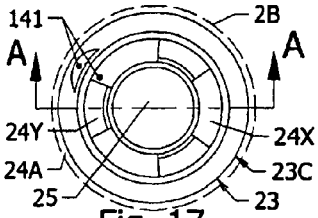
Fig. 17
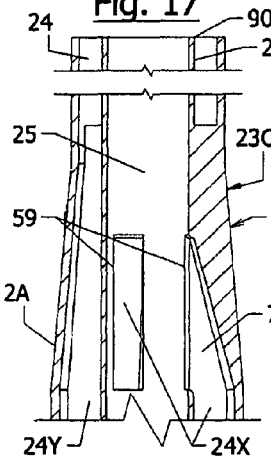
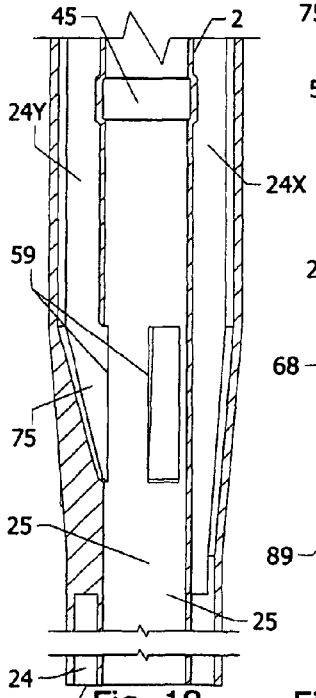
Fig. 18
Section A-A
Fig. 19
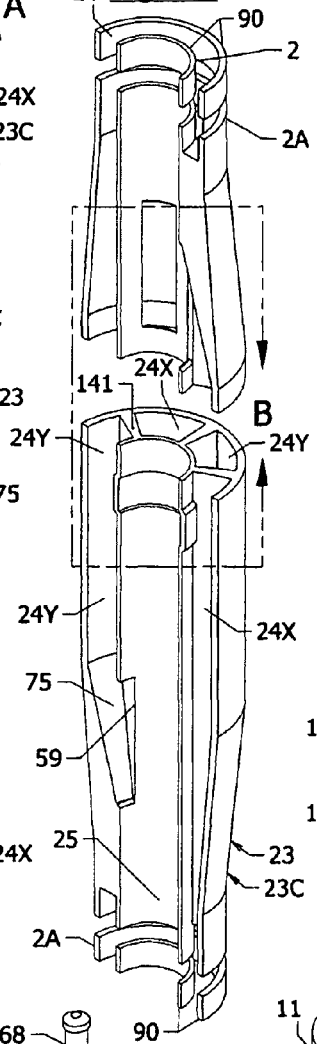
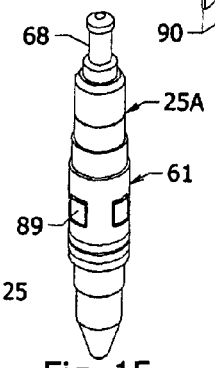
Fig. 15
Prior Art
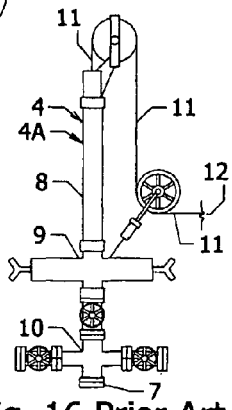
Fig. 16 Prior Art
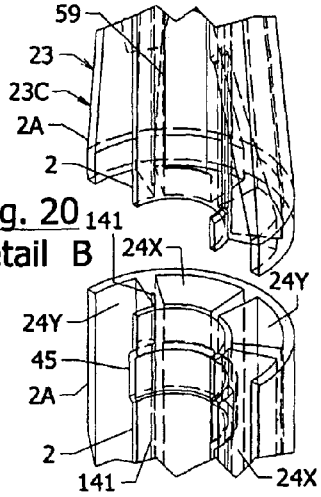
Fig. 20
Detail B
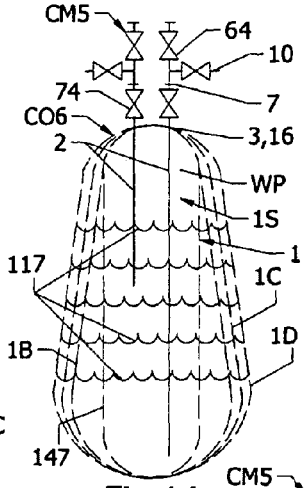
Fig.14
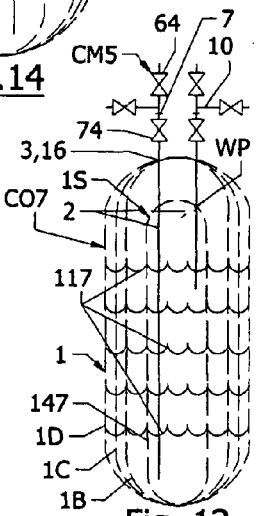
Fig. 13

C
C
2B
23
24A
23F 79
90
79
25
74
23F
23
127
F
25A
61
23C
45
24Y
24X
75
25
24
79
74
127
2A
2
90

24
25
61
74
D
25
23F
23
75
25A
61
24Y
24X
61
45
75
E
45
25
24
74
127
2
2A

Section C-C
2A
2
79
23F
25
59
23C
24X
24Y
68
25A
59
75
24X

Detail F
61
25A
23F
24Y
24X
2A
75
75
23C
59
25
24
79
2

Detail E
59
89
G
G
128
61

Detail D
2
79
79
45
24
23F
143
2A
142
144
61
74
127
25

Section
G-G
59
128
89
66
61
114
59

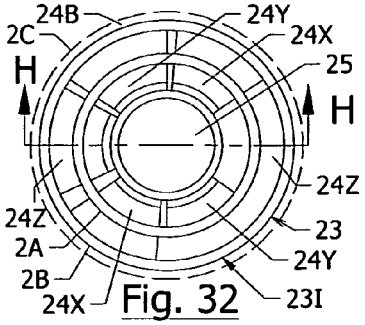
Fig. 32
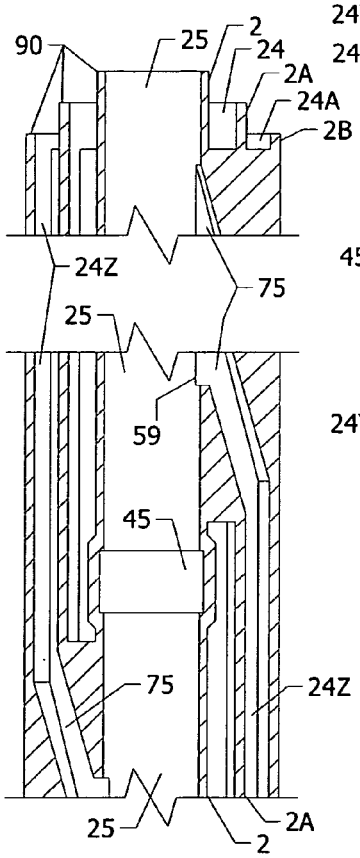
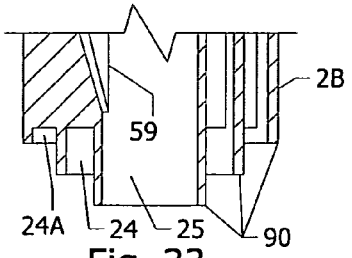
Fig. 33
Section H-H
Fig. 34
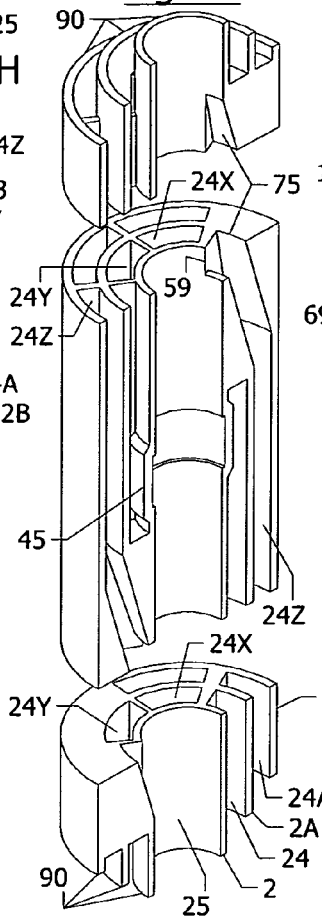
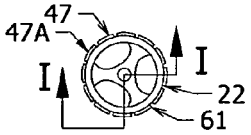
Fig. 35
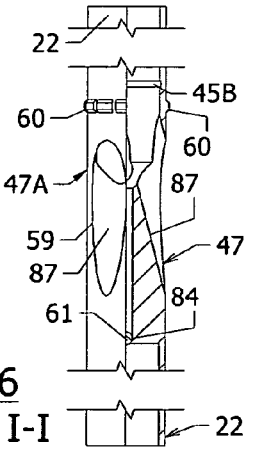
Fig. 36
Section I-I
Fig. 29
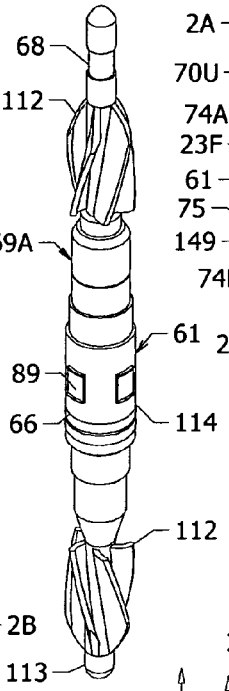
Fig. 30
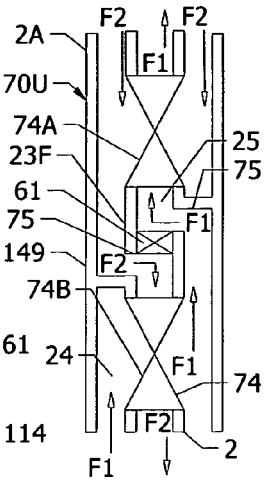
Fig. 31
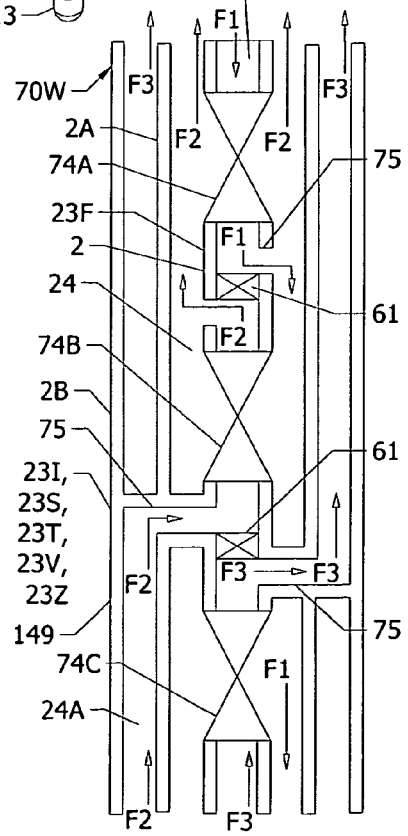

Section N-N

Section L-L

Detail M 90
41
43
P
39
90

45B
47
87
88
65
61
43
25
25
44
42
39

Detail P 90
43
41
Q
39,149
R
25
59
42
150
41
150
148
39

Detail Q
39,149
2A
148
124
59
125

Detail R 47
61
87
96

61
47
59
87
45B
96

61
45B
87
47
96

S
T
2
90
24
25
2A
76H
23T
23
41
43
44
39
45
75
25A
61
F1
F2
68
89
59

V
87
48
V
61
47

137
24Z
87
45A
24Y
25
24X
150
145B
43
CS8

145A
42
CS8
45A
U
U
137
87
43

47
48
87
CS8
146

47
137
CS8
43
146
145A
137
43
145B
137
66

61
47
87
87
96
96
48
87

Section V-V
45B
87
47
61
87
96
48
87

137
145A
CS8
43
41
150
42
148
137
66
39
149

Section U-U
CS8
137
148
149
41
149
148
150
150
CS8
43
145A
42
149
148
39
150
137
39
66
149

W
24A
24
24B
24C
CS8
W
2
2A
23
23V
2C
2B
25
2D

90

2A
24
25
24
2C
24B
24A
2B
X
43
75
24A
23
23V
24A
75
24B
39
150
25
59
24B
150
90
Ø13.375
Ø32.5
Ø36.0
Ø12.25
150
Ø4.0
Ø5.0
CS8
148
149
149
150

Ø13.375
149
Ø6.0
Ø12.25
Ø5.0
150
148
149
CS8
Ø32.0
Ø29.0
149
150

Ø12.25
Ø13.375
Ø30.0
149
Ø28.0
Ø8.625
Ø5.0
150
149
150
148
CS8

25
24A
24A
42
24B
75
23V
24A
59
75
24B
24A
75,24
2B
43
2
24B
2A
23V
41
25
2C
44
39
42

Detail X

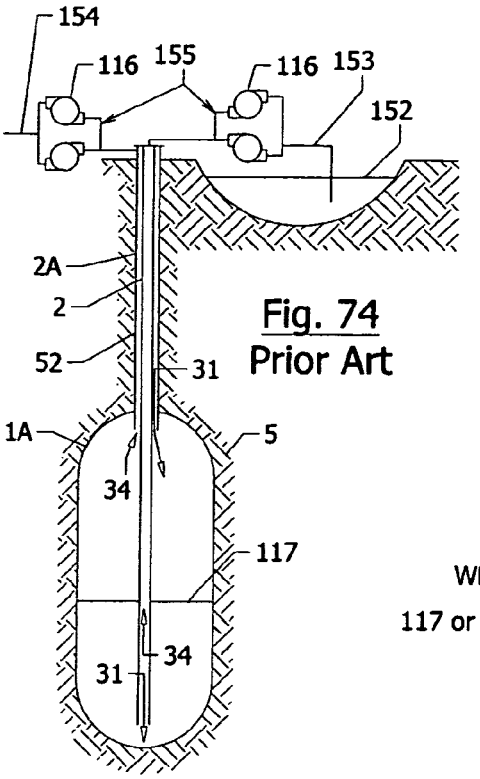
Fig. 74
Prior Art
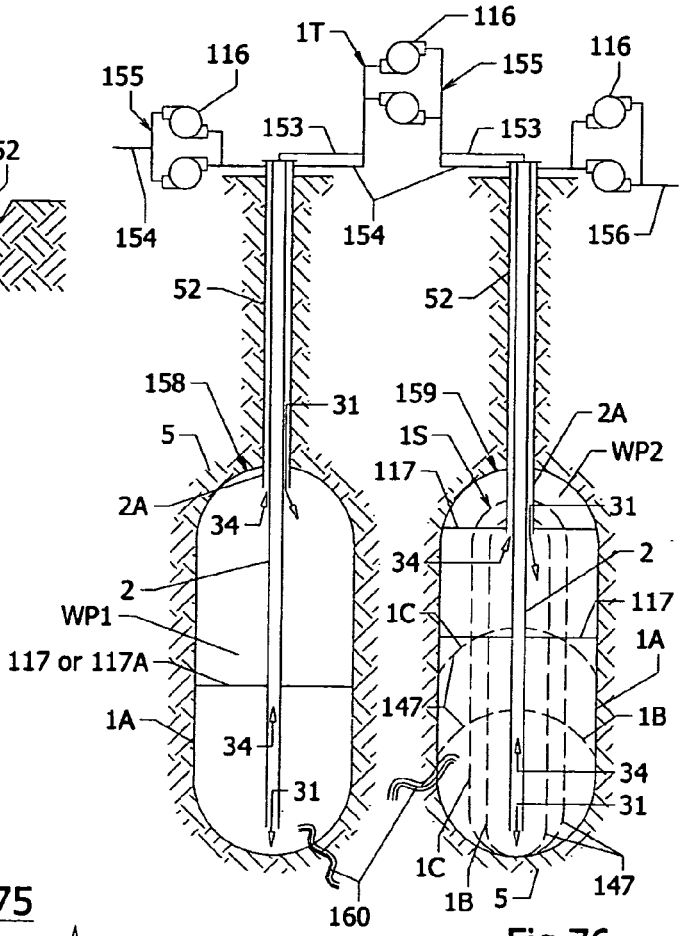
Fig.76
Fig. 75
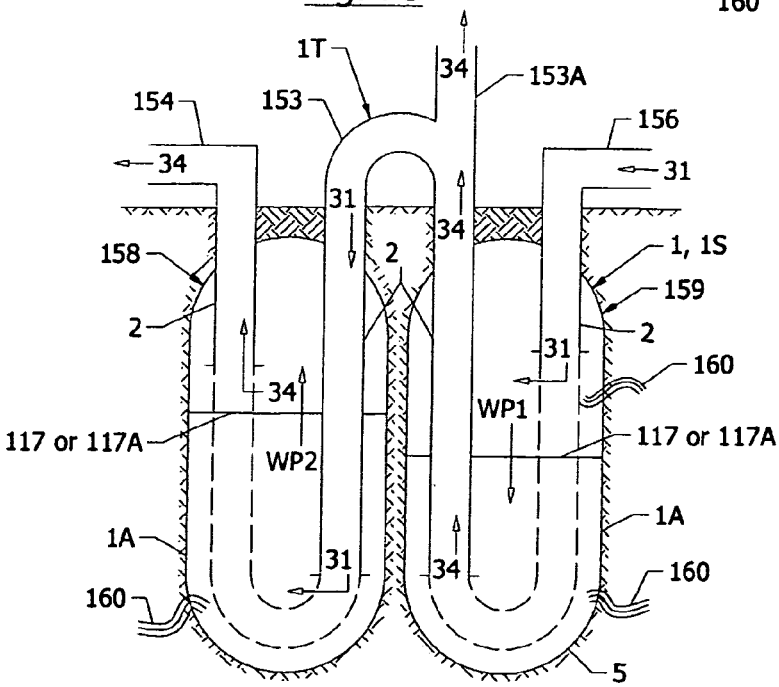

PRESSURE CONTROLLED WELL CONSTRUCTION AND OPERATION SYSTEMS AND METHODS USABLE FOR HYDROCARBON OPERATIONS, STORAGE AND SOLUTION MINING

CROSS REFERENCE TO RELATED APPLICATIONS

The present application claims priority to patent cooperation treaty (PCT) application having PCT Application Number PCT/US2011/000372, entitled "Pressure Controlled Well Construction And Operation Systems And Methods Usable For Hydrocarbon Operations, Storage and Solution Mining," filed Mar. 1, 2011, the United Kingdom patent application having Patent Application Number GB1004961.7, entitled "Apparatus And Methods For Operating One Or More Solution Mined Storage Wells Through A Single Bore," filed Mar. 25, 2010, the U.S. patent application having Ser. No. 12/803,283, entitled "Apparatus And Methods For Forming And Using Subterranean Salt Caverns," filed on Jun. 22, 2010, the United Kingdom patent application having Patent Application Number GB1010480.0, entitled "Apparatus And Methods For Forming Subterranean Salt Caverns," filed Jun. 22, 2010, the U.S. patent application having Ser. No. 12/803,775, entitled "Through Tubing Cable Rotary System," filed on Jul. 6, 2010, the United Kingdom patent application having Patent Application Number GB1011290.2, entitled "Apparatus And Methods For A Sealing Subterranean Borehole And Performing Other Cable Downhole Rotary Operations," filed Jul. 5, 2010, all of which are incorporated herein in their entirety by reference.

FIELD

The present invention relates, generally, to manifold crossover member apparatus and methods usable for providing pressure containment and control when constructing and/or operating a manifold string, and during hydrocarbon operations, storage and/or solution mining, with at least two conduits and fluid separated passageways through the subterranean strata, for one or more substantially hydrocarbon and/or substantially water wells, or storage caverns, that originate from a single main bore and can extend into one or more subterranean regions.

BACKGROUND

Conventional methods for constructing and performing operations on multiple wells, within a region, require numerous bores and conduits coupled with associated valve trees, wellheads, and other equipment for injection and/or production from each well, located within the region. The costs of the equipment for the construction, control and operation of these multiple wells can be extremely expensive, which, historically, has prevented development of reserves in the oil and gas industry. In addition, obtaining optimal production from each of these multiple wells can be a problem because each underground formation, has its own unique reservoir characteristics, including pressure, temperature, viscosity, permeability, and other characteristics that generally require specific and differing choke pressures, flow rates, stimulation means, etc. for overall production of wells in the region.

An embodiment of the present invention can include providing a manifold string, with a plurality of conduits forming a plurality of pressure barriers with at least one intermediate passageway or annular space, that can be usable to control pressurized, subterranean, fluid-mixture, flow streams, which can be controlled by the manifold string within passageways through subterranean strata for one or more subterranean wells, that can extend from a single main bore. Important uses of this aspect include, for example, constructing and/or operation of one or more subterranean wells from a single surface location, providing the opportunity for simultaneous well activities and/or common batch activities to be performed on a plurality of wells, without the need to remove established barriers, reposition a rig, and/or to re-establish barriers necessary for well control.

An additional embodiment of the present invention includes one or more manifold crossover apparatus, usable with a manifold string to selectively control an innermost and at least one intermediate concentric or annular passageway. The innermost passageway can be usable for communicating flow-controlling devices for engagement in one or more receptacles of a manifold string to provide, for example, the ability to selectively change controlling mechanisms and/or flow paths of subterranean pressurized fluids.

Another embodiment of the present invention enables fluid separation within a plurality of radial passageways that can communicate through orifices within the innermost passageway, with the radial passageways' diverting walls located within annular or concentric passageways, to direct fluid flow to the innermost passageway. Placing fluid controlling devices through the innermost passageway, for engagement within the manifold string, provides further control of fluid-mixture flow streams between passageways of the manifold crossover and the radially inward or radially outward disposed passageways, including the passageway surrounding the manifold string to, for example, enable the crossover of flow between the innermost and concentric passageways. This crossover of flow enables selective control of the flow in the concentric passageway by use of valves, which can be engaged to the innermost passageway for providing selective pressure control of one or more annular or concentric passageways, while retaining the ability to access wells through the innermost passageway.

In another embodiment of the present invention, conventional flow controlling devices are conveyable through the innermost passageway, for engagement within a receptacle or conduits of a manifold string, to selectively control fluid communication by diverting at least a portion of the fluid-mixture flow streams. An example of this embodiment includes the placement of a fluid motor and fluid pump, usable with gas expansion from an underground storage cavern for driving an impellor to pump and inject water for solution mining, during combined operations. An additional example includes, placement of an orifice piston, which can be usable with coiled tubing for under-balanced drilling.

In a related embodiment, flow control devices engagable within a manifold string, a manifold string receptacle, or a plurality of innermost passageway subterranean valves can be usable with one or more manifold crossovers to selectively control pressurized fluid, which can be communicated through the innermost passageway and/or one or more concentric passageways. The flow control devices can be used, for example, to replace traditionally unreliable annulus safety valves with more reliable tubing retrievable valves or, for example, to repair a failed tubing retrievable safety valve for controlling a concentric passageway of an underground storage, within depleted reservoirs or salt caverns, with an insert safety valve placed through the innermost passageway.

Another embodiment of the present invention enables the ability to divert all or a portion of a fluid-mixture flow stream to a another passageway, that can be disposed radially inward or radially outward for the purposes of carrying out simultaneous well construction, well production and/or well injection operations. The simultaneous well construction and/or well operations enables, for example, one or more under-balanced coiled tubing fish-bone sidetracks of a well to be performed more readily, while producing the well to reduce skin damage in a low permeability reservoir, or can further enable underground storage and solution mining operations to be performed simultaneously, thus removing the conventional requirement for a plurality of rig operations and/or high risk snubbing operations to strip out a dewatering string from a gas storage cavern.

Another embodiment of the present invention provides selective control for placing well construction fluid mixtures of gases, liquids and/or solids within a region of the passageway through subterranean strata, while removing pressurized subterranean fluids from the subterranean strata by over-balancing or under-balancing hydrostatic pressures, for example, during proppant frac stimulations, gravel packs and simultaneous underground storage and solution mining operations.

In still another embodiment, the present invention provides an orifice piston apparatus that can be engagable to a manifold crossover and through which cables or conduits may pass during, for example, under-balanced perforating or drilling operations. Engagement, placement and/or removal of the piston can be assisted by differential pressure applied to the face of the piston during simultaneous well construction, injection operations and/or production operations, including for example, performing a mechanical integrity test using a cable, passed through the orifice piston, to measure a gas liquid interface below the final cemented casing shoe of an underground storage cavern.

Another embodiment of the present invention includes the ability to commingle fluid mixture flow streams and/or to separate selected fluid mixture flow streams with an adapted chamber junction. The fluid flow from exit bore conduits can be commingled through the chamber or directed to intermediate concentric passageways disposed radially inward or outward of the chamber. The bore selector can be usable to communicate fluid and/or fluid control devices through the innermost passageway and chamber junction for selectively controlling one or more wells below a single main bore.

Another embodiment of the present invention provides adapted chamber junctions, usable within a single well passageway with a plurality of flow streams, wherein the innermost passageway of a chamber junction exit bore can be axially aligned with the innermost passageway of the chamber and the conduits axially above. At least one more exit bore conduit can contain a radial passageway that can be usable with a bore selector, fluid diverter, straddle, or other flow control device to fluidly communicate between the innermost passageway and the surrounding passageway, or another concentric intermediate passageway.

Another embodiment of the present invention, includes a reduced length manifold crossover with a plurality of radial passageways for communicating from the innermost passageway to the passageway surrounding the manifold string, or a radially outward concentric passageway using radially disposed small conduits, such that flow through the one or more intermediate concentric passageways effectively travels around and past the rounded shapes of the small conduits. In this embodiment, reduced length conventional flow controlling apparatus can be usable to selectively control flow through orifice connections with the innermost passageway to, for example, provide gradual axial adjustments of solution mining fresh water placement during the salt dissolution and/or storage process.

Embodiments of the present invention include methods for selectively controlling pressures, volumes and temperatures of fluids that can be stored and retrieved from a storage space. Examples of such methods include controlled pressurization of a storage cavern, using water or brine, during gas extraction to reduce or minimize the temperature reduction caused by retrieving compressed stored gas through expansion, thus providing a longer withdrawal period before reaching a minimum operating temperature for associated well equipment.

Other embodiments of the present invention include methods for selectively controlling a substantially water interface during solution mining and/or during re-filling of a cavern, for stored fluid extraction. These selective control methods affect the shape of the cavern walls to, in use, control working storage volumes and solution mining rates for varying storage volume turnovers and natural salt creep rates, usable for simultaneous underground hydrocarbon storage and solution mining operations over a number of years, and/or seasonal storage volume turn-overs.

Embodiments of the present invention can include methods for providing a subterranean brine reservoir with a stored product cushion for selectively controlling working volume and displacement of liquids or compressed gases to and from salt caverns, fluidly associated with brine reservoirs holding subterranean heated brine or generating displacement brine that can be fluidly communicated in u-tube like conduit, pumping and/or compression arrangements between caverns.

In related embodiments, the present invention can provide methods for removing salt gas storage cavern sunk construction cost by displacing conventionally irretrievable cushion gas cavern structural support inventories for preventing salt creep with brine from brine reservoirs during high demand, followed by gas refilling and brine displacement during periods of higher gas availability to, for example, improve the economic viability of constructing large scale salt cavern gas storage facilities, as compared to conventional depleted permeable sandstone reservoir storage.

In other embodiments, the present invention can provide methods usable to selectively access and fluidly communicate between a plurality of specific gravity separated fluids, that can be disposed in caverns and subterranean brine reservoirs connected with u-tube like conduit, pumping and/or compression arrangements engaged with manifold crossovers disposed with the caverns.

Still other embodiments of the present invention can provide methods usable to space salt storage caverns and brine reservoirs for salt pillar support within ocean environments, with pipeline or shipping access and an abundance of water and brine absorption capacity usable, for example, to access stored specific gravity separated liquid products above brine with boats and/or pipelines, while performing u-tube fluid communication with gas storage caverns to, for example, perform storage operations during periods of contrary demand between liquids and gas.

Finally, other embodiments of the present invention provide methods for the use of a fluid buffer for transportation pipelines and/or the selective access to fluids of differing specific gravity for use or disposal, for example, pigging pipelines of water and other fluids into a storage cavern, wherein the fluids are selectively accessed by a manifold crossover with specific gravity cavern separation of stored hydrocarbons from water/brine for environmentally safe ocean discharge.

Periodic catastrophic well failures within the well construction and operations industry continue to demonstrate the need for a plurality of conventional, high-strength, metallic conduit, pressure barriers with intermediate concentric passageways, that can be usable for monitoring annuli pressures that are associated with such pressure barriers, particularly as ever deeper and adverse geological reservoirs are targeted and/or more gas storage is required to meet increasing global hydrocarbon demand.

The practical need for improved methods and apparatus usable to more effectively contain subterranean pressures during well construction and production activities is increased by such activities being performed in the ever deeper and higher pressure subterranean regions, which are targeted for their highly productive rates. In addition, the ever increasing demand for under-balanced operations to reduce reservoir skin damage, or the increased need for large underground gas storage facilities placed under or around urban or environmentally sensitive areas, increase the need for such improved methods and apparatus.

Therefore, a practical need exists for apparatus and methods usable for placing a plurality of tubing-conveyed subterranean valves, to contain well pressures, for an associated plurality of passageways to pressurized subterranean regions. In addition, methods and apparatus usable to replace traditionally unreliable annular safety valves are needed, while retaining access to the innermost passageways of associated strings for measuring, monitoring and maintaining the lower end of a subterranean well, including, for example, engaging replacement insert valves and/or other flow control devices usable to construct passageways and control fluid communication and/or pressures within a well.

With the imminent approach of peak liquid hydrocarbon production worldwide, a need exists for lowering the risks and associated costs of developing remaining hydrocarbons. In particular, improved methods and apparatus for underground hydrocarbon gas storage, usable to replace various areas of liquid hydrocarbon and/or coal consumption, and shorten the timeframe for increased rates of return by, for example, enabling simultaneous construction and operation of underground storage wells with a more cost effective single rig visit and, thus, shortening the timeframe for return on investment while lowering cost by removing the conventional need for subsequent well interventions by large hoisting capacity rigs and/or the conventional need for potentially hazardous and expensive snubbing operations to remove dewatering strings from explosive hydrocarbon gas filled storage caverns.

With the size and productivity of conventional hydrocarbon discoveries decreasing, a need exists for methods and apparatus usable to reduce skin damage in low permeability reservoirs, where conventional methods cause permanent productivity loss.

A need exists for systems and methods for reducing underground cavern construction costs and for retaining innermost bore access, usable for sonar measurements taken from inside and/or outside a leaching string to provide information for better adjusting simultaneous underground storage and solution mining operations. These cost-effective systems and methods must be operable during combined solution mining and storage, especially when encountering unexpected geologic salt deposit features because stored product may prevent large hoisting capacity rig interventions during solution mining conventionally necessary to remove a completion to take a sonar measurement and/or to adjust the depth of the outer leaching string, that controls the depth at which a substantially water interface is placed within a salt dissolution zone.

A need exists for systems and methods for providing improved, cost-effective construction and operation of underground gas storage, particularly within a depleted reservoir sealed by a subterranean cap rock within a dip closure or geologic trapping features, wherein the risk of skin damage to the reservoir's permeability during, or subsequent to, injecting and storing gas results in the need for improved, cost-effective, low skin damage construction and operation. A need exists for systems and methods for providing improved, cost-effective and higher-efficiency permeability retention under-balanced well construction and/or completion operations in, for example, depleted gas storage reservoirs or valved dual conduit completions in gas tight salt cavern reservoirs to, for example, increase working storage volume associated with decreases in required cushion gas volumes required to maintain cavern stability, including the ability to cost-effectively empty a gas storage cavern for seasonal demand requirements.

In analogous well operations, a need exists for valved concentric dual conduit apparatuses and methods usable from a single bore wellhead and valve tree for pressure containment while water flood stimulating of a hydrocarbon reservoir through a single main bore, while producing through the same single main bore for reduced construction cost economic extraction in, for example, instances of insufficient nature economic hydrocarbon flow rate pressures.

With the use of valved dual conduits, a further need exists for storing products in a cushion during simultaneous solution mining and storage operations of brine and storage reservoirs, usable to selectively control working volume and displacement of liquids or compressed gases to and from other salt cavern brine and storage reservoirs, where brine may be subterranean heated and stored or generated during displacement operations through u-tube conduit arrangements between two or more brine and storage reservoirs with fluid pumping and/or compression to, for example, remove the need for cavern stability cushion gas.

With peak hydrocarbon production and the associated changes in consumer demands, a need exists for contra-seasonal storage of gas and liquid hydrocarbons in the same brine and storage reservoir caverns, with selective access to the plurality of specific gravity separated fluids that can be disposed within the reservoirs.

A related economic need exists for reducing salt gas storage cavern sunk construction cost by displacing conventionally irretrievable cushion gas cavern structural support inventories, during high demand periods, with gas refilling and brine displacement during lower demand periods, improving economic viability of larger scale storage facilities.

A related operational need exists for large scale storage facility cavern brine and storage reservoir salt pillar support within an open ocean environment with more flexible fluid communication with pipelines, ships and an abundance of water and brine absorption capacity.

With exploration, transportation and storage of hydrocarbons entering ever more challenging environmentally sensitive and potentially hostile areas, such as the oceans or arctic climates, a need exists for methods and apparatus of smaller foot prints usable to provide a plurality of pressure containing barriers, wherein annuli and passageways between pressure barriers are selectively controllable during well construction and/or well operations, including for example, production during underbalanced perforating and drilling within low permeability reservoirs, production during underbalanced gravel packs within unconsolidated reservoirs, and/or simultaneous gas storage and solution mining for day trading, transportation pipeline buffer storage, and/or pigging in an offshore environment.

Embodiments of the present invention address these needs.

SUMMARY

The present invention relates, generally, to manifold crossover member apparatus, systems, and methods usable for providing pressure containment and control when constructing and/or operating a manifold string, and during hydrocarbon operations, storage and/or solution mining operations, with at least two conduits and fluid separated passageways through the subterranean strata, for one or more substantially hydrocarbon and/or substantially water wells, or cavern brine and storage reservoirs, that originate from a single main bore and can extend into one or more subterranean regions.

Embodiments of the present invention can include apparatus (23C of FIGS. 6, 17-20 and 22-26; 23F of FIGS. 3, 6, 9-12, 21-26 and 30-31; 23I of FIGS. 31-34; 23T of FIGS. 6, 11-12, 31 and 54-58; 23Z of FIG. 38; 23S of FIGS. 10, and 42-44; and 23V of FIGS. 71-73) and methods (CS1 to CS8 and CO1 to CO7 of FIGS. 3, 5-6, 9-14, 59-62, 66-71 and 81, 1S of FIGS. 9-10, 12-14, 75-76 and 80-83, 1T of FIGS. 76-77 and 80-83, and 157 of FIGS. 82-83), that can be usable with a manifold string (70 of FIGS. 3, 9-11, 30-31, 38 and 80) or a plurality of wells manifold string (76 of FIGS. 6, 11-12 and 54-58), with one or more fluidly communicating manifold crossovers (23) forming a subterranean manifold string. The subterranean manifold string can comprise an upper end plurality of concentric conduits (2, 2A, 2B of FIGS. 17, 21, 31-32, 38, 42 and 71-73, 2C of FIGS. 32 and 71-73, 2D of FIGS. 71, 39), that can be engagable to a valve tree (10 and 10A of FIGS. 1, 3, 6-10, 13-14 and 80-81) and usable with selectively controllable surface valves (64 of FIGS. 1, 3, 6-10, 13-14 and 80-81), and a lower end plurality of conduits (2, 2A, 2B, 2C, 2D, 39), that can be arranged (CS1 to CS7 of FIGS. 3, 5-6 and 9-12), configured (CS8 of FIGS. 59-62 and 66-71) and/or assembled (146 of FIGS. 59 and 62, 1S, 1T 157) for fluidly communicating with one or more subterranean regions through an innermost passageway (25), that can be usable for communicating fluid mixtures and flow control devices (61 of FIGS. 9-12, 15, 22-31, 35-36, 39-41, 43-44, 51-53, 55-58 and 63-65), engagable within a bore or with a receptacle (45 of FIG. 18) disposed between radial passageway (75 of FIGS. 18-19, 22-26, 33-34, 38, 43-44, 54-57 and 71-73), and/or orifices (59 of FIGS. 18-19, 22-26, 33-34, 43-44 and 55-58), which can fluidly communicate between said innermost passageway (25) and a concentrically disposed passageway (24, 24A, 24B, 24X, 24Y, 24Z, 55). A wall of a manifold crossover and/or a selectively placed fluid control device can be used to divert fluid-mixture flow streams of gases, liquids and/or solids. The flow streams can be diverted from one passageway to another radially disposed inward or outward passageway. The diversion of the flow streams serves to, in use, selectively control pressurized fluid communication through a plurality of concentric conduits and passageways through subterranean strata, which can extend axially downward from one or more wells from a single main bore (6), with a plurality of pressure barriers (7, 10, 10A, 61, 64, 74, 148, 149) to perform pressurized fluid well construction, injection, and/or production operations (CO1 to CO7 of FIGS. 3, 6 and 9-14), either individually or simultaneously.

Embodiments of the present invention can further include methods that can be usable with a manifold string (70 of FIGS. 3, 9-11, 30-31 and 38) or a plurality of wells manifold string (76 of FIGS. 6, 11-12 and 54-58) and/or conventional well designs (for example FIGS. 1, 4, 7-8 and 13-14) for pressure-contained, simultaneous, underground, hydrocarbon storage and solution mining operations (1S of FIGS. 9-10, 12-14, 75-76 and 80-83). The method steps can include providing two or more conduit strings (2, 2A, 2B of FIGS. 17, 21, 31-32, 38, 42 and 71-73; 2C of FIGS. 32 and 71-73; 2D of FIGS. 71, 39) that can be engagable to one or more wellheads (7) and valve trees (10 and 10A of FIGS. 1, 3, 6-10 and 13-14) for selectively communicating fluid mixtures of gases, liquids and/or solids into, and from, at least one region at the lower end of a passageway through subterranean strata, within a salt deposit (5), that can be usable for storing hydrocarbons and salt dissolution. The method steps can further include providing water, salt-inert fluids, and/or hydrocarbons within the region to form a cushion between the final cemented casing (3) shoe (16) and a substantially water interface, usable to form a storage cushion space and further usable with said two or more conduit strings to provide a plurality of barriers (7, 10, 10A, 61, 64, 74, 148, 149) for pressure contained underground hydrocarbon operations (CO1-CO2), storage (1S, 1T) and/or to and from a storage cushion space, during further solution mining operations (1S, 1T and CO1 to CO7).

Embodiments of the present invention can use a manifold string (70Q of FIG. 3, 70R of FIG. 9, 70T of FIG. 10, 70U of FIG. 30, 70W of FIG. 31, 70G of FIG. 38, 76M of FIG. 6, 76N of FIGS. 11-12, 76H of FIGS. 54-58) with one or more manifold crossovers (23 of FIGS. 3, 6, 9-12, 17-26, 30-34, 38, 42-44, 54-58, 71-73 and 80), that can be usable with one or more flow controlling devices (61 of FIGS. 9-12, 15, 22-31, 35-36, 39-41, 43-44, 51-53, 55-58 and 63-65) to selectively control pressurized subterranean fluid-mixture flow streams within a passageway through subterranean strata (52), for one or more subterranean wells extending from a single main bore (6).

Various simultaneous underground storage and solution mining preferred method embodiments (CO6 of FIGS. 14 and 81, and CO7 of FIGS. 13 and 81) of the present invention can be usable with conventional wells of two or more string construction, which are capable of containing a pressurized storage cushion (1S) while injecting water to displace storage and/or solution mine a cavern wall (1A).

Preferred embodiments of the present invention can use a manifold crossover apparatus (23) with a first plurality of conduits at an upper end (2, 2A, 2B of FIGS. 17, 21, 31-32, 38, 42 and 71-73, 2C of FIGS. 32 and 71-73, 2D of FIG. 71) and a second plurality of conduits at a lower end, wherein the first plurality of conduits can form at least one intermediate concentric passageway (24, 24A and 24B of FIGS. 71-73, 24X and 24Y of FIGS. 17-20, 22-23, 25-26 and 32-34 and 24Z of FIGS. 32-34), that can be disposed about an inner passageway (25), which can be usable for communicating fluids and devices that can be engagable within the passageway or with at least one receptacle (45), wherein engaged fluid control devices (61, 128 of FIGS. 6, 27-28) can be usable to selectively control fluid communication.

Fluid communication between passageways can occur through fluidly separated first and at least second radial passageways (75 of FIGS. 18-19, 22-26, 33-34, 38, 43-44, 54-57 and 71-73), that can be associated with first and at least second radial passageway orifices (59 of FIGS. 18-19, 22-26, 33-34, 43-44 and 55-58) that are connected to the innermost passageway (25). At least one passageway can be at least partially blocked from fluid communication by a wall across the passageway or by a fluid control device (61) between the manifold crossover upper end plurality of concentric conduits and the manifold crossover lower end plurality of concentric or non-concentric conduits (2, 2A, 2B, 2C, 2D, 39), comprising a lower end concentric string or lower end chamber junction (43 of FIGS. 38, 45-46, 48-50, 54-59, 61, 66-67 and 71-73), respectively.

Fluid-mixture flow streams can be diverted from one passageway to another disposed radially inward or outward passageway from the diverted passageway of a manifold crossover, located between said upper end plurality of concentric conduits and said lower end plurality of conduits to, in use, control pressurized fluid communication within the innermost passageway (25), a surrounding passageway (55), and/or an intermediate (24, 24A, 24B, 24C, 24X, 24Y, 24Z) passageway, that can be formed by a plurality of concentric conduits within the passageway through subterranean strata (52), that can extend axially downward from one or more wells from a single main bore (6), during well construction and/or well operations.

Various manifold crossover embodiments (23C of FIGS. 6, 17-20 and 22-26, 23F of FIGS. 3, 6, 9-12, 21-26 and 30-31 and 23I of FIGS. 31-34) of the present invention can fluidly segregate an intermediate concentric passageway, circumferentially, to form fluidly separate axial passageways (24X, 24Y, 24Z). The fluidly separate axial passageways can be associated with radial passageways (75), which are at least partially blocked from fluid communication between the upper and lower ends by one or more walls for diverting fluid through the radial passageway orifices (59), communicating with the innermost passageway (25), at axially opposite sides of a receptacle (45), usable for engagement of a flow controlling device (61), wherein blocking the innermost passageway causes flow streams to crossover between the innermost passageway and at least one concentric passageway (24, 24A, 24B, 24C, 24X, 24Y, 24Z, 55).

Embodiments can further include various related manifold crossover embodiments (23F of FIGS. 3, 6, 9-12, 21-26 and 30-31; 23I of FIGS. 31-34; and 23S, 23T, 23V and 23Z of FIG. 31) with subterranean valves (74 of FIGS. 1, 3, 6, 8-10, 13-14, 22-26 and 30-31, and 74A, 74B and 74C of FIGS. 30 and 31), that can be engaged to an innermost conduit string (2), at the ends of the string (2) and between manifold crossovers to selectively control pressurized fluid communicated through passageways for forming a valve-controlled manifold crossover assembly.

Other preferred manifold crossover embodiments (23I of FIGS. 31-34, 23S of FIGS. 10, 31 and 42-44, and 23Z of FIGS. 31 and 38) can use at least one radial passageway (75) to fluidly communicate between the innermost passageway and at least one additional concentric passageway (24A, 24B, 24C, 55), that can be formed by a concentric string (2A, 2B, 2C, 2D) and/or passageway through subterranean strata (52) by passing through at least one intermediate concentric passageway (24) formed by the plurality of conduits.

Other various manifold crossover embodiments (23T of FIGS. 6, 11-12, 31 and 54-58, 23V of FIGS. 31 and 71-73, 23Z of FIGS. 31 and 38) can use fluidly separated radial passageways (75), comprising associated passageways of exit bore conduits (39) of a chamber junction (43), that communicate through radial passageway orifices (44, 59) with the innermost passageway of the upper end plurality of concentric conduits (2, 2A, 2B, 2C, 2D). At least one additional radial passageway can fluidly communicate between the innermost passageway of at least one exit bore conduit and at least one axial passageway (24, 24A, 24B, 24C, 24X, 24Y, 24X, 55), that is formed by extending the upper end plurality of concentric conduits to surround and/or engage the exit bore conduit or a supporting fluid conduit (150 of FIGS. 68-73), with a bore selector (47 of FIGS. 3, 35-37, 47, 51-53, 59 and 63-65, 47A of FIGS. 35-36 and 39-41) usable to selectively communicate fluids and fluid control devices through the innermost passageway of the chamber junction exit bores for engagement with a receptacle to selectively control fluid communication through and/or between passageways.

Various construction method embodiments (CS1 to CS8 of FIGS. 3, 5-6, 9-12, 59-62 and 66-71) are usable to provide a plurality of conventional metallic conduit pressure barriers with intermediate passageways for pressure monitoring with, for example, annulus gauges (13 of FIG. 1) for measuring pressures between a secondary barrier (148 of FIGS. 60-70) and a potential failure of a primary barrier (149 of FIGS. 60-70).

In other manifold crossover embodiments (23T of FIGS. 6, 11-12, 31 and 54-58, 23V of FIGS. 31 and 71-73), chamber junctions can be usable with a construction method (CS8 of 59-62 and 66-71) to provide a plurality of conventional sized conduits within a single main bore, which can be further usable for securing connectors of fluid communicating conduit or solid-construction, arranged concentrically or radially, within a secondary pressure bearing conduit, wherein engagement of primary and secondary full-pressure bather conduit strings and/or provision of a pressure relief reservoir, such as exposed fracturable strata below a casing shoe, can be used to limit pressure exerted on the secondary pressure bearing conduit, should the primary conduit fail.

Manifold crossover embodiments (23Z of FIGS. 31 and 38) of the present invention can use an exit bore conduit (39) innermost passageway (25), that can be axially aligned to the chamber (41) axis with an upper end plurality of concentric conduits extended, to surround the axially aligned exit bore conduit with at least one other exit bore conduit, that passes through at least one intermediate concentric passageway (24, 24A, 24B, 24C, 24X, 24Y, 24Z) to fluidly communicate with a different intermediate concentric passageway (24, 24A, 24B, 24C, 24X, 24Y, 24Z) or the surrounding passageway (55). A bore selector (47, 47A) or flow control device (61) can be usable to selectively control fluid communication through radial passageways formed by the exit bores. Additional radial passageways and associated orifices can be usable with the flow diverter (21 of FIGS. 9 and 38) manifold crossover (23Z) to crossover between the innermost passageway (25) and an adjacent concentric passageway (24).

Other manifold crossover embodiments (23S of FIGS. 10, 31 and 42-44) can use fluidly separated radial passageways, with a first radial passageway comprising a straddle (22 of FIGS. 35-36, 39-41 and 43-44) bore axially aligned to the innermost passageway (25) for fluidly separating at least part of at least a second radial passageway, that can comprise a conduit passageway passing through the intermediate concentric passageway (24), between a plurality of concentric conduits (2, 2A, 2B, 2C, 2D) to fluidly communicate between the innermost passageway (25) and a different intermediate concentric passageway (24, 24A, 24B, 24C, 24X, 24Y, 24Z) or the surrounding passageway (55). The straddle (22) can be conveyable through the innermost passageway and engagable with a receptacle to selectively control fluid communication, by choking at least part of the at least second radial passageway.

Various flow controlling devices (61), including an orifice piston embodiment (128 of FIGS. 6, 27-28), can be conveyable through the innermost passageway (25) with, for example, a wireline rig (4A of FIG. 16), for engagement to at least one receptacle (45). Placement and removal of the flow controlling devices can be assisted by greater differential pressure applied to an axial upward or axially downward piston surface, wherein cables or conduits are passable through at least one orifice (59) of an orifice piston (128), while using the piston surface to divert at least a portion of fluid mixture flow streams to a passageway other than the innermost passageway.

Construction method embodiments (CS1 of FIG. 3, CS2 of FIG. 5, CS3 of FIG. 6, CS4 of FIG. 9, CS5 of FIG. 10, CS6 of FIG. 11, CS7 of FIG. 12 and CS8 of FIGS. 59-63 and 66-71) can be combinable with hydrocarbon operations method (CO1 of FIG. 3, CO2 of FIG. 6, CO3 of FIG. 9, CO4 of FIG. 10, CO5 of FIG. 12) embodiments, for using at least one manifold crossover apparatus (23C, 23I, 23S, 23T, 23V, 23Z) to form a manifold string, or with two or more conduit string pressure-controllable conventional wells (CO6 of FIG. 14, CO7 of FIG. 13) for selectively controlling pressurized subterranean fluid-mixture flow streams within the passageway through subterranean strata (52), for one or more subterranean wells extending from a single main bore (6).

Embodiments of the construction and operation methods (CS1-CS8 and CO1-CO5), respectively, can include at least one manifold string (70, 76) with a plurality of concentric conduits (2, 2A, 2B, 2C, 2D) for engaging with an associated plurality of manifold crossover conduits, with at least one intermediate concentric passageway (24) disposed about an innermost passageway (25) that can be usable for communicating fluids and devices, with at least one receptacle (45) usable for engaging fluid control devices (61) to selectively control pressurized fluid communication, The method embodiments (CS1-CS8 and CO1-CO5) can be usable for communicating fluid-mixture flow streams through manifold crossover (23) fluidly separated radial passageways (75) and associated orifices (59) to the innermost passageways (25).

Method embodiments (CS1-CS8 and CO1-CO5) can further include diverting at least a portion of the communicated fluids-mixture flow streams to a different passageway that can be disposed radially inward or outward from the diverted passageway of a manifold crossover (23), between the upper end of a manifold string or crossover plurality of concentric conduits and the lower end manifold string or crossover plurality of conduits to, in use, control pressurized fluid communication within the innermost passageway (25), intermediate concentric passageway (24, 24A, 24B, 24C, 24X, 24Y, 24Z), and/or the surrounding passageway (55), that can be formed between the plurality of conduits (2, 2A, 2B, 2C, 2D, 39) and the passageway through subterranean strata (52) extending axially downward from one or more wells from a single main bore (6).

The method embodiments (CS1-CS8 and CO1-CO7) can also include providing subsea or surface valve trees (10, 10A) with subsea or surface valves (64) and/or subterranean valves (74), usable with control lines (79 of FIGS. 1 and 22-26) engaged to each of the ends of the innermost conduits (2, 39) of a manifold crossover (23) to selectively control at least a portion of the pressurized fluid that is communicated between the innermost passageways (25) and at least one concentric passageway (24, 24A, 24B, 24C, 24X, 24Y, 24Z, 55).

Other method embodiments (CS1-CS8 and CO1-CO7) include providing flow controlling devices (61), which can be communicated through the innermost passageway (25) and engaged within a bore (25) and/or receptacle (45) of a conduit string to selectively control fluid communication, by diverting at least a portion of the communicated fluid mixture flow streams.

Other method embodiments (CS1-CS8 and CO1-CO5) include providing an orifice piston (128) flow-controlling device (61), placeable and removable from a bore (25) or a receptacle (45) of a manifold string (70, 76) by greater differential pressure applied to an axially upward or axially downward piston surface, wherein cables (11 of FIG. 15) or conduits can be placeable through the orifice piston, while diverting at least a portion of the communicated fluid-mixture flow streams to a passageway other than the innermost passageway.

Various method embodiments (1T, CS1-CS8 and CO1-CO7) can be usable for selectively controlling communication of fluid mixtures of gases, liquids and/or solids between the upper ends of a single main bore (6) and a proximal region of the passageway through subterranean strata (52) to overbalance, balance, or under-balance hydrostatic pressures exerted on the proximal region during fluid communication.

Combined operations method embodiments (1S, 1T, CS1-CS8 and CO1-CO7) include providing salt-inert fluids and/or hydrocarbons, within a subterranean region, for forming a cushion between the final cemented casing shoe and a substantially water interface, usable to form a storage cushion space and/or solution mine using a salt dissolution process.

Other combined operations method embodiments (CS1-CS8 and CO1-CO7) can be usable with two or more strings (2, 2A, 2B, 2C, 2D, 39) for selectively controlling pressurized fluid communication between a valve tree (10, 10A) and region of the passageway through subterranean strata (52) to selectively control a substantially water interface, with a valve tree and salt-inert or hydrocarbon fluids, to form a storage cushion space to, in use, simultaneously provide pressure contained underground hydrocarbon storage operations (1S of FIGS. 9-10 and 12-14) to and from the storage cushion space during further solution mining operations (1 of FIGS. 7, 9-10 and 12-14).

Various combined operations method embodiments (1S, 1T, 157, CS1-CS8 and CO1-CO7) can replace conventional methods (CM1 of FIG. 1, CM2 of FIG. 4, CM3 of FIG. 7 and CM4 of FIG. 8), or supplement conventional well designs (CM5 of FIGS. 13-14 and 81), with an apparatus and/or methods of the present invention to selectively control fluid mixture communication to one or more wells from a single main bore (6).

Other various method embodiments (1S, 1T, CS1-CS8 and CO1-CO5) can be usable for controlling pressurized fluid communication of salt-inert or hydrocarbon fluids, that are stored and retrieved from a cushion with a valve controlled manifold crossover to selectively control the substantially water interface for causing salt dissolution, to affect associated working pressures, volumes, and temperatures of fluids stored and retrieved from a storage space and/or the rate of solution mining during combined solution mining and storage operations.

Other method embodiments (1T, CS1-CS8 and CO1-CO7) can be usable for controlling the shape of the cavern walls with a selectively controlled, substantially water interface, that can result from pressurized fluid communication to control working storage volumes and solution mining rates for varying storage volume turnovers and natural salt creep rates, during underground hydrocarbon storage and solution mining operations (1S).

Still other method embodiments (1T, 157) provide water to a substantially water or fluid interface to generate and displace brine, at a lower end of a first brine and storage reservoir via a u-tube conduit arrangement, to at least a second brine and storage reservoir to minimize salt dissolution in at least the second brine and storage reservoir during such operations.

Other related method embodiments (1T, 157) provide selective control of pressurized fluid communication of salt inert or stored fluids, stored and retrieved from a salt cavern cushion, to affect associated working pressures, volumes and temperatures of fluids stored and retrieved from a brine and storage reservoir and/or working storage volumes, solution mining rates, salt creep rates, or combinations thereof, until reaching the maximum effective diameter for salt cavern stability after which salt inert fluids are stored.

Still other method embodiments (157) comprising arranging and separating one or more reservoirs to provide salt pillar support according to pressures of fluids stored within and effective diameters of said brine and storage reservoirs.

Finally, other various method embodiments (1S, 1T, CS1-CS8 and CO1-CO7) can be usable for providing an underground fluid buffer for transportation pipelines, well production, and/or underground storage operations, wherein a storage cushion space can be further usable for separating fluids of differing specific gravity and for selectively accessing the separated fluids through a manifold crossover.

BRIEF DESCRIPTION OF THE DRAWINGS

Preferred embodiments of the invention are described below by way of example only, with reference to the accompanying drawings, in which:

FIGS. 9 to 14 depict method embodiments for constructing wells and underground storage spaces from a single well and/or a plurality of wells extending from a single main bore.

FIGS. 15 to 16 show prior art apparatus usable with the present invention.

FIGS. 17 to 20 illustrate an embodiment of a manifold crossover of the present invention.

FIG. 29 illustrates a fluid pump apparatus of the present inventor usable to selectively control fluid flow streams within embodiments of the present invention.

FIGS. 30 and 31 are diagrammatic illustrations of the manifold crossover embodiments of the present invention.

FIGS. 32 to 34 depict a manifold crossover embodiment of the present invention with additional intermediate concentric passageways.

FIGS. 35 to 37 illustrate apparatus of the present inventor usable to selectively control fluid flow streams within embodiments of the present invention.

FIG. 38 illustrates an embodiment of a manifold crossover of the present invention adapted from flow diverting strings of the present inventor.

FIGS. 39 to 41 show various views of an adapted prior art apparatus usable as a bore selector with the present invention.

FIGS. 42 to 44 illustrate a manifold crossover embodiment of the present invention usable to reduce the length of a manifold crossover.

FIG. 74 diagrammatically depicts a subterranean liquid storage using brine displacement from a brine pond.

FIG. 75 diagrammatically illustrates an embodiment with u-tube like fluid communication between an underground storage cavern and associated subterranean brine reservoir.

FIG. 76 diagrammatically shows an embodiment with pumping, turbine or compressed fluid communication through surface conduit manifold between an underground storage cavern and associated subterranean brine reservoir.

Embodiments of the present invention are described below with reference to the listed Figures.

DETAILED DESCRIPTION OF THE EMBODIMENTS

Before explaining selected embodiments of the present invention in detail, it is to be understood that the present invention is not limited to the particular embodiments described herein and that the present invention can be practiced or carried out in various ways.

Referring now to FIGS. 1 to 14, comparisons of the construction methods CS1, CS2, CS3, CS4, CS5, CS6 and CS7 of FIGS. 3, 5, 6, 9, 10, 11 and 12, respectively, and combined construction and operations methods CO1, CO2, CO3, CO3, CO4, CO5, CO6 and CO7 of FIGS. 3, 6, 9, 10, 12, 14 and 13, respectively, to the prior art hydrocarbon conventional methods CM1, CM2 and underground storage conventional methods CM3 and CM4 of FIGS. 1, 4, 7 and 8, respectively, are shown. Conventional construction methods are generally not combinable with conventional operations, for various reasons, including an inability to selectively control operating pressures during well construction and/or to place a plurality of metallic conduit barriers between potentially explosive hydrocarbon production and personnel performing the construction actives.

Figure 1:
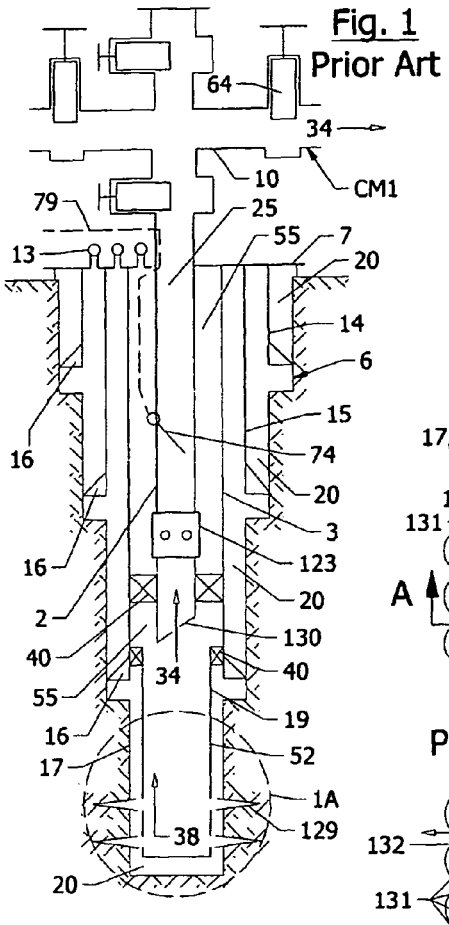
Fig. 1 Prior Art
FIGS. 1 and 2 depict a subterranean well and the concept of permeability skin damage, respectively.

FIG. 1 depicts an elevation diagrammatic cross-sectional view of a conventional subterranean well construction method (CM1), usable for various hydrocarbon or underground storage wells. The Figure depicts a lower perforated (129) cemented (20) liner (19) portion that can be replaced with a subterranean storage space of a geologic trap (1A), of a depleted reservoir, or a space that was solution mined from the strata bore (17) to salt cavern walls (1A), wherein a sliding door (123) is, generally, not present.

The upper end of the subterranean wells of the present invention can be constructible by boring a strata passageway (17) and placing a conductor (14) casing, that can be secured and sealed to the bore with cement and referred to as a casing shoe (16), after which boring, placing and cementing one or more intermediate casings (15) and sealing casing shoes (16) can occur before placing the final cemented (20) casing (3) and casing shoe (16). Chamber junctions and manifold strings of the present inventor can be usable as, or placeable through, the intermediate casings.

Generally, boring a final strata passageway (17) through the final cemented casing (3) to the targeted subterranean region can be followed by an open hole completion in, for example, solution mined wells or the depicted cemented (20) and perforated (129) liner (19) within, for example, hydrocarbon production wells or waste disposal wells.

While liners (19) are, generally, engaged to intermediate (15) and/or final cemented casing (3) with a hanger and packer (40), non-liner casings (3, 14, 15) are typically engaged to a wellhead (7), wherein intermediate concentric passageways or annuli are monitored with gauges (13) for pressure changes, indicating a breach of the primary barrier (2) or loss of integrity with secondary barriers (3, 15, 19), containing released subterranean pressurized fluid.

Production conduits (2) or tubing generally form the primary barrier, located within the passageway through subterranean strata (52) and comprising passageways of casings (3, 14, 15), liners (19) and strata bores (17). The production tubing or production casing can be secured to the final cemented casing (3) or liner with a production packer (40) at its lower end and with the upper end secured to the wellhead (7) to form the primary barrier to subterranean pressurized fluids.

A valve tree (10) with selectively operable valves (64) can be engaged to the upper end of the wellhead. For conventional solution mined wells, production and injection conduits (2, 2A) may be free hanging from the valve tree during the salt dissolution process, as described in FIG. 7, after which a completion, similar to that shown in FIG. 1, may be installed for underground storage operations.

The innermost passageway (25) can be controllable by a subterranean valve (74), that can be operated with a control line (79) and can be engaged between conduits of the production (34) or injection conduit string (2), which can be equipped with a sliding side door (123) to allow limited fluid communication between the concentric or surrounding passageway (55) and the innermost passageway (25). The sliding side door can be usable for various construction methods, but generally closed for fluid mixture (38) production (34), with the annular passageway (55) used primarily for monitoring the primary pressure control barrier (2) and secondary barrier (3) conduit strings.

In comparison, various apparatus and methods of the present invention provide a usable additional intermediate concentric passageway between the innermost passageway (25) and surrounding passageway (55), and/or provide an outer string to replace the final cemented casing (3) for installing a completion with the final cemented casing string, unlike conventional methods (CM1).

Convention methods for controlling subterranean pressures with a completion, for example 2, 40, 74 and 123, placed within the well bore with a heavy brine or drilling mud of greater hydrostatic head to control subterranean pressures of a exposed strata bore (17), without a liner (19, 20, 40), are generally secured with a production packer (40) that is engaged between the tubing (2) and a final cemented casing (3), after which the valve tree (10) is installed with the sliding side door (123) opened to remove the pressure controlling heavy brine or drilling mud from the annular space (24), before closing the sliding side door (123) and flowing (34) fluid mixtures (38).

In comparison, various methods of the present invention provide a manifold crossover that can be usable to selectively control fluid communication during construction, replacing, for example, the sliding side door (123) for use during production and/or injection operations, to provide a selectively controllable subterranean manifold for controlling one or more wells from a single main bore (6), unlike conventional methods (CM1).

Other conventional methods for pressure control include, for example, placing a completion (2, 40, 74), without a sliding side door (123), within a completion fluid using a liner (19), that is cemented (20) across the strata bore (17), sealed with a liner top packer (40), and secured with a hanger to the final cemented casing (3) to control subterranean pressures, while the valve tree (10) is placed to control subterranean pressures. After which, a rig (4A of FIG. 16) can be usable to place perforating guns through the safety valve (74), temporarily disabling the valve, past a wireline re-entry guide (130) to perforate (129) the passageway through subterranean strata (52) in with an over-balance or limited underbalance to prevent pushing and tangling perforating guns and the cable they were placed with, after which the perforating guns and rig are removed in a controlled pressure operation.

In comparison, various apparatus and methods of the present invention provide a means of forming a significant under-balance by circulating through an additional passageway to, for example, perform underbalanced perforating or drilling through a completion, as later described.

Maintaining control of subterranean pressures during construction and subsequent injection, or production to or from the subterranean strata through well passageways, is a central axiom of well operations that affects virtually every activity from selection of casings, liners and associated equipment to the fluids placed within the passageway through subterranean strata (52) to hydrostatically hold back fluid mixtures (38) prior to pressure controlled production (34) through a valve tree (10). In some instances, such as drilling and well construction activities in low permeability subterranean reservoirs, long term productivity may be damaged by conventional over-balance methods of controlling subterranean pressures.

In lower pressure or lower permeability reservoirs, skin damage (135 of FIG. 2) may occur during, for example: drilling of the reservoir, placement of the completion in an open hole, and/or during conventional methods of over-balanced perforation, when under-balancing the reservoir risks causing perforating guns to be pushed upwards and tangling wirelines and/or sticking the perforating string and rendering the safety valve (74) and valve tree (10) inoperable, until the guns and conveyance apparatus are removed from the path of closing valves.

Figure 2:
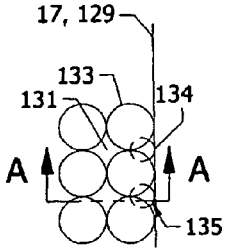
Fig. 2 Prior Art

Referring now to FIG. 2, the Figure depicts a plan view above an elevation cross-section with and along line A-A, with dashed lines showing hidden surfaces, showing the conventional concept of permeability skin damage (135), with larger reservoir particles (133), such as sand grains in a reservoir, packed together by subterranean pressures. Bridging across particles forms intermediate pore spaces (131) within which fluid mixtures of compressed gases, liquids and smaller solid particles may be contained. When pore spaces (131) are connected sufficiently to flow fluid mixtures, the connected pore spaces are permeable (132).

Fluid mixtures contained within pore spaces (131) are subjected to the subterranean overburden pressure with permeability (132) providing a passageway through which fluid mixtures may migrate, wherein their fluid connection to deeper subterranean overburden forces pressurizes shallower permeable (132) pore spaces (131).

Controlling subterranean pressurized fluid mixtures in permeable pore spaces, adjacent to a bore hole (17) or perforation tunnel (129), requires a higher hydrostatic or dynamic head fluid mixture within the bore (17) or perforation (129) acting against pore (131) pressure, that can hydraulically force smaller particles (134) or liquids, for example the particles or liquids in low permeability gas reservoirs, into the throat of low permeability adjacent pore spaces (131). However, insufficient pressure and/or surface area can force the particles or liquids out of the pore spaces (131) during production, thus causing skin damage (135). Reservoirs with low permeability or flow capacity through these skin-like pore spaces (131) can have insufficient pressure and/or flow area against the choking particles (134), or capillary forces of the liquid, to force intruding fluid mixtures back out of the pore throats, which can result in permanent skin damage (135) that affects productivity throughout the remaining well life.

Figure 3:
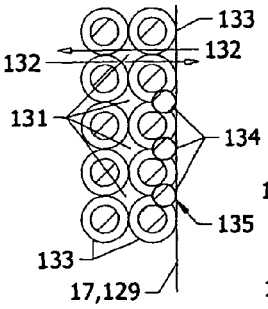
FIG. 3 illustrates an embodiment of the present invention usable to reduce the impact of skin damage and/or solution mine a cavern.
Figure 3:
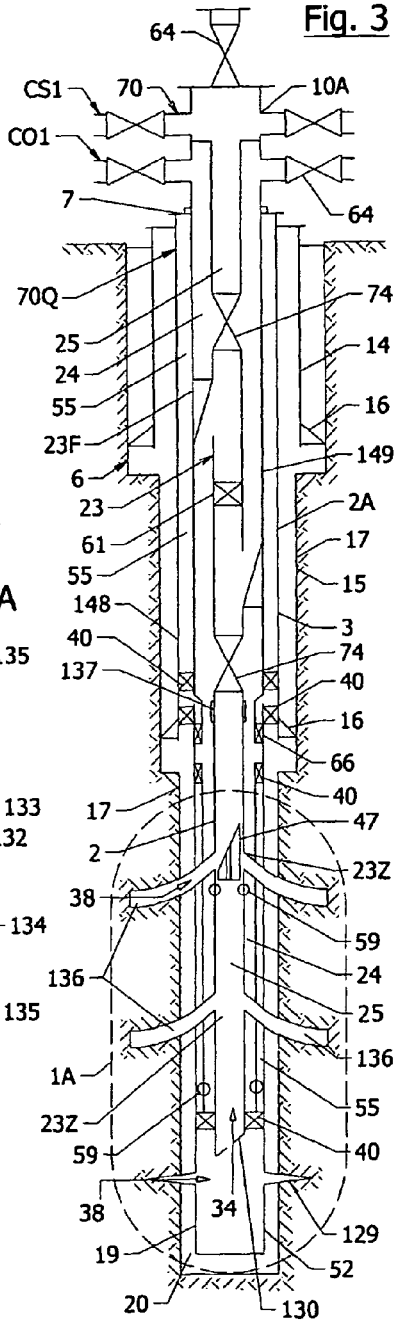

FIG. 3 depicts an elevation diagrammatic view through a cross-sectional slice of the subterranean strata of an embodiment of construction (CS1) and hydrocarbon operations (CO1) methods, which include a manifold string (70Q) of the present inventor. The manifold string (70Q) can be usable with embodiments of manifold crossovers (23F, 23Z), as shown in FIG. 3. In addition, the Figure shows various conventional well construction elements, similar to that shown in FIG. 1, with a dual spool tree (10A) capable of flow through the innermost bore (25), and a concentric passageway (24) engaged to the wellhead (7) and a completion string (2) that can comprise a manifold crossover (23F), with inner (2) and outer (2A) conduit strings engaged to the final cemented casing (3) and a production packer (40) sealed (66) to the liner (19) at its upper end. A production conduit (2), with another manifold crossover (23Z) within the surrounding (55) passageway through subterranean strata (52), can be usable to perform a series of fishbone sidetracks (136), wherein production packers (40), engaged to the liner (19), separate various producing zones with the lowermost zone perforated (129).

The construction (CS1) and hydrocarbon operations (CO1) methods depict a manifold crossover (23F) that can be usable to provide production and/or injection through either the innermost (25) or concentric (24) passageways. The lower conduit string (2) flow diverting manifold crossovers (23Z) can be engaged to the liner (17) with the upper packer (40); after which, the upper assembly (2, 2A, 23F, 40, 66, 137) can be engagable to the lower placed assembly (2, 2A, 23Z, 23Z, 40, 137), with a conventional connector (137), for example a ratch-latch, sealed (66) to the liner (19) with, for example a polished bore receptacle and mandrel, and secured to the final production casing (3) with a production packer (40). Next, the dual spool valve tree (10A) may be placed.

The construction (CS1) method can be usable for underground storage within a geologic trap (1A) of a depleted reservoir through, for example, lower skin damage sidetracks (136) or perforations (129), or in combination with an operations method (CO1) that can be usable for underground storage and solution mining of cavern walls (1A) when well trajectories are oriented vertically, the lower end packer (40) and cementation (20) are omitted from the perforated (129) liner (19) to allow fluid flow for salt dissolution. For brine and storage reservoir cavern creation, a salt inert cushion fluid, with a specific gravity lighter than water, can be forced into the well and allowed to rise around the liner (19), where it can be trapped by the liner top packer (40) to form a water interface that, combined with conventional interface measuring technology, either placed through the innermost passageway (25) or permanently attached to various conduits of the manifold string (70Q), can be usable to selectively control combined storage and mining operations, with alternating injection of a salt inert stored cushion fluid, injection of fresh water, and extraction of brine through the valve controlled manifold crossover (23F) and flow diverting manifold crossovers (23Z).

Once pressure containing barriers are placed (CS1) for substantially hydrocarbon applications, the operations method (CO1) of displacing to a lighter specific gravity hydrostatic column by circulating a lower density fluid through the innermost (25) and concentric (24) passageways, can be usable to under-balance the hydrostatic head of the fluid within the passageway through subterranean strata (52), below the pore pressure contained behind the liner (19). This will allow fluids to flow outward during perforation (129), thus reducing or avoiding skin damage (135 of FIG. 2) in non-salt reservoirs, or placing a cushion under the final cemented casing (3) shoe (16) for brine and storage reservoirs. A wireline rig (4A of FIG. 16) can be engagable to the valve tree (10A) for placement of guns to perforate (129) the liner in a pressure controlled and under-balanced state, without the risk of pushing the guns axially upward with released pore space fluid, by circulating down the innermost passageway (25) using a cable passable flow control device (61), for example an orifice piston (128 of FIGS. 27-28), that can be engaged in the upper manifold crossover (23F), and taking returns through the concentric passageway (24) and through the valve tree for pressure controlled processing. Once perforating has been completed in a non-salt reservoir, the lower production packer can be set to separate and pressure-contain the lower perforated fluid (38) production (34) zone.

Figures 37, 38, 39, 40, 41, 42, 43, 44:
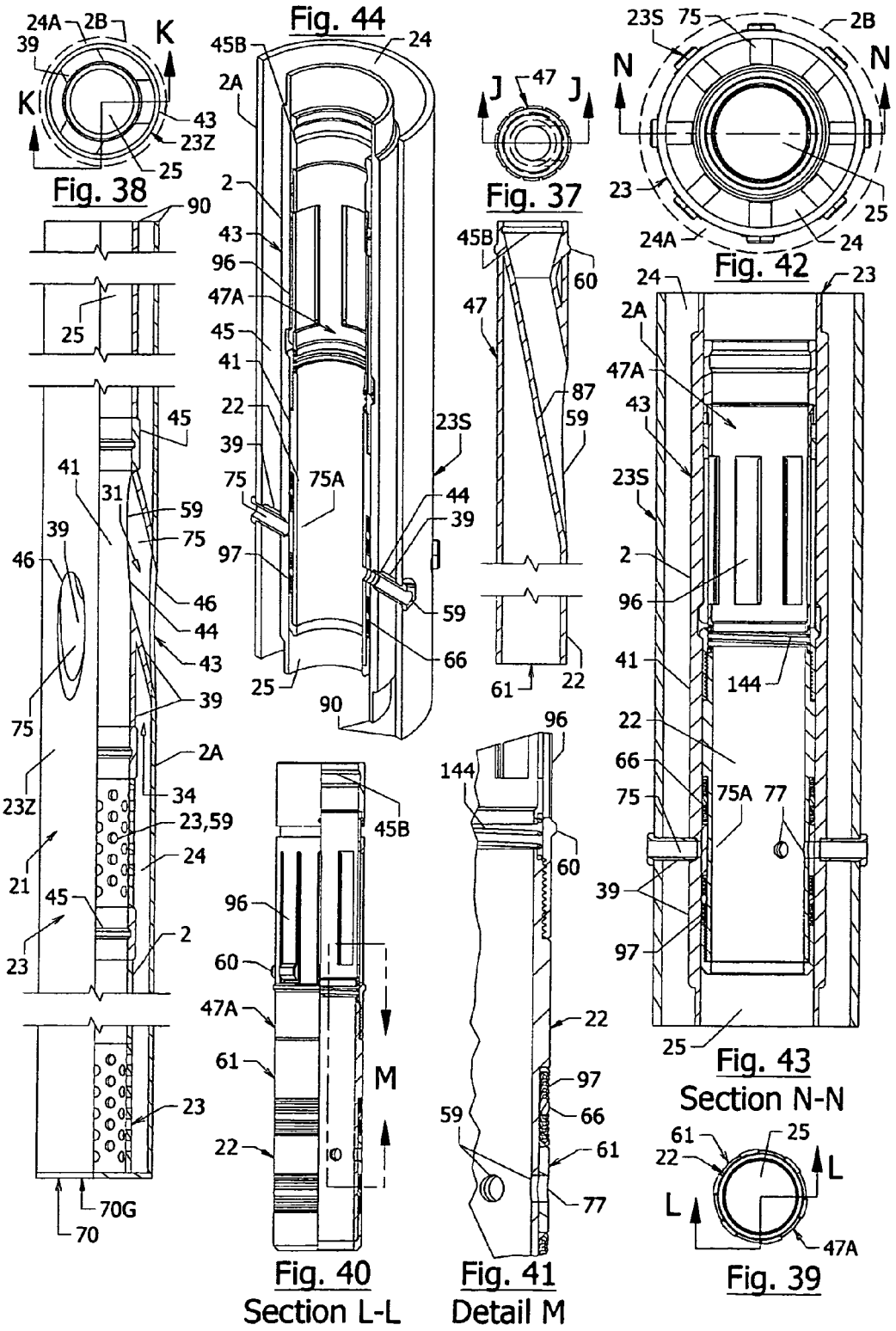

Hydrocarbon method embodiment (CO1) can be usable to perform underbalanced drilling operations, while allowing production (38) to be extracted (34) from a non-salt reservoir, to reduce or avoid skin damage (135 of FIG. 2) with, for example coiled tubing, wherein a series of side tracks (136), such as the fish-bone style sidetracks shown in FIG. 3, are carried out through the exit bores of the manifold crossovers (23Z of FIG. 38) using a bore selector (47 of FIG. 37). If a ported bore selector (47 of FIGS. 51-53) and the drilling circulating conduit are passed through an orifice piston (128 of FIGS. 27-28), shown as a flow control device (61) in FIG. 3, a lighter specific gravity fluid, such as gas or diesel, can be circulated down the concentric passageway (24), through orifices (59) in the inner conduit (2) of the upper manifold crossover (23Z), and through the bore selector (47) for mixing with coiled tubing drilling returns to further under-balance the drilling operations and associated skin damage (135 of FIG. 2).

Embodiments of construction (CS1) and hydrocarbon operations (CO1) methods can be usable to under-balance various operations performable through a completion. For example, gravel packing an unconsolidated reservoir or underbalanced construction of underground storage in a depleted sandstone reservoir where skin damage adversely affects storage efficiency. In these embodiments, the innermost (25) and concentric (24) passageways can be designed for flow through the valve tree (10A) for underbalanced gravel pack placement or well construction. In comparison, conventional completions (CM1 of FIG. 1) are generally not usable for simultaneous construction and production operations, and the conventional method of over-balance placement may permanently damage a reservoir by choking pore throats, thus reducing its permeability.

Figure 4:
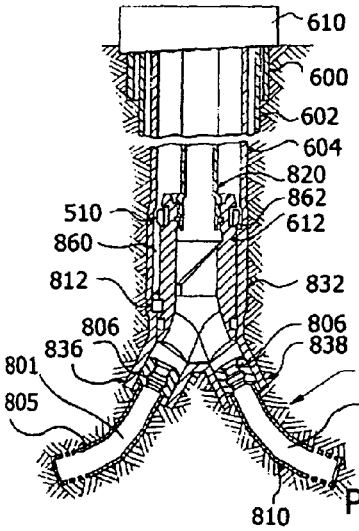
Fig. 4 Prior Art
FIG. 4 shows a prior art branching multi-well construction using conventional expandable metal technology.

Referring now to FIG. 4, an elevation cross-sectional view within the subterranean strata of a branching chamber (832) with expandable metal branches (836, 838) is shown. The Figure illustrates single barriers below the branch, which comprise expandable metals of lesser strength than traditional hardened metal materials, wherein a secondary barrier passageway and barrier, necessary for monitoring the integrity of primary subterranean well barriers below the junction, is not present.

The branching chamber (832) is placed within a parent well bore and flexible metal branches (836, 838) are expanded to provide a pressure containing junction, that can be limited by lower expandable metal burst and collapse pressure ratings in comparison to conventional tempered and/or heat treated and hardened metal products.

In comparison, various apparatus and methods of the present invention can be, generally, constructed with conventional, non-expandable metals of higher strength, with a plurality of barriers and annular passageways below junctions to provide increase pressure bearing capacity and redundancy.

FIG. 4 shows branch wells (801, 808) extending from the branching chamber, and a branching sub (612) is shown at a node of a parent well, having parent casing (604) running through intermediate casing (602) and surface casing (600) from a wellhead (610). The need to engage a branching sub (612) for the production tubing (820) and support of the low collapse strength expandable metal branching chamber (832) requires cementing the junction in place, thus preventing construction of a usable annular space to monitor the primary well barriers of branch wells (801, 808). Cementing conduits within well bores (801, 808) represents a single barrier that may, should it fail, bypass the connector (806), leaking through the strata and/or collapsing the expandable junctions (836, 838) and leaking between the branch sub (612) and branching chamber (832) into an annulus, with insufficient hydrostatic column, when placed within the shallow strata to prevent breaching the parent casing (604) barrier. This parent casing (604) barrier can be exposed to higher subterranean pressures transmitted through a poorly cemented annular space, without prior indications of increased pressure from, for example, an annulus gauge (13 of FIG. 1).

In comparison, various apparatus and methods of the present invention can be usable to place shallow junctions of conventional hardened metal with concentric passageways or annular spaces, extending axially downward from wells of a junction of wells, to provide sufficient hydrostatic pressures and/or metal strength for a usable secondary barrier. A relief pressure reservoir, for example, an exposed fracturable strata bore below a casing shoe in fluid communication with the annular space, can be usable to provide a secondary barrier, which can protect the above ground or mud-line environment in the event of a primary barrier failure.

Methods of completing the branched well shown in FIG. 4 include providing a down hole manifold (612) set in the branching chamber (832), above the junction of the branch well (801, 808) bore lining (805, 810) engagements (806). The downhole manifold can be oriented and latched via an apparatus (510, 862) in the branching chamber (832) by orienting the manifold (612) with a key (812) and a slot (860) arrangement. The Figure shows production tubing (820) that can extend from the surface to the downhole manifold (612) to isolate the parent well from the branch wells (801, 808), which can be closed by plugs placed in the branch well engagements (806) below the downhole manifold (612).

If the junction is placed within deeper strata, the expandable metal branch can provide sufficient barriers when combined with a larger hydrostatic pressure head between the tubing (820) and the parent casing (604), similar to a multilateral application placed deep within the subterranean strata or if a production packer arrangement is used above or in place of the downhole manifold (612). However, the collapse resistance of an expandable metal junction may be insufficient to adequately resist very deep subterranean pore pressures.

Application of prior art branching technologies are, generally, limited by the need to use unconventional expandable metal technology, including the unconventional need to expand the non-concentric branching chamber (832) branches (836, 838), cement them in place, and then orient (812, 860) and latch (510, 862) an unconventional downhole manifold (612), with no annular passageways available to monitor well integrity below the chamber (832). Without the provision of two conduit barriers and an annular passageway of sufficient hydrostatic head to provide sufficient pressure barrier support and monitoring time, the application is generally limited to multi-lateral type applications and access to the innermost bore is necessary.

In comparison, various apparatus and methods of the present invention can be usable with larger diameter conduits of sufficient wall thicknesses and associated pressure rating for shallow multi-well applications from a single main bore. The prefabrication with conventional technology, within a controlled environment, followed by onsite assembly, placement and/or construction within a subterranean environment, with the use of conventional off-the-shelf technologies, can reduce the risk in applications of the present invention.

Figures 5, 6:
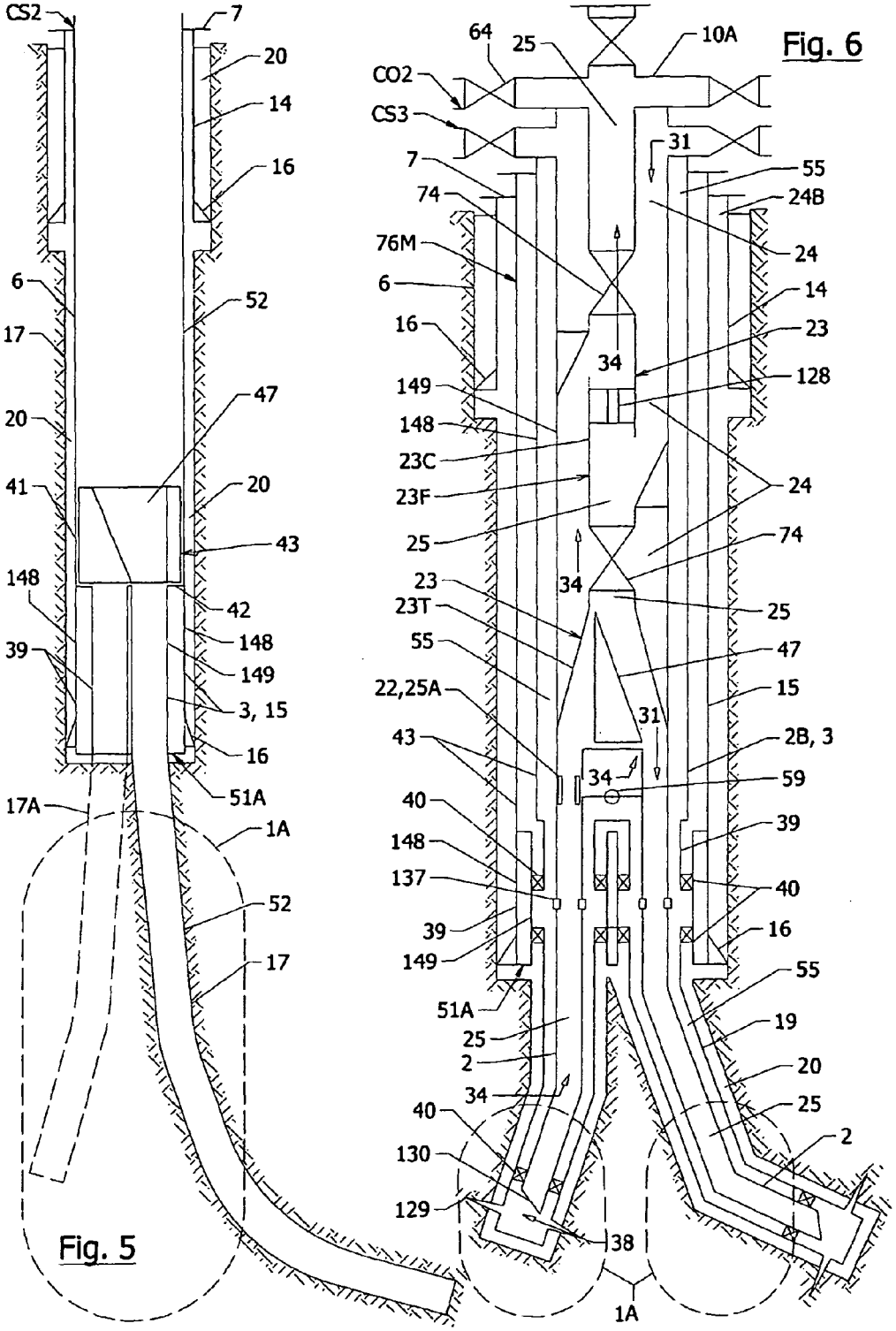
FIGS. 5 to 6 illustrate an intermediate construction and completed method step for plurality of well embodiments of the present invention from a single main bore, usable for substantially hydrocarbon and/or substantially water wells.

Referring now to FIGS. 5 and 6, the Figures show construction (CS2, CS3) and hydrocarbon operations (CO2) method embodiments, illustrating a plurality of wells, one of which is bored (17) and one of which is yet to be bored (17A), branching from a junction of wells (51A) within the shallow strata and depicting, for example, a plurality of perforated (129) hydrocarbon wells to non-salt reservoirs or a plurality of underground storage and solution mining wells to brine and storage reservoirs, usable to form and use space within the walls (1A) of one or more salt caverns.

FIG. 5 depicts an elevation subterranean cross-sectional diagrammatic view of an intermediate construction step (CS2) embodiment using a chamber junction (43) and bore selector (47). The Figure illustrates a placed conductor casing (14), that is shown cemented (20) and sealed at the casing shoe (16) after boring the surface hole. The Figure further depicts a bore (17) that has been drilled through the conductor (14) and strata with a placed chamber junction (43), for example that of FIG. 45-46, 48-50 or 61 and 66-57, and cemented (20) to form a casing shoe (16) of an intermediate (15) casing for a substantially hydrocarbon well or substantially water disposal well in non-salt reservoirs, or a final cemented casing (3) for substantially hydrocarbon and substantially water underground brine and storage reservoirs in salt reservoirs. A bore selector (47), for example as shown in FIG. 47, 51-53 or 63-64, can be engaged within the chamber (41) at the chamber bottom (42) to selectively access the right hand chamber junction (43) exit bore conduit (39). The Figure shows a strata bore (17) that has been drilled to form a passageway through subterranean strata (52). A containing conduit, about the exit bores (39), is shown added to the chamber junctions to form a secondary barrier (2A, 148), similar to those shown in FIGS. 48-50, 66-67 and 68-70, disposed about primary barriers (2, 39, 149 of FIGS. 68-70), to allow concentric passageways or annular spaces below the chamber junction (43) to be monitored through various supporting fluid communication conduits (150 of FIGS. 66-70).

Figures 10, 11, 12:
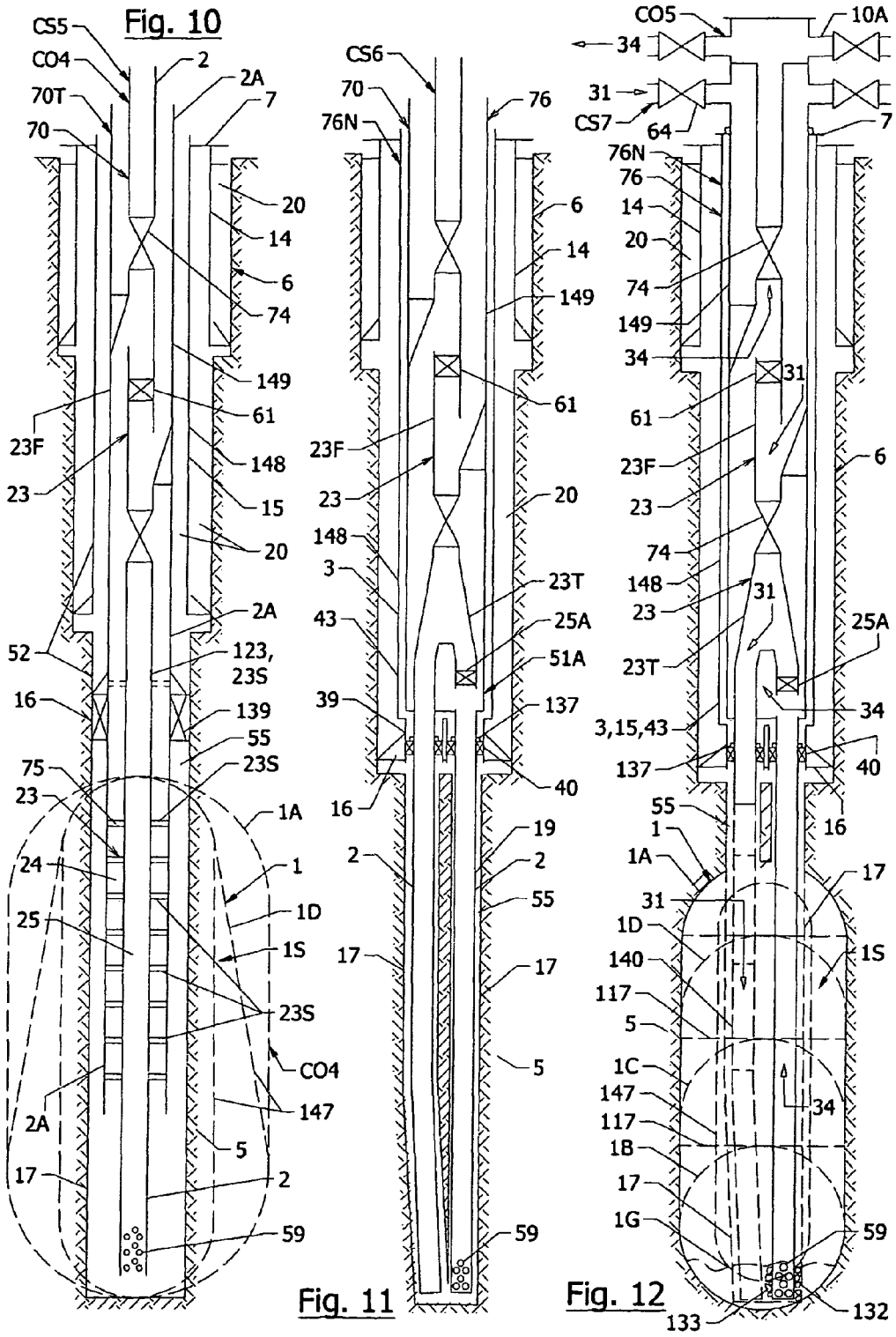

For construction of underground brine and storage reservoir cavern wells usable to form cavern walls (1A) in a salt deposit, the strata bores (17) may diverge to separate caverns before being oriented for vertical solution mining as shown in FIG. 6, or progress axially downward in a parallel or intersecting arrangement as described in FIG. 5 with a completion similar to that shown in FIG. 11.

Referring now to FIG. 6, the Figure depicts an elevation diagrammatic view through a cross-sectional slice of the subterranean strata of a construction (CS3) and combined construction and operations (CO2) method embodiment, illustrating a manifold string (76M) with a manifold crossover (23F) embodiment. The Figure shows selective control of the fluid communication between two separate wells, through a single main bore, using subterranean valves (74) engaged at both ends of a manifold crossover (23C) for forming a valve controlled manifold crossover (23F) engaged with a chamber junction manifold crossover (23T), which can be usable with a flow controlling plug (25A) to direct flow from left and right wells to the innermost (25) and intermediate concentric (24) passageway, respectively.

After boring (CS2 of FIG. 5) passageways (17) through the chamber junction (43) and strata, liners (19) can be engaged to the primary barrier conduit (149) with hangers and liner top packers (40), extending axially downward for a plurality of wells from a single main bore (6). The hydrocarbon method (CO2) can be usable to perforate (129) cemented (20) liners (19) in a substantially hydrocarbon well for production from a reservoir, or storage in a depleted sandstone reservoir well, or disposal and/or simulation in a substantially water well in non-salt reservoirs, or brine and storage reservoirs operations in salt deposits.

For under-balanced perforating and/or when string tension is necessary, the method (CO2) can be usable to place a liner hanger, with a bypass flow capacity to suspend the tubing (2), with the unset lower end production packer (40) and upper end connector (137) (e.g. a ratch-latch), for each of the plurality of wells, usable to engage the chamber junction manifold (23T) and valve controlled manifold crossover (23F) placed as a single assembly prior to engagement of a valve tree (10A). Thereafter, a plug can be placeable within the lower production packer for setting and placing the lower end conduit strings of the manifold string (76M) in tension.

In the perforating example illustrated, a cable rig (4A of FIG. 16) is engagable to the valve tree (10A) for placement of cable (11 of FIG. 16) conveyed by perforating guns passing through an orifice piston (128), that is shown engaged between the valves of the upper manifold crossover (23F) with the perforating guns selectively communicated through the bore selector (47) and mule shoe (130) to perforate (129) the liner (19). An under-balance below the hydrostatic pore pressure can be achievable by injecting a low specific gravity fluid (31) through the lower innermost passageway (25) to prevent upward movement of the perforating guns, after firing with the fluid that is returned past an unset lower packer (40) and through an intermediate concentric passageway (24B), that can be diverted through a selectively controllable valve manifold crossover, similar to that of FIG. 31, usable with three flow streams.

After perforating (129), the bore selector (47) can be removed and the straddle (22), within the chamber junction manifold crossover (23T), and the orifice piston (128), within the other chamber junction (23F), can be replaced with plugs (25A of FIGS. 11-12) that can be usable to control fluid mixture (38) flow streams produced (34) from the left side well with independent production in the right side well, opposite to the injection arrows shown.

The hydrocarbon operations method (CO2) can be usable for combined operations of substantially hydrocarbon and substantially water wells that are usable for injection (31) and production (34) through a single main bore (6) to, for example, water flood the lower portion of a reservoir while producing from the upper portion of the reservoir through a subsea valve tree. Water can be injected (31) into the concentric passageway (24) for crossing over at the manifold crossover (23F) and flowing through the innermost passageway (25) to the right side perforated (129) liner (19), while production from the left side perforated (129) liner (19) can be produced through the concentric passageway of the chamber junction manifold (23T). This production can cross over to the innermost passageway (25), at the upper manifold crossover (23F), wherein both the injection and production fluid mixture streams can be selectively controlled by a plurality of bathers (2, 2A, 2B, 3), subterranean valves (74) and a valve tree (10A).

The construction method (CS3) can be usable with surface or subsea valves trees (10A), for example, an adapted horizontal subsea tree. An extra spool can be added to a conventional valve tree (10 of FIG. 1) to allow continuous flow through a concentric passageway (24) with storage to and from, for example, a plurality of depleted reservoir storage wells from a single main bore (6), with a perforated (129) liner. The storage boundary (1A) can be a geologic trap such as a dip closure or solution mined cavern walls in a salt deposit usable for containing stored product.

The construction (CS3) and hydrocarbon operations (CO2) methods are adaptable for two laterally separated, substantially water, underground, solution-mined, storage cavern wells, wherein the cemented (20) liner (19) is replaced with a free-hanging liner (19) without the lower packer (40), flow diverting string (similar to 70T of FIG. 10 below the cement packer 139), that can be engaged to each primary barrier (149) exit bore conduit (39) of the chamber junction (43). An outer string (2A of FIG. 10) can be engaged with the depicted liner hanger and packer (40), with the connector (137) at the upper end of the inner string (2 of FIG. 10). The arrangement can be engagable to the manifold crossover (23T) and usable to inject and trap a cushion of salt inert fluid between the bore (17) and the liner top packer (40) and final cemented (20) exit bore (39) casing shoe (16), during solution mining operations by using, for example, manifold crossovers (23S of FIG. 10) to adjust the water interface level.

Fresh water can be injected (31) through the innermost passageways extending from the chamber junction manifold crossover (23T), with the straddle (22) in place and the bore selector (47), to both the left and right side wells, respectively. Salt saturated brine can be returned (34) from the solution mined space within the cavern walls (1A) from both left and right side wells through a lower manifold crossover (23T) orifice (59), which is not present in previously described embodiments and requires blocking of the surrounding passageway by, for example, cement and/or a packer. In other embodiments using the radial passageway covered by the straddle (22), the orifice (59) can be provided with a one-way valve, usable to inject and trap a salt inert fluid cushion for selectively controlling the water interface during solution mining.

Figures 45, 46, 47, 48, 49, 50, 51, 52, 53:
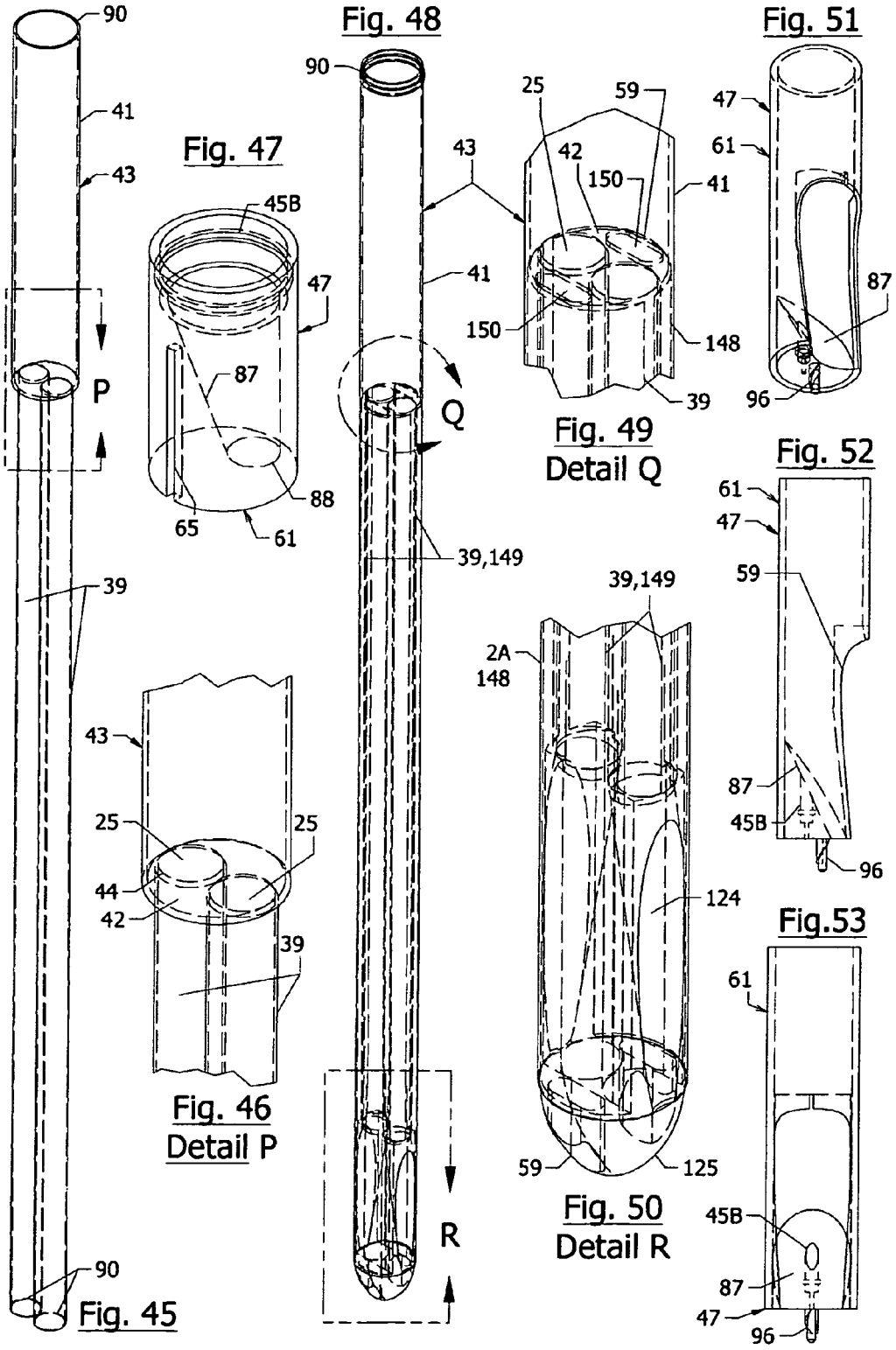
FIGS. 45 to 53 show various apparatus of the present inventor usable with the present invention.

The method (CS3) can be usable with either substantially hydrocarbon and/or substantially water wells, using an inner chamber junction (43), similar to that of FIGS. 45-46, placed and engaged at its lower end with packers (40) to the outer chamber junction (43) primary barrier (149) exit bore conduits (39). This placement of the inner chamber junction (43) provides a surrounding passageway (55) for primary barrier monitoring within the hydrocarbon well with a lower packer (40), or for brine returns in a free-hanging manifold string solution mining water well, with an additional intermediate concentric passageway (24B) for monitoring the secondary barrier (148).

Figure 7:
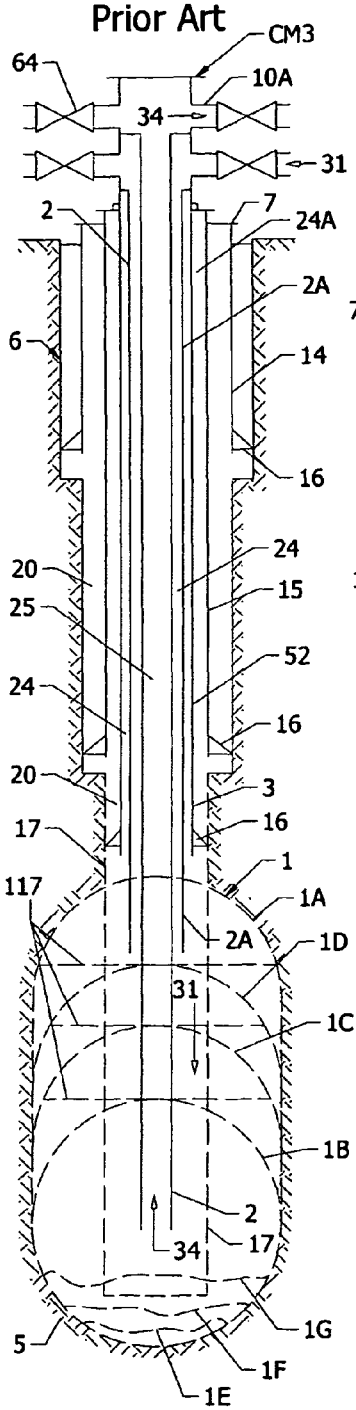
Fig. 7 Prior Art
FIGS. 7 and 8 show steps in the construction of a solution mining well and underground storage space.
Figure 8:
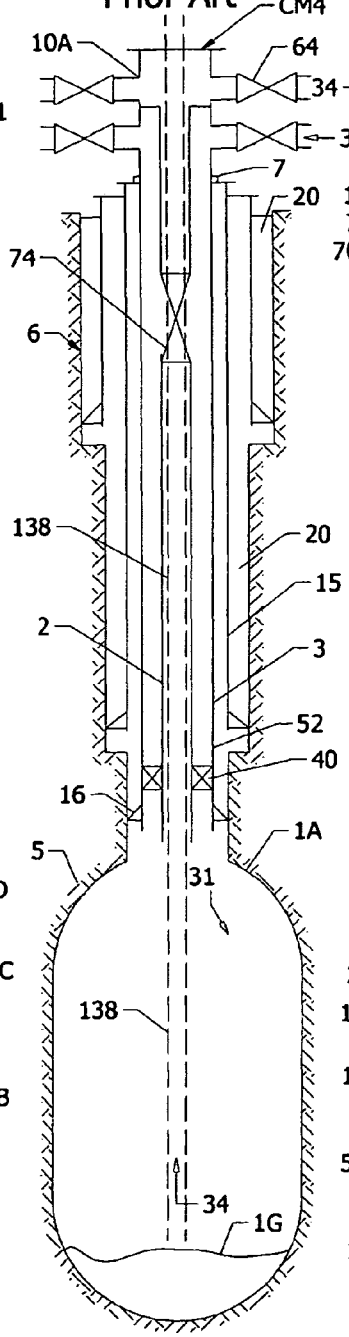
Fig. 8 Prior Art

FIGS. 7 and 8 depict elevation subterranean cross-sectional diagrammatic views of the generalized conventional construction steps (CM3, CM4) for forming an underground storage space within salt cavern walls (1A), using a solution mining salt dissolution process. The Figures illustrate conventional construction of a storage well, with a conductor (14), an intermediate casing (15), and a final cemented casing (3) sealed with a casing shoe (16), through which a strata passageway (17) is bored. The Figure shows passageway through subterranean strata (52) within which solution mining begins in FIG. 7 by placing a free hanging inner string (2) within an outer free hanging string (2A), which may be adjusted with the use of a large hoisting capacity rig during the processes to reposition the point at which fresh water enters the solution mining region of a salt deposit (5) and/or to provide improved sonar measurements than are possible through casings (2, 2A), after which the free hanging strings are removed from the passageway through subterranean strata (52) of FIG. 8 showing a completion (2, 40, 74) installed with a dewatering string (138) preventing valve (74) operation until after the cavern is emptied for gas operations and the string (138) is snubbed or stripped out of the well.

Referring now to FIG. 7, the Figure depicts the conventional solution mining (1) method (CM3) starting with injection of potable water, pond water, ditch water, sea water, or other forms of water, generally termed fresh water due its unsaturated salinity level as compared to extracted salt saturated brine. The Figure shows the water injected through the innermost passageway (25) and returned through the intermediate concentric passageway (24), between the inner (2) and outer (2A) free hanging conduit strings, using direct circulation with a cushion, generally comprising diesel or nitrogen. The injected water is shown forced into an additional intermediate concentric passageway (24A), between the outer conduit string (2A) and a final cemented casing (3), to control the water interface (117), wherein an initial solution mined space is created for insoluble strata to fall through a substantially water fluid stream to the cavern floor (1E).

Generally, once sufficient space is formed with direct circulation, a conventionally more efficient indirect circulation can be performed by injecting (31) down the intermediate concentric passageway (24) with returned (34) fluids passing through the innermost passageway (25), with a salt inert fluid fluidly communicated through a port in the wellhead (7) and trapped in the additional concentric passageway (24A) to maintain a water interface (117) during circulation.

Generally, caverns are solution mined from the bottom up by mining a space (1B) with a water interface (117), raising the water interface (117) repeatedly to create increasing volumetric spaces (1C and 1D) with water-insoluble strata falling through fluids, and raising (1E, 1F, 1G) the cavern floor while continuously injecting (31) fresh water and extracting (34) saturated or near saturated salt brine, that can be dependent upon the residence time, pressure, volume and temperature conditions of the salt dissolution process.

As the process of solution mining may take years, dependent upon the size of cavern being mined, the rate at which fresh water is injected (31) and the number of large hoisting capacity rig visits required to construct the well and adjust the outer leaching string (2A) during formation of a salt cavern represents a significant net present value investment.

Referring now to FIG. 8, the Figure depicts the conventional completion method (CM4) following solution mining (CM3 and 1 of FIG. 7), wherein the free hanging leaching strings (2, 2A) have been removed and a completion, similar to CM1 of FIG. 1, comprising a production casing (2) and production packer (40), engaged to the final cemented casing (3), have been placed and engaged to the wellhead (7) with a valve tree (10A), that can be engaged to the upper end using valves (64) to selectively control injection and extraction of fluids.

In liquid storage wells, where the stored products do not pose a significant evaporative or expansion escape risk, for example crude oil or diesel, generally, no subterranean valve (74) is present. In addition, a dewatering string (138), generally, remains in place through the production casing (2), and product is injected (31) indirectly through the passageway, between the dewatering (138) and the production casing (2), taking brine returns (34) through the dewatering string (138) with stored liquid product displacing brine from the space within the cavern walls (1A). Retrieval of stored liquid is generally accomplished by direct injection of brine, from a pond or storage facility, through the dewatering string (138) to float the lower specific gravity stored product out of the cavern as described in FIG. 74.

In gas or volatile liquid storage instances, a failsafe shut subterranean valve (74) is generally placed in the production casing (2), through which a dewatering string can be placed. Gas or volatile liquids can be stored using indirect circulation for injection (31) through the passageway, between the dewatering (138) and production casing (2), and taking brine returns (34) through the dewatering string (138), after which the dewatering string (138) must be stripped or snubbed out of the well in a relatively high risk operation, where personnel are in close proximity to pressurized barriers, to allow the fail safe safety valve (74) to function.

Conventional methods (CM3, CM4) of constructing salt caverns and initializing gas or volatile liquid underground storage are labor intensive and potentially hazardous, taking a number of years to complete before realizing a return on investment.

Figure 9:
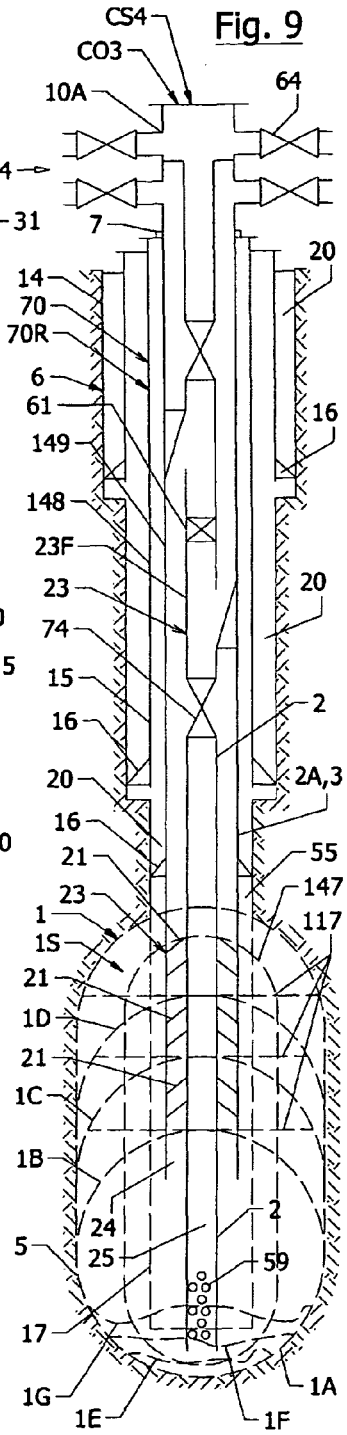

Referring now to FIG. 9, an elevation cross-sectional diagrammatic view through a slice of subterranean strata along the axis depicting embodiments of construction (CS4) and hydrocarbon operations (CO3) methods are shown. The depicted embodiments can be usable with a manifold string (70R) and flow diverter (21) and a manifold crossover (23F) of the present invention. The Figure illustrates well construction, similar to FIG. 3, above the final cemented casing (3), which comprises the outer string (2A) of the manifold string (70R) cemented (2) to form a casing shoe (16). An initial cavern space, within salt deposit (5) cavern walls (1A), can be used for storage during solution mining (1S). The construction and combined operations methods (CO3-CO7) can be usable to reduce both the number of large hoisting capacity rig visits and the time frame before realizing a return on investment, when compared to conventional methods (CM3 and CM4 of FIGS. 7 and 8) with simultaneous storage and solution mining (1S).

After cementation (20) of the manifold string (70R) and any associated mechanical integrity tests of the casing shoe (16), and the placement of a salt inert cushion fluid, water can be injected into the solution mined (1) spaces (1B, 1C, 1D), initially, using an indirect method. The indirect method injects the water through the intermediate concentric passageway (24), taking returns through the innermost passageway (25) and orifices (59) in the inner conduit string (2), at its lower end. Thereafter, a direct method can be used to inject water through the innermost passageway (25) to flow diverting crossovers (21), described in FIG. 38, that can be selectively controlled with flow diverting bore selectors (47A of FIGS. 35-36), also usable to inject and trap a salt inert cushion fluid between the final cemented casing (3) shoe (16) and the water level (117). After sufficient volume is formed through faster leaching of a lesser diameter cavern roof, the water interface (117) can be lowered with the cushion between the lesser diameter roof and water interface usable as a storage space (147) during simultaneous storage and solution mining (15), wherein below the water interface, the flow diverting bore selectors can be usable to selectively place water for solution mining (1) a larger diameter cavern, during which insoluble strata can fall and accumulate (1E, 1F and 1G) at the bottom of the cavern. Saturated brine can enter orifices (59) in the inner conduit (2) and can cross over to the intermediate passageway (24), below the bore selector for extraction through the valve tree (10A).

The method (CO3) can be usable to form an initial space within cavern walls (1B) by using direct circulation of fresh water through the innermost passageway (25), with salt saturated brine returned through the concentric passageway (24) using the lowest water interface (117) above the lower end of the outer string (2A). Alternatively, the initial space within the cavern walls can be formed indirectly from the circulation of water through the concentric passageway (24) to the innermost passageway, during which time a salt inert fluid cushion can be periodically injected through either passageway (24, 25) and trapped by the casing shoe (16).

Various initial cavern volume shapes (147) usable for simultaneous storage and solution mining (1S) can be formed with direct or indirect circulation and adjustment of the salt inert fluid cushion that can control the water interface, selectively increased with injection or removed with a manifold crossover (23), after the initial insoluble volume. While no two caverns are ever the same shape after completing solution mining, any conventional design shape is formable with the present invention, for example those of FIGS. 10, 13 and 14, can be usable to more quickly form a cushion storage volume (147 of FIGS. 13 and 14) and can be further usable as a leaching cushion for subsequent solution mining operations (1).

The conventional rule-of-thumb for salt dissolution is that the top of the cavern leaches twice as fast as the sides of the cavern, and the sides of a cavern leach twice as fast as the bottom of a cavern. Conventional methods (CM4 of FIG. 8) of cavern formation involve developing a cavern width, first, at its deepest level and, then, working upward to complete the cavern shape, wherein the present method (CO3) can be usable to form a smaller volume that can be usable for storage and cushion, after which solution mining of the cavern side walls (1A) can continue, either conventionally or with method embodiments (1T of FIGS. 75-76 and 80-83) for brine and storage reservoirs.

Liquid storage is generally volume dependent, with a high unit value per unit of volume, and salt caverns are generally preferred with liquid storage methods (1T of FIGS. 75-76 and 80-83) of the present invention usable with gas storage. Gas storage within gas tight salt caverns is generally more profitable for shorter trading periods to increase the number of turns, referring to turn-around volumetric usage as described in FIG. 78, wherein only a portion of the cavern is used with larger seasonal swings that are conventionally left to less efficient, depleted, sandstone reservoirs, presumably due to the higher investment cost of the more efficient salt cavern storage space dedicated solely to gas storage. Various methods (157, CO1-CO7, 1S and 1T of FIGS. 75-76 and 80-83) are usable to combine both liquid and gas storage.

The construction method (CS4) manifold crossover (23F) can be usable, for example, to perform both solution mining and gas storage operations (1S) without rig intervention. A smaller cavern volume (147), formed by first solution mining a smaller diameter cavern axially upward at the faster dissolution rate of the cavern room, can be usable to form a gas trading cushion volume (147). Thereafter, the water interface can be lowered by the volume of gas stored, during, for example, the weekend lower usage period for displacing brine, and released during daily peak demands as fresh water is injected to solution mine the cavern walls (1A) to a larger diameter from the bottom up. The stored cushion product extraction and associated pressures are aided by methods of (1T of FIGS. 75-76 and 80-83) fresh water injection, brine generation and displacement between a u-tube conduit arrangement between brine and storage reservoirs.

FIGS. 13 and 14, depict elevation diagrammatic views of combined hydrocarbon operations method embodiments (CO6 and CO7, respectively) that can be usable with conventional well designs (CM5), including conventional designs incorporating one or more apparatus of the present invention to solution mine various cavern design shapes while simultaneously storing a valued produced, for example, hydrocarbon gas within the walls (1A) of a salt deposit cavern. The Figure shows a smaller cavern cushion storage space (147) that can be solution mined, first, for the purpose of simultaneous storage operations (1S) during solution mining operations (1) with a working pressure (WP), usable to selectively control the substantially water interface (117) during enlargement of the cavern walls (1A)

Referring now to FIGS. 9-10, 12-14, 76 and 80, the Figures depict various example intermediate and final cavern design shapes that can be usable with the present invention. An initial volume (147) can be formed for a storage cushion during simultaneous storage and solution mining (1S), after which subsequent cavern shapes (1B, 1C, 1D) can be formed by selectively controlling the substantially water interface (117) with placement of a salt inert cushion and selective placement of manifold crossovers (23) and flow control devices, until reaching the final cavern wall (1A of FIGS. 9-10, 12-14, 76 and 80) design volume.

Construction methods (CS4-CS7) can be usable with any underground storage facility requiring a subterranean well for fluid communication of stored products, for example depleted reservoirs similar to those depicted in FIGS. 3 and 6. The storage boundary (1A of FIGS. 3 and 6) represents a geologic feature, such as a four-way dip closure reservoir or the walls of a conventional mine or, as described, a solution mined salt cavern, wherein subterranean valves can be required for stored products, posing a significant risk of escaping through expansion or evaporation.

Combined storage and solution mining methods (1S, 1T, CO3-CO7, 157) can be usable with any underground salt cavern storage facility. The present invention can be usable for combining liquid and gas storage caverns, where higher unit value products, such as liquid hydrocarbon storage, conventionally displaced with saturated brine rather than water and having a storage value not necessarily driven by short term peak loading, are not generally combined with hydrocarbon gas salt cavern storage, wherein economics are dominated by short term peak leveling requiring only a small portion of the design volume from caverns generally not refilled after initial dewatering.

Liquid products of greater per unit value, generally, require lower economic volume turn-over or turns than, for example, a compressed product like hydrocarbon gas, with two distinct demand cycles comprising a daily or weekly usage of a small proportion of the stored volume to manage peak demand and a season demand occurring over a longer time horizon, comprising cycling the entire working storage volume between the maximum and minimum working pressures of the cavern. Typically, the capital cost of constructing large underground salt cavern gas storage facilities, comprising many interconnected caverns, is less economic for seasonal demand than, for example, a depleted reservoir, because the capital investment is higher returns on the longer investment. As a result, salt cavern storage is conventionally used for peak leveling of daily and weekly demand, wherein the seasonal turn-over of a lower value per unit product cannot economically justify the construction investment, or the sunk cost investment, for a significant volume of cushion gas that must be left within caverns to maintain the minimum working pressure supporting the salt cavern roof.

Consequently, less capital intensive and less-efficient depleted sandstone reservoir gas storage is typically used for seasonal demands, while gas-tight salt caverns are generally used for peak leveling daily or weekly demand, generally, preventing the combination of contra-seasonal-demand storage combinations of liquid and gas hydrocarbons storage facilities.

Embodiments of the methods of the present invention are usable to reduce the cost of constructing and operating liquid and gas storage facilities. For example, embodiments of the present invention can reduce costs by constructing a well in a single rig visit, or by providing pressurized containment for seasonal re-filling of a gas storage cavern with liquid hydrocarbons, water and/or brine without further rig visits, that are conventionally required for placement and removal of a dewatering string through subsurface safety valve. Additional reduction of costs include economically supplying water and disposing of brine using, for example, the ocean to provide larger facilities with a plurality of more efficient gas-tight storage caverns that can be usable for economically supplying both peak leveling and seasonal gas demands.

Conventional designs include, for example, the dual wells to a single cavern depicted in FIGS. 13 and 14. The Figures show two or more conduit strings (2) and selectively controllable subterranean valves (74), engaged to associated wellheads (7) and subsea or surface valve (64) trees (10), that are usable to selectively control injection of salt inert fluids and water to form a cushion storage volume (147), after which a cushion storage space working pressure (WP) is usable to selectively control a substantially water or fluid interface (117) for underground storage operations (1S), while solution mining (1). For example, hydrocarbon gas may be stored within the upper cushion volume (147) during a weekend forcing saturated brine from the cavern and, then, released from storage during weekday peak demands as water is injected into the cavern to solution mine the lower end of the cavern and to reduce working pressure (WP) reductions caused by product withdrawal.

Initially, any salt inert fluid followed by any storage valued salt inert fluid, for example, diesel or hydrocarbon gas, can be trappable through injection and lower specific gravity floatation between the final cemented casing shoe (3,16) and a substantially water interface (117), usable for selectively controlling salt dissolution (1). For example, nitrogen gas can be used to form the initial storage cushion volume; after which, hydrocarbons valued for various consumer demands can be usable as a salt inert fluid for storage operations (1S) or compressed air, generated from wind energy and valued for release to a pneumatic motor driving an electrical generator, can be usable as a salt inert fluid for storage operations (1S) while solution mining (1).

Conventional theories, relating to support of the cavern roof and working gas pressures within a cavern, use shapes (1D), similar to those of FIGS. 10 and 14, to provide an arching salt deposit roof capable of lower working pressures than, for example, shapes (1A) similar to FIGS. 9, 10, 12 and 13. Apparatus and methods of the present invention can be usable with any cavern shape and working cavern pressure. Higher and lower working pressures (WP), associated with various cavern shapes, can be at least partially controllable with fresh water injection, brine generation and/or brine displacement during combined operations (1T, CO3-CO7) to help maintain cavern pressure during stored product release, wherein product storage drives the water interface (117) and associated brine extraction and/or dewatering.

Various methods for injection of water and extraction of saturated brine can be usable to selectively control the substantially water interface (117). For example, a gas storage operation (1S) pump (69A of FIG. 29), engaged within a manifold crossover (23F of FIGS. 6, 9, 10 and 12) between controlling valves (74 of FIGS. 6, 9, 10 and 12), can be operable with release of compressed gas to pump water into the pressurized (WP) cavern for solution mining (1) operations, as expanding compressed gas is released from storage. The compressed gas can be injected into the cavern for urging saturated brine from the cavern, with the working pressure (WP) of the dewatering operation assisted by reverse operation of the in-line subterranean pump (69A of FIG. 29) for aiding brine extraction.

Various other solution mining (1) and storage operations (1S) can be usable including frequent, intermittent or seasonal extraction and emptying of stored fluids within the cavern by filling the volume (147, 1B, 1C, 1D) with fresh water left to fully saturate, with dissolution of a calculated salt, wall thickness within the tolerance of the maximum cavern design diameter using, for example, an ocean for water supply and brine disposal and/or a u-tube conduit arrangement method (1T) for fluid communication between brine and storage reservoirs.

The working pressure and working volume, within underground gas storage wells and caverns, can be invariably linked in compressible fluid storage operations, where a large initial volume of cushion gas must remain within caverns for the life of a convention gas storage facility to maintain the minimum working pressure that is necessary to prevent salt creep from adversely affecting the storage space and/or stability of the salt cavern roof.

Embodiments of the methods (1T, CO3-CO7) can be usable to positively affect the working volume, comprising for example the sum of a working gas volume and cushion gas volume necessary to maintain salt cavern stability and/or for extending the withdrawal period associated the limiting thermodynamics of expanding gas lowering well equipment, generally measured at the wellhead. Increased usable working volume can be achieved by filling the cavern volume with water or brine, from for example and ocean or brine and storage reservoir, while using a valve controlled manifold crossover (23F of FIGS. 6, 9, 10, 12 and 21-26) or a conventional well design with two conduit strings, usable to selectively control injection of water, salt inert and/or valued storage fluids while extracting brine or valued storage fluids. The embodiments of the methods (1T, CO3-CO7) can be usable to control at least a portion of the pressure, volume and temperature thermodynamic results of injection and/or extraction of stored fluids, while simultaneously emptying or filling the cavern with water or brine.

Referring now to FIG. 10, an elevation subterranean cross-sectional diagrammatic view of construction (CS5) and combined hydrocarbon operations (CO4) method embodiments, using a manifold string (70T) with manifold crossovers (23F, 23S) within a bored strata passageway (17) through a salt deposit (5). Embodiments, shown in the Figure, include using a conventional cement retainer or expandable cement packer (139) and a manifold crossover (23S), adapted with a conventional cement stage collar (123) for performing a similar function to a sliding side door, wherein the cement port can be closed after cementation through radial passageway conduits extending from the innermost bore to the outer conduit string (2A), engaging the manifold string (70T) to the passageway through subterranean strata (52) with a casing shoe (16). The casing shoe (16) can comprise the expandable cement packer (139) that can be cemented (20) in place through an intermediate casing (15) placed and cemented (20) within a conductor casing (14), with a wellhead (7) at its upper end.

After engaging a valve tree (10A of FIG. 12) to the upper end of the wellhead (7), the combined operations (1S, CO4) method can comprise placing an initial water interface cushion with trapped injection and, then, forming a storage cushion volume (147) using the faster cavern roof leaching rate, once an initial cavern diameter is established by indirect circulation axially down the intermediate concentric passageway (24), and through the lower end orifices (59) in the inner conduit string (2). The method (CO4) can continue by the combined operations of solution mining, injecting and storing a salt inert storage fluid (15), within the upper end of the space (147) or cushion, to lower the water interface for enlargement of the initial cavern diameter, with further indirect and/or direct circulation through the innermost passageway (25) to various radial passageways (75) of manifold crossovers (23S), for enlarging the lower cavern shape (1D). Indirect circulation of water down the concentric passageway (24), with brine returned through the innermost passageway (25), can be changeable, after formation of the initial volume (147), to direct circulation of water down the innermost passageway to a selected blocked depth, using, for example, a flow controlling device such a plug, for diverting flow through the manifold crossover (23S) to fall downward through the storage cushion to the water interface, with stored products retrieved from the cushion through the manifold crossover (23S) by indirect circulation. Subsequent combined operations (CO4) can comprise, for example, alternating gas storage peak demand trading and solution mining operations (15), wherein the sloped cavern roof is designed for emptying the cavern of water and refilling it, accounting for differing rates of salt dissolution between the walls and roof until reaching the final wall (1A) shape. Thereafter, the embodiments of the combined operations method (CO4) can include, for example, peak leveling trading of gas for using a smaller portion of the cavern, refilling the cavern for season gas storage, and compensating for natural salt creep, resulting from strata overburden pressures, with subsequent seasonal salt dissolution.

Inclusion of a plurality of smaller diameter radial passageway manifold crossovers (23S of FIGS. 42-44), usable with a plurality of shorter conventional flow controlling device (61 of FIGS. 39-41) lengths provides a means for depth critical adjustments, that can be necessary when solution mining operations encounter unexpected subterranean salt deposit features, or wherein high injection rates of water are to be spread over various depths through several manifold crossovers (23S), instead of injection through a large bore at a single depth.

Various larger bore manifold crossovers, for example 23Z of FIG. 38, can be included for sonar measuring devices to exit a manifold string entering the cavern, to take the sonar measurements. Alternatively, measurements can be taken through the manifold string conduits to adjust solution mining operations and to manage unexpected subterranean features encountered during solution mining.

Referring now to FIGS. 11 and 12, elevation subterranean cross sectional diagrammatic views of construction (CS6) and combined hydrocarbon operations (CO5) method embodiments are shown, which can be usable with a manifold string (76N) and manifold crossovers (23F, 23T). The Figures show a chamber junction (43) final casing (3) that can be cemented (20) within a conductor (14) casing for forming a single main bore (6) and wellhead (7) for engagement of a valve tree (10A). The Figures show a plurality of strata bores (17) that have been drilled through a salt deposit (5) to intersect at their lower end. The Figures include a plurality of conduit string (2) liners (19) with hangers and production packers (40), which are engaged with the chamber junction (43) exit bore conduits (39), after which the manifold crossovers (23F, 23T) assembly can be connected (137) with, for example, packer anchors secured to the production packers (40) with a valve tree (10A) that can be engaged to the upper end of the wellhead, securing the tops of the various conduit strings (2, 2A, 3 and 14).

The combined underground storage and solution mining method (CO5) can be usable to inject (31) fresh water into the left side well, taking returns (34) through the right side well, wherein a plug (25A) within a manifold crossover (23T) can direct flow from the right well into the concentric passageway (24) to enter the innermost passageway (25) above the flow control device (61) within the upper manifold crossover (23F). The upper manifold crossover (23F) can comprise, for example, a plug (25A of FIG. 15) or a fluid pump (69A of FIG. 29), that can be usable to both divert and selectively control fluid flow through the subterranean valve (74) controlled upper manifold crossover (23F), wherein fluid communication is further selectively controlled by valves (64) of the valve tree (10A).

Water and a salt inert fluid are injectable (31) and trappable under the production packers and casing shoe (16) or within, either or both, cavern chimneys formed by the wells exiting the chamber junction (43), if a manifold crossover (23S of FIG. 10) is adapted with a cementing stage tool (123 of FIG. 10) and a cement packer (139 of FIG. 10) is used to seal either or both cavern chimneys. As the substantially water interface (117) is moved axially upward, the left side conduit can be sequentially severed (140) to adjust the level at which water is placed within the intermediate cavern walls and provide unrestricted sonar measurements.

One or both wells exiting the chamber junction (43) can be usable to leach a salt inert storage cushion fluid volume (147 of FIGS. 10, 13, 14, 76 and 80) and can be further usable to store fluid during combined operations (CO5). The liquid interface (117) can be selectively movable with working pressure, and the interface (117) can be raised upward as the cavern volume (1B, 1C, 1D) is formed through salt dissolution. Water insoluble strata can fall and accumulate (1G) at the cavern lower end with extraction (34) through orifices (59) in the right side well conduit (2), during the process of extracting fine particles and small solids, and leaving the larger particles (133) to form by permeability (132 of FIG. 2), within the insolubles accumulated (1G) at the cavern floor.

Referring now to FIGS. 3, 5-6, 9-14, 76 and 80-83 depicting various preferred method embodiments (1S, CS1-CS7, CO1-CO7, 1T, 157), wherein various methods and apparatus described herein can be usable and combinable with various other methods and apparatus of the present invention to form other embodiments, that can be usable to selectively control pressures during construction and/or hydrocarbon operations, storage or solution mining for one or more substantially hydrocarbon and/or substantially water wells from a single main bore (6).

As demonstrated by various described construction (CS1-CS3) and combined operations (CO1-CO2) methods, the present invention can be usable to accomplish various operations performable through a completion to one or more wells through a single main bore (6), and is further adaptable to perform, for example, any pressure controlled circulation of fluids through a completion string for acid cleanups, matrix acid frac stimulations or proppant frac stimulations, gravel packs, jet pump operations, gas lift operations, other fluid operations through a completion string normally requiring circulation, with for example, coiled tubing.

Referring now to FIGS. 15 and 16, views of a conventional wireline plug (25A) and wireline rig (4A), respectively, are depicted. The Figures show a flow control device (61) placeable through engagement with a cable (11) of a wireline or slickline (4A) rig (4), with a hoisting (12) apparatus for conveyance through a lubricator (8) and blow out preventer (9) engaged to the top of a valve tree (10), that is secured to a wellhead (7) in communication with the innermost passageway of a manifold string, for placement within the passageway through subterranean strata to selectively control pressurized fluid flow. Various example flow control apparatuses (61) are depicted and comprise a: plug (25A) with a cable engagable connector (68) and mandrels (89), a straddle (22 of FIGS. 39-44), an orifice piston (128 of FIGS. 27-28), a pump (69A of FIG. 29) and bore selectors (47 of FIGS. 37, 51-53 and 47A of FIGS. 35-36), that can be placeable, usable and retrievable from the innermost passageway (25) of the present invention to selectively control pressurized fluid flow, wherein other conventional devices and flow controlling devices of the present inventor are also usable.

Figures 21, 22, 23, 24, 25, 26, 27, 28:
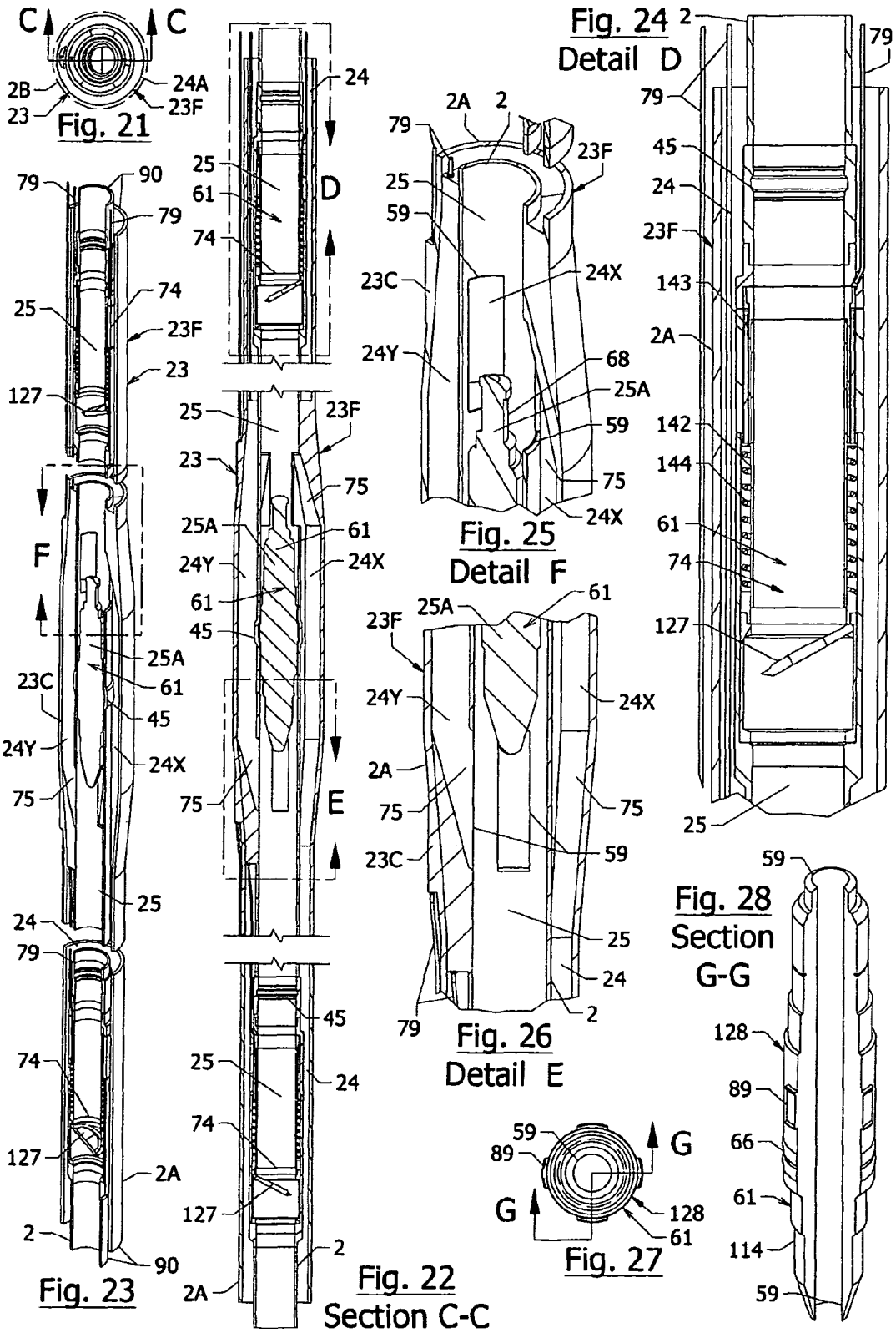
FIGS. 21 to 26 depict a manifold string using a manifold crossover of the present invention.
FIGS. 27 to 28 show an orifice piston embodiment of the present invention for selectively controlling fluid flow streams.
Figures 68, 69, 70, 71, 72, 73:
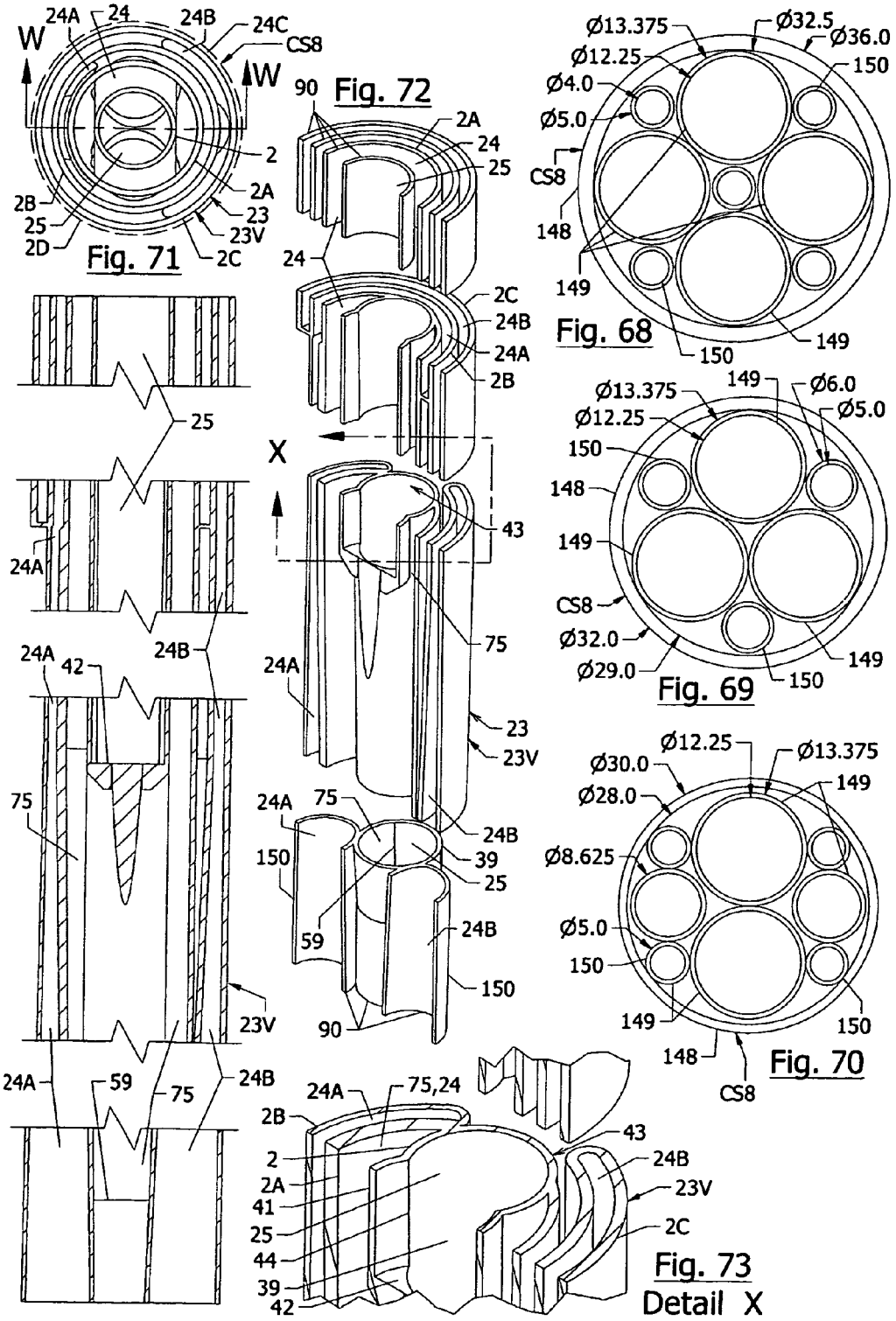
FIGS. 68 to 70 illustrate examples of conventionally sized conduit and bore configurations usable within a single main bore, and which can be usable with a construction method of the present invention.
FIGS. 71 to 73 depict an adapted chamber junction manifold crossover embodiment of the present invention with additional intermediate concentric passageways of a single main bore extended as supporting fluid passageways.

Referring now to FIGS. 17, 21, 32, 38, 42 and 71, the Figures depict plan views with dashed lines representing additional conduits (2B, 2C, 2D), usable to form additional concentric passageways (24A, 24B, 24C) that can be engagable with other manifold crossovers, for example, 23C of FIGS. 17 to 20, 23F of FIGS. 21 to 26, 23I of FIGS. 31 to 34, 23Z of FIG. 38, 23S of FIGS. 42-44 and 23V of FIGS. 71 to 73, to form various other manifold crossover embodiments (23) and/or manifold strings. In a manner similar to the manifold string (70W) of FIG. 31, any number of additional concentric conduits and/or conduit strings engagable with various manifold crossovers can be configurable in various arrangements to selectively control pressurized fluid mixture flow through a plurality of concentric passageways, using a valve disposed across the innermost passageway, whereby access through the innermost passageway remains usable for conveying flow controlling devices (61).

With regard to FIGS. 17 to 20, various views of a manifold crossover (23C) embodiment are shown, depicting concentric conduits (2, 2A) on upper and lower ends of an expanded diameter outer concentric conduit (2A), with walls angularly arranged for relatively high flow stream velocities and with an enlarged internal diameter to form equivalent or larger cross-sectional flow areas to, for example, reduce the risk of erosion or flow cutting of the manifold crossovers (23C) walls, usable to form embodiments of valve controlled crossovers (for example 23F of FIGS. 21 to 26).

Referring now to FIG. 17, a plan view with line A-A associated with FIG. 18, of a manifold crossover (23) embodiment (23C), depicting fluidly separated intermediate concentric passageways (24X and 24Y) formed within the intermediate concentric passageway (24), about the innermost passageway (25).

FIG. 18 depicts an elevation cross-sectional view along line A-A of FIG. 17, illustrating a manifold crossover (23C). The Figure shows the left side fluidly separated passageway (24Y) ending at a lower end wall for diverting fluid communication through lower radial passageways (75), with the right fluidly separated passageway (24X) ending at an upper end wall for diverting fluid communication through the upper radial passageways (75). The engagement of a flow control device, for example a plug (25A of FIG. 15), within the receptacle (45) between upper and lower radial passageway (75) orifices (59) can effectively divert fluid communication from the concentric passageway (24) to the innermost passageway (25), and vice-versa.

Referring now to FIG. 19, the Figure depicts a projected view of FIG. 18 along section line A-A of FIG. 17, with detail line B associated with FIG. 20 of a manifold crossover (23C). The Figure shows the ends (90) of the manifold crossover engagable between conduits of conduit strings (2, 2A) of a manifold string, wherein the innermost passageway can be usable to convey flow control devices through the string. The intermediate concentric passageway (24) is shown fluidly separated into flow stream passageways (24X and 24Y) to cross over fluid communication from the innermost passageway (25) to the concentric passageway (24), and vice-versa, when a flow control device is engaged with the receptacle (45) between radial passageway (75) orifices (59) The manifold crossover (23C) can be usable with a valve controlled manifold crossover (23F of FIGS. 21-26), wherein a valve control line passageway (141) can be placeable within walls between fluidly separated passageways (24X, 24Y) for subsequent continuance within the concentric passageway (24) or for external engagement with the string, as shown in FIG. 17.

FIG. 20 depicts a magnified view of the portion of the manifold crossover (23C) within detail line B of FIG. 19, with dashed lines showing hidden surfaces, and further illustrates the arrangement of passageways (24, 25, 24X, 24Y and 141) about and around the radial passageway orifices (59), connecting the passageways (24, 25 of FIG. 18) formed by the inner (2) and outer conduits (2A).

FIGS. 21 to 26 depict various views of a valve controlled manifold crossover (23F) embodiment. The Figures include conventional valves (74) that can be suitable for subterranean use. The valves are shown, for example purposes, as fail-safe flapper (127) type subsurface safety valves, with control lines (79), that can be engaged to the upper and lower ends (90 of FIGS. 17-20) of a manifold crossover (23C of FIGS. 17-20) to form a valve controlled manifold crossover (23F), with upper and lower ends engagable between conduits (2, 2A) of a larger manifold string.

Referring now to FIGS. 21, 22 and 23, the Figures depict plan, elevation cross-sectional and isometric projection views, respectively, with break lines showing removed sections of the FIG. 22 cross-section, along line C-C of FIG. 21, and projected to form the isometric view of FIG. 23, with detail lines D, E and F associated with FIGS. 24, 25 and 26, respectively, of a valve controlled manifold crossover (23F).

The Figures illustrate flapper (127) type valves (74) through which flow control devices may be conveyed, and through which a plug (25A) flow controlling device can be installed within the receptacle (45) to divert fluid communication between the upper innermost passageway (25), through the upper radial passageway (75) and the fluid separated concentrically disposed passageway (24X), to the lower intermediate passageway (24). At the same time or simultaneously, fluid communication can be diverted through the upper concentric passageway (24), through the fluidly separated concentric passageway (24Y) and lower radial passageway (75), to the lower innermost passageway (25). Fluid flow to both fluidly communicated flow streams can be selectively controllable by the upper and lower valves (74) and control lines (79).

FIG. 24 depicts a magnified view of the portion of manifold crossover (23F) within detail line D of FIG. 22. The Figure illustrates the upper conventional flapper (127) valve (74) with a flow tube (142) that can be engagable with the flapper (127) urged by a piston (143) pressured through the control line (79) axially downward to hold the valve open. A loss of hydraulic pressure in the control line (79) can release the piston (143) force, and a spring (144) can be used to shut the valve with pressure beneath the flapper assisting closure. The valve can be engaged to the inner concentric conduit string (2) and contained within the outer concentric conduit string (2A), with the lower valve control line passing through the concentric passageway (24) or, alternatively, on the exterior of the assembly as shown.

In a manner similar to the manifold crossover (23C), the diameter of a conduit string (2, 2A) can be adjustable within any confining spaces to accommodate a loss of cross-sectional area. For example, the diameter of the conduit 2A of FIGS. 21-26 is increasable to provide improved flow properties past the valve (74) bodies extending into, and partially blocking, the depicted concentric passageway (24).

Referring now to FIG. 25, a magnified view of the portion of manifold crossovers (23C and 23F) within detail line F of FIG. 23 is shown. The Figure depicts the cable engagable connector (68) of the plug (25A), that is deployed through, and engaged within, the upper innermost passageway (25) to divert fluid communication from the innermost passageway to the upper radial passageway (75) orifices (59).

The Figure shows control and/or measurement lines (79) that can be usable to, for example, operate the lower valve (74) and to operate measurement devices for the substantially water interface in a solution mining and/or underground storage cushion operation, with hydraulic or electrical signal passage through the wall between the fluidly separated passageways (24X, 24Y) and the intermediate concentric passageway (24) or, alternatively, by engagement to the outside diameter of the outer string (2A). The control or measurement cable or line (79) can pass through the concentric passageway, between concentric conduits (2 and 2A), or enter the surrounding passageway about the manifold crossover (23).

Similar arrangements can be usable for passing control and/or measuring conduit or cable lines (79) from the surrounding passageway (55 of FIGS. 3, 6 and 9-12) into a concentric passageway (24 of FIGS. 3, 6 and 9-12) to bypass, for example, a packer (40 of FIGS. 3, 6, and 9-12). Thereafter, the cables can re-enter the surrounding passageway and be strapped to the assembly as it is placed within the passageway through subterranean strata (52 of FIGS. 3, 6, and 9-12).

FIG. 26 depicts a magnified view of the portion of manifold crossovers (23C and 23F) within detail line E of FIG. 22. The Figure illustrates the plug diverting fluid communication from the lower innermost passageway (25) to the radial passageway (75) orifices (59), with control lines (79) exiting the bottom of the wall between fluidly separated passageways (24X, 24Y), both internal and external to the outer conduit (2A).

Referring now to FIGS. 27 and 28, the Figures depict a plan view with line G-G and elevation cross-section along line G-G, respectively, of an orifice piston embodiment (128). The Figures show a housing (114) with outer diameter seals (66), upper and lower orifices (59) at the ends of the associated passageway that can be usable for passage of a conduit or cable (11 of FIG. 15). The orifice (59) passageway may be sealing or provide partial fluid communication to aid placement, removal and use within a method. Methods of use include, for example, placement within manifold crossover (23C, 23F, 23I, 23T, 23Z) receptacles between innermost passageway orifices, wherein the connectors, shown for example as mandrels (89), are engagable with receptacles to divert all or part of fluid communication from the innermost passageway from crossing radial passageways fluid flow streams above and below the orifice piston between intermediate and innermost passageways, similar to a choke or plug (25A of FIGS. 21-23 and 25-26), when cable or conduits are passed through the flow control device (61) orifice piston (128) and innermost passageway. Differential pressures against the upper and lower piston surfaces can be usable to place and/or hold the orifice piston (128) in place or to aid in its removal during, for example, the under-balanced cable perforating operations of FIGS. 3 and 6; the under-balanced coiled tubing drilling operations of FIG. 3; or the coiled tubing cleanout of insolubles blocking a manifold string in the solution mining and combined operation methods of FIGS. 9-14.

FIG. 29 depicts an isometric view of a fluid motor and fluid pump (69A) flow control device (61) with a cable connection (68) for placement and removal through the innermost passageway. The pump can be usable within receptacles in various manifold crossovers (for example 23C, 23F, 23I, 23T, 23Z), with upper and lower fluid turbines (112) placeable between crossing fluid communicating passageways. The energy from one fluid mixture flow stream can be partially transferred to the other through a shaft (113) connecting the two turbine or impellor (112) arrangements, for example, gas expansion from an underground storage cavern driving one impellor also drives the other impellor, which can be usable to pump water into the storage cavern for solution mining operations and, conversely, with fluid pumped into the cavern during solution mining assists either storage fluid or brine extraction from the cavern. For example, the temperature of gas expansion can be reduced by decreasing the decompression of stored gas, thereby increasing the withdrawal periods achievable during seasonal drawn down of a cavern, before shutting in on minimum equipment operating temperatures. If differing rotational speeds between impellors are required, for example, when expanding gas through one turbine is driving the other liquid pumping impellor with a higher torque requirement, gearing arrangements, such as planetary gearing are usable within the housing (114).

Referring now to FIGS. 30 and 31, the Figures show diagrammatic views of the manifold crossover (23F) of FIGS. 21-26 forming a manifold string (70U) embodiment of FIG. 30, and the manifold crossover (23F of FIGS. 21-26) combinable with manifold crossovers (23I of FIGS. 32-34; 23T of FIGS. 6, 11-12 and 54-58; 23Z of FIG. 38; 23S of FIGS. 10 and 42-44; and 23V of FIGS. 71-73) and configurable in various arrangements to replicate the valve controlled manifold string (70W) embodiment of FIG. 31. The Figures include various usable flow paths and fluid mixture flow stream variations with a plurality of valve (74) configurations, wherein further embodiments are possible with addition conduits, passageways and valves.

The FIG. 30 manifold string (70U) depicts a flow stream F1 flowing axially upward within the lower end concentric passageway (24) and crossing over above the flow control device (61), below the upper valve (74A), to the upper end innermost passageway (25). In addition, the Figure shows a flow stream F2 flowing axially downward within the upper end concentric passageway (24) and crossing over below the flow control device (61), above the lower valve (74B), to continue through the lower end innermost passageway (25).

The FIG. 31 manifold string (70W) depicts a flow stream F1 flowing axially downward within the upper end innermost passageway and crossing over above the upper flow control device (61), below the upper valve (74A), to the lower end concentric passageway (24). In addition, the Figure shows a flow stream F2 flowing axially upward within the lower end additional concentric passageway (24A) and crossing over above the lower flow control device (61), above the lower valve (74C), to the innermost passageway (25) and crossing over again, below the upper flow control device (61) to the upper end concentric passageway (24). Further, the Figure includes a flow stream F3 flowing axially upward through the lower end innermost passageway (25) and crossing over below the lower flow control device (61), to continue through the upper end additional concentric passageway (24A). All flow streams (F1, F2, F3) can be controlled by selectively controllable valves (74A, 74B, 74C) of the innermost passageway (25).

Referring now to FIGS. 32, 33 and 34, the Figures show plan, elevation cross sectional and isometric projection views, respectively, with dashed lines showing hidden surfaces and break lines showing removed sections of FIG. 33 cross-section, along line H-H of FIG. 32, projected to form the isometric view of FIG. 34, of a manifold crossover (23I) embodiment, with additional intermediate concentric passageways (24A, 24B of FIG. 32). The Figures illustrate an inner conduit (2), intermediate conduit (2A), and outer conduit (2B) forming an innermost passageway (25), intermediate concentric passageway (24), and additional intermediate concentric passageways that can be usable for fluid communication.

Dependent upon the number of intermediate passageways between the innermost passageway (25) and the concentric passageway (24A), that can be fluidly connected by the radial passageway (75), one (24X) or more (24Y) fluidly separated passageways can pass through the manifold crossover (23I) without being diverted to fluidly communication between one (24) or more upper and lower intermediate passageways. The third fluidly separated passageway (24Z) can fluidly communicate from a concentric passageway (24A), through radial passageway (75) orifices (59), with the innermost passageway (25) on opposite sides of a receptacle (45) for engagement of a flow control device. Engagement of a flow controlling device within the receptacle (45), between radial passageway orifices (59), can be usable to divert or crossover all or a part of fluid mixture flow streams being communicated through the innermost passageway (25) and the fluidly engaged (59, 75) concentric passageway (24A).

FIGS. 35 and 36 depict plan views with line I-I and elevation cross-section along line I-I, respectively, with break lines showing removed portions, of an embodiment of a flow controlling device (61) bore selector (47A). The depicted embodiment can be usable to selectively divert fluid flow and/or further flow controlling devices through a plurality of orifices. The Figures show an upper straddle (22) wall branching to a plurality of orifices (59), with guiding surfaces (87), that can be usable with a chamber junction (43 of FIG. 38) additional orifices to communicate devices and/or fluids. The bore selector (47) can be engagable at a receptacle (45B) for placement, with mandrels (60) engagable to an associated receptacle (45 of FIG. 38). The upper and lower straddle (22) walls can be usable to control flow of a surrounding conduit orifices (23, 59 of FIG. 38), with passage of fluids through, for example, an internal one-way valve (84) or other internal flow controlling device (61) to aid placement, removal and/or usage of the bore selector.

Referring now to FIG. 37, a plan view with line J-J above an elevation cross-section along line J-J, with a break line showing a portion removed, of a bore selector (47) and flow controlling device (61) is shown. The Figure shows a guiding surface (87) for fluids or devices through the bore selector orifice (59), that can be alignable with an associated chamber junction (for example 43 of FIG. 38), wherein the guiding surface (87) wall can block access to an additional orifice and exit bore axially aligned with the innermost passageway, and/or other radially disposed additional orifices. An extension of the bore selector (47) outer wall can also form a straddle (22) that can be usable to block adjacent manifold crossover orifices (23, 59 of FIG. 38).

Referring now to FIGS. 32-34, 38 and 42-44, the Figures depict manifold crossovers (23) that can be usable for diverting flow between the innermost passageway (25), through an intermediate concentric passageway (24), to a passageway disposed radially outward, such as an additional concentric passageway (24A) or a passageway surrounding the outer conduit (2A). The radial passageway (75) comprises fluidly separated passageways (24X, 24Y) or the bore of a conduit (39).

FIG. 38 depicts a plan view with line K-K above an elevation cross-section along line K-K of a manifold crossover (23Z) embodiment, within a manifold string (700), with break lines showing removed portions. The Figure illustrates a chamber junction (43) with three radially disposed exit bore conduits (39) truncated (46) at an enclosing concentric conduit (2A), forming radial passageways (75) engaged through radial passageway orifices (59) to the chamber (41) for forming an innermost bore (25) with a fourth exit bore conduit (39) axially aligned with the upper internal passageway (25), that is shown engaged to the lower end internal conduit (2) and concentrically disposed within the concentric conduit (2A). The Figure shows the manifold crossover (23Z) with a flow diverter (21), and the ends (90) of the manifold crossover (23Z) can be engagable between conduits of a manifold string (70G).

The example manifold string (70) has a plurality of adjacent passageway orifice (59) crossovers (23), axially below the chamber junction (43), with associated receptacles (45) for engaging flow controlling devices, such as bore selectors (47A of FIG. 35-36 or 47 of FIG. 37) or straddles (22 of FIGS. 39-41). The devices can divert fluid from the innermost passageway (25) to the concentric passageway (24) through the adjacent passageway orifice (59) crossovers (23) by blocking a portion of the innermost passageway (25), or the devices can prevent communication between the passageways by straddling the orifices (59).

Example fluid mixture flow stream arrangements include injecting (31) fluid through the upper end innermost bore (25) and diverting it, with a bore selector (47A of FIGS. 36-36), through the three radial passageways (75) to the passageway surrounding outer conduit (2A). The fluid flow (34) through the lower innermost passageway (25) can cross over (23) at the adjacent passageway orifices (59), below the bore selector and continue axially upward (34) in the concentric passageway (24).

Referring now to FIGS. 39, 40 and 41, the Figures depict plan, cross-sectional and magnified detail views, respectively, with the portion within detail line M of FIG. 40 cross-section, along line L-L of FIG. 39, magnified in FIG. 41 for illustrating an adapted prior art flow control device (61), that can be usable as a bore selector (47A). The Figure shows a straddle (22) with a flow control device connection (96) that is depicted, for example, as snap-in mandrel (60) with a spring (144) locking arrangement to prevent dislodgement during fluid communication. A placement receptacle (45B) can be usable for engaging and conveying the apparatus through the innermost passageway for engagement with an associated receptacle.

The straddle (22) portion internal bore (25) can be usable as a radial passageway when blocking orifices of a manifold crossover (for example 23S of FIG. 42-44), or the internal bore may open, or be partially or fully blocked, to selectively divert fluid to orifices (59) within the straddle (22) wall, usable as fixed chokes and/or protection against flow cutting sealing surfaces within which the straddle or bore selector is engaged. Seals (66), for example, chevron type seals (97), can be usable for blocking flow past the straddle (22) wall or for diversion through the protective and/or fixed choke orifices (59). Any orientation means suitable for subterranean use, for example keys and slots or helical surfaces, can be usable to align the bore selector (47A) fixed choke and/or protective orifices (59) with radial passageways of the exit bore conduits (39).

FIGS. 42, 43 and 44 depict plan, elevation cross-sectional and isometric projection views, respectively, with FIG. 43 cross-section, along line N-N of FIG. 42, projected to form the isometric view of FIG. 44 of manifold crossover (23S) embodiment. The Figures illustrate an additional concentric conduit (2B), shown as a dashed line, that can be usable to form an additional concentric passageway (24A of FIG. 42) about a concentric conduit (2), that is shown engaged with an adapted chamber junction (43) for forming a concentric passageway (24) through which exit bore conduits (39), with internal radial passageways (75), can fluidly communicate between the innermost passageway (25) and the additional passageway (24A of FIG. 42) or surrounding passageway, formed when the assembly is placed within the passageway through subterranean strata. The assembly can be engagable between conduits of manifold strings at upper and lower ends (90). An axially aligned exit bore conduit (39 of innermost bore (25) diameter can be disposed immediately below the radially extending exit bore conduits (39), wherein a bore selector (47A of FIGS. 39-41) can be engagable with the receptacle (45) to selectively control fluid flow through the radial passageways (75) and placeable, through the axially aligned exit bore conduit, for engagement with other manifold crossovers.

Flow control devices (61) can be usable as a bore selector (47A). For example, the straddle (22) of FIGS. 39 to 41, can be placeable and engagable with an internal receptacle (45B) for engagement to the manifold crossover receptacle (45). The flow control device can be usable to form an axially aligned radial passageway (75A) that can be fluidly separated from radial-extending passageways (75) with various seals (66), including for example, interlocking type seals (97), which can be usable for pressure containment about orifices (59) for protection from flow cutting and/or fluid mixture abrasion. FIGS. 43 and 44 show a flow control device engagement (96), that can be usable for orienting the bore selector orifice (59) to bore passageways.

Comparisons of FIGS. 3, 6, 9-14, 16-38, 42-44, which depict various manifold crossovers (23), having a plurality of upper end and lower end concentric conduits (2, 2A, 2B, 2C, 2D, 39, 148, 149), to FIGS. 45 to 73, which depict manifold crossovers (23) having an upper end plurality of concentric conduits and lower end plurality of concentric and/or non-concentric conduits (2, 39, 148, 149, 150), show a number of embodiments with various arrangements of axially parallel and/or concentric conduits, within a single main bore, that can be usable with manifold crossovers of the present invention. The conduits within a single strata bore from, for example, a conventional dual bore wellhead and valve tree or traditional concentric conduit wellhead and valve tree, can be engagable with concentric and/or non-concentric conduits to form a single main bore that can be further engagable to a manifold crossover and/or chamber junction with a plurality of lower end conduits for forming a manifold string.

Referring now to FIGS. 45 and 46, the Figures show isometric and magnified isometric views, respectively, with dashed lines showing hidden surfaces with and within detail line P, depicting an embodiment of a chamber junction (43). The depicted chamber junction (43) comprises a chamber (41) and engaged (44) exit bore conduits (39), with innermost passageways (25) extending downward from a chamber bottom (42), that can be usable for construction methods (for example CS2 of FIG. 5). The engagement of a bore selector (for example 47 of FIG. 47) is usable for boring and/or fluid communication. The upper end (90) of the chamber junction can be engagable to a conduit of the plurality of concentric conduits of a manifold string, with lower ends engagable to a plurality of conduit strings.

FIG. 47 depicts an isometric view of bore selector (47) flow control device (61) that can be usable with the chamber junction of FIGS. 45-46 and 48-50, with dashed lines showing hidden surfaces. The Figure illustrates a guiding surface (87) for devices and/or fluids, that is in communication with an orifice (88) engagable with the bore of an exit bore conduit through placement with, for example, a receptacle engagement (45B) that can be alignable with the slot receptacle (65) and associated key, which can be fixed to the chamber of a chamber junction, wherein the lower end engages the chamber junction bottom.

Figures 59, 60, 61, 62, 63, 64, 65, 66, 67:
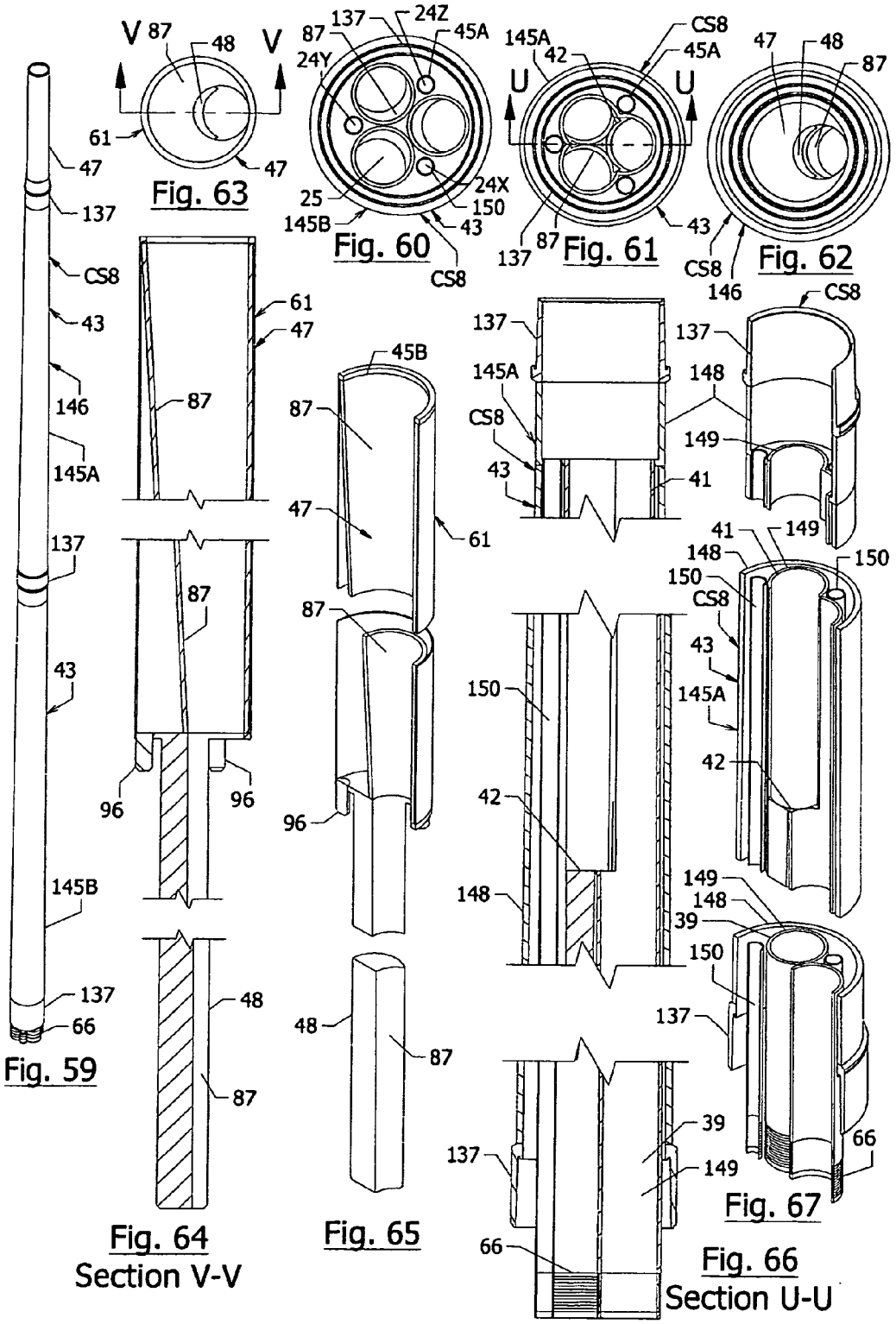
FIGS. 59 to 67 show various apparatus of the present inventor usable with a construction method of the present invention.

Referring now to FIGS. 48, 49 and 50, the Figures depict an isometric view with detail lines Q and R, a magnified view within line Q of FIG. 48 and magnified view within line R of FIG. 48, respectively, with dashed lines showing hidden surfaces of an embodiment of a chamber junction (43). The depicted chamber junction (43) includes an upper end (90) that can be engagable to conduits of a single main bore and placeable within or usable for boring a strata passageway, and a lower end casing drill bit or reamer shoe (125). After placement, the exit bore conduits (39) can be usable as primary barriers (149) for engagement of, for example, liner hangers or packers with a secondary barrier (148) extending downward from the chamber (41). Fluid communicating conduits (150, as shown in FIG. 67) orifices (59) can be usable for alignment of bore selectors or engagement of subsequent chamber junctions, and fluid communication through lower end orifices (59) associated with the drill bit or reamer shoe (125) during boring or placement. After placement, a bore selector guiding surface can be usable to place drilling assemblies, through the exit bore conduits (39), to whip-stocks (124) at the lower end, which can be further usable to laterally and fluidly separate the separated well bores under a single main bore.

FIGS. 51, 52 and 53 depict an isometric view, an upwards side elevation view, and a front elevation view, respectively, with dashed lines showing hidden surfaces of a flow controlling device (61) bore selector (47). The depicted flow controlling device (61) bore selector (47) can be usable with chambers junctions, similar to FIGS. 54-58, with a guiding surface (87) for devices and/or fluids, wherein a flow control device engagement (96), shown as a helical alignable mandrel, can be usable to orient the bore selector orifice (59) to an exit bore passageway. The Figure includes an innermost bore aligned receptacle (45B) in the guiding surface that can be usable for placement and retrieval of the bore selector.

Referring now to FIGS. 54 to 58, the Figures depict a manifold crossover embodiment (23T) usable as manifold string (76H) that can be usable to minimize frictional resistance to flow in high velocity or high erosion environments.

Figures 54, 55, 56, 57, 58:
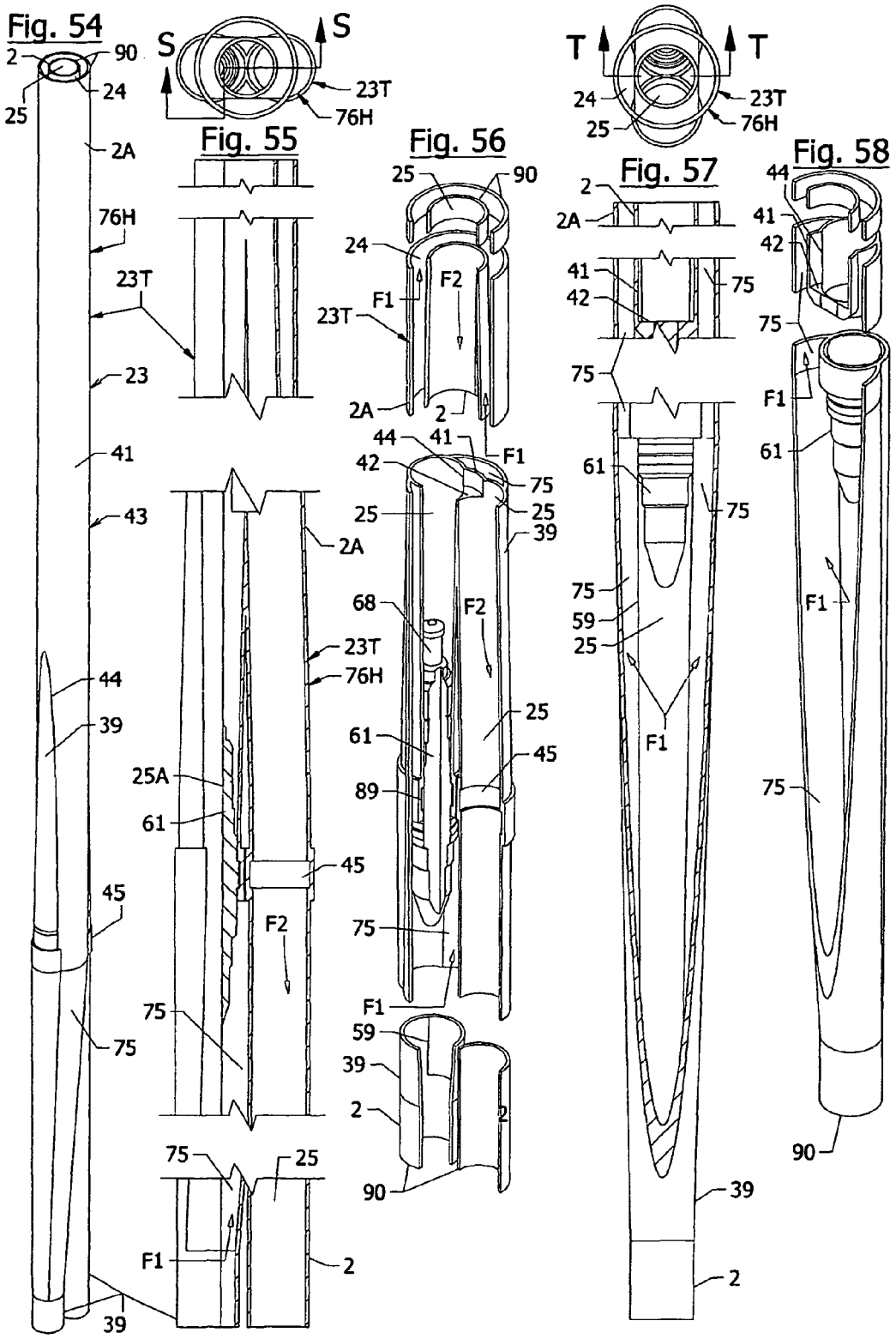
FIGS. 54 to 58 depict a manifold crossover embodiment of the present invention formed from an adapted chamber junction of the present inventor.

Referring now to FIG. 54, the Figure depicts an isometric view of an adapted chamber junction manifold crossover (23T), associated with FIGS. 55 to 58. FIG. 54 illustrates an inner concentric string (2), outer concentric string (2A) or second main bore conduit with ends (90) engagable to conduit strings of a single main bore. The chamber junction (43) can be adapted to form a manifold (43A) with the addition of receptacles and a radial passageway (75) blister, located between the exit bore conduits (39) and the chamber junction bottom (42) about which the upper outer concentric string (2A) extends and fluidly engages with the blister.

FIGS. 55 and 57 depict plan views above elevation cross-sectional views with and along lines S-S and T-T, respectively, with break lines removing portions of the assembly associated with the cross-sections in FIGS. 56 and 58 isometric views, showing the manifold crossover (23T) of FIG. 54. The Figures illustrate the placement of a flow controlling member, shown for example, as a cable (11 of FIG. 16) placeable and retrievable blocking plug (25A), that can be conveyable through the inner concentric string (2) innermost passageway (25) with a bore selector (47 of FIGS. 51-53) guiding surface that can be usable to complete the chamber junction innermost passageway guiding surface (87), excluding other exit bores. The diverting flow controlling member can be engaged with the nipple profile receptacle (45) to block fluid communication through the exit bore conduit (39) innermost passageway (25).

The concentric passageway (24) flow stream fluidly communicates (F1) through the radial passageway (75) blister to the lower end of one exit bore conduit (39) passageway, with the opposite exit bore conduit (39) fluidly communicating (F2) with the chamber (41) and chamber (41) innermost passageway (25).

Commingled flow, within the chamber (41) junction manifold (43A), from both exit bores (39) can be operable by placing a straddle (22 of FIGS. 39-40 without choke orifices) across the orifice (59) of the radial passageway (75).

Referring now to FIGS. 56 and 58, the Figures depict projected isometric views with cross-sections associated with FIGS. 55 and 57 and break lines of the manifold crossover (23T) of FIG. 54. The Figures show isometric views from different orientation perspectives of the radial passageway (75) blister about the flow controlling device (61), shown as a blocking plug (25A).

Other flow controlling members, such a pressure activated one-way valve, can be usable to feed a substantially lighter specific gravity fluid stream, from the concentric passageway (24), into a heavier specific gravity flow stream, from an exit bore conduit, to reduce hydrostatic pressure on the second well and, thus, increasing flowing velocity and/or creating an under-balance.

For solution mining operations, the manifold crossover (23T) can be usable to fluidly separate water injection and brine extraction streams, maintaining access to the innermost passageway for the running of other devices, such as severance devices or measurement devices for measuring the shape of a salt cavern or performing a mechanical integrity test of the final cemented casing shoe.

The manifold crossover (23T) of FIGS. 54 to 58 can be adaptable with further conduits comprising, for example, an adjacent passageway orifice crossover (23 of FIG. 38) across the radial passageway (75) orifice (59) of the exit bore conduit (39), or to the concentric and supporting conduits of FIGS. 71-73, to form a manifold crossover (23V of FIGS. 71-73). Access to innermost passageways of supporting flow conduits (150, as shown in FIG. 67), located below the chamber (41), is not required. Alternatively, the additional exit bore conduits (39) can be increasable from two to four, by adapting the additional chamber junction with additional orifices aligned with supporting flow conduits (150, as shown in FIG. 67), to provide access to their innermost passageway.

Referring now to FIGS. 59 to 71, the Figures depicting various configurations and/or apparatuses for a construction method (CS8) embodiment. Embodiments of the method (CS8) can be usable with a plurality of exit bore (39) arrangements that can be selectively accessible through a chamber junction (43) with one or more bore selectors (47) engagable with an associated plurality of additional orifices. Additional conduits (150), supporting fluid communication to or from the single main bore, can be placeable about exit bore conduits of a chamber junction arrangement to, for example, fluidly communicate with concentric passageways, not requiring innermost bore access, or to align bore selectors or engage conduit arrangements with large cross-sectional areas and associated forces, in the event of a breach of a primary barrier (149), wherein a usable secondary barrier (148) is available.

Prior art expandable metal junctions, as described in FIG. 4, and conventional multilateral technologies are, generally, unable to provide well branches with both primary (2, 39, 149) and secondary (2A, 148) conduit barriers, with associated usable concentric or annular passageways for monitoring pressure between these barriers, through fluid communication. Concentric passageways, between conduit pressure barriers, can be usable for various associated well operations, for example, fluidly circulating a higher specific gravity kill fluid to replace a failed primary barrier conduit barrier (2, 39, 149).

Manifold strings (70, 76) and/or manifold crossovers (23) can be usable with the construction method (C8) to provide selective control of pressurized fluid communication within and about these bathers, for one or more wells below a single main bore, through a single wellhead and valve tree to, for example, provide a single subsea tree, which can be usable with gas lift and/or water injection for production from multiple wells. Alternatively, uses can include the selective control of a plurality of wells to one or more underground storage caverns, during solution mining and/or underground storage operations.

FIG. 59 depicts an isometric view of an arrangement (146) of a bore selector (47), an upper chamber junction assembly (145A), and lower chamber junction assembly (145B), illustrating a construction method (CS8). The conduit above the upper connection (137) is removed to show the bore selector (47) of FIGS. 63-64, that can be placeable through a single main bore and engagable to the upper chamber junction (43) of FIG. 61 and FIGS. 66-67, engaged with a connector (137)

to the lower chamber junction (43) shown in the plan view of FIG. 60, wherein the entire assembly (146) is shown in the plan view of FIG. 62.

Referring now to FIGS. 60, 61 and 62, the Figures show plan views of the lower chamber junction assembly (145B), upper chamber junction assembly (145A) and fully assembled arrangement (146) of FIG. 59, respectively. The Figures show a preferred construction method (CS8) with the FIG. 60 chamber junction (43) of similar construction to the chamber junctions of FIGS. 45-46 and 48, and with no overlap of exit bore internal diameters for providing fluidly separated exit bores guiding surfaces (87) and innermost passageways (25) with fluid communicating conduits (150, as shown in FIG. 67). The fluid communicating conduits can be usable for fluid communication with, for example, fluidly separated passageways (24X, 24Y and 24Z) from a circumferentially segmented concentric passageway, or usable as receptacles (45A) for a bore selector, similar to that of FIG. 47. In addition, the fluid communicating conduits can be usable to engage and/or to fluidly communicate with the upper chamber junction (43), as shown in FIG. 61. The exit bores' inside diameters overlap in a cloverleaf shape which can be usable with the bore selector, of FIGS. 63-64, to select the right most exit bore passageway, as shown FIG. 62 plan view. The guiding surfaces (87) of the bore selector extension (48) can be engaged within the cloverleaf shape to complete the right most bore circumference.

FIGS. 63, 64 and 65 depict plan, elevation cross-sectional and isometric projection views of the cross-section, respectively, of the bore selector (47) flow controlling device (61) of FIGS. 59 and 62, with break lines showing removed portions in the FIG. 64 cross-section, along line V-V of FIG. 63, projected to form the isometric view of FIG. 65. The Figures illustrate the guiding surface (87) extending to an extension (48), which can be usable to complete, for example, the circumference of exit bores of the chamber junction of FIG. 61 for conveyance of devices and/or for fluid communication to a selected bore, while excluding other bores. The bore selector (47) can be rotatable to various bores and engagable with connectors (96) to the receptacles (45A of FIG. 61).

Referring now to FIGS. 61, 66 and 67, the Figures depict plan, elevation cross-sectional and isometric projection views, respectively, of a chamber junction (43) and construction method (CS8), with break lines showing removed portions in FIG. 66 cross-section, along line U-U of FIG. 61, projected to form the isometric view of FIG. 67, of the upper chamber junction assembly (43) of FIGS. 59 and 62. The Figures illustrate an upper end connector (137) that can be engagable with a single main bore conduit and a lower end connector (137) that can be engagable with, for example, the upper end of the lower chamber junction of FIGS. 59-60 or another assembly within the single main bore. The chamber (41) and exit bores (39) can form primary barrier conduits (149) with lower end seal stacks (66), engaged with the upper end bores of FIG. 60, within a secondary conduit barrier (148). Fluid from, for example, lower end annular spaces associated with the well bore extending from the chamber junction (43 of FIG. 60), can be communicable through supporting fluid communication conduits (150) for measurement (13 of FIG. 1) at the single main bore upper end wellhead.

FIGS. 68, 69 and 70 depict plan views of various example combinations of conventional sized conduit configurations, including four 13⅜ inch diameter, three 13⅜ inch diameter, and two 13⅜ inch diameter primary bather configurations, respectively, of construction method (CS8) that can be usable to adapt chamber junctions of FIGS. 45-46, 48-50, 54-58, 59-62 and 66-67. FIG. 68 illustrates four 13⅜ inch outside diameter primary barrier conduits (149) within a 36 inch outside diameter secondary bather conduit (148), with five 5 inch outside diameter supporting pressurized fluid communication conduits (150). FIG. 69 depicts three 13⅜ inch outside diameter primary barrier conduits (149) within a 32 inch outside diameter secondary barrier conduit (148), with three 6 inch outside diameter supporting fluid communication conduits (150). FIG. 70 shows two 13⅜ inch outside diameter primary barrier conduits (149) within a 30 inch outside diameter secondary barrier conduit (148), with four 5 inch outside diameter and two 8⅝ inch outside diameter supporting pressurized fluid communication conduits (150). The exemplary outside and inside diameters illustrated are reconfigurable to provide various pressurized fluid communication ratings, with annular spaces between outside diameters of the conduits (149, 150) and within the secondary bather conduit (148) inside diameter, also usable for fluid communication.

Conventional well construction and operation practices, generally, dictate the use of conventional sized conduits to facilitate the use of conventional tooling and apparatus. This use includes conventional flow controlling devices that can be placeable through the innermost passageway of the present invention, wherein 13⅜ inch outside diameter conduits can be commonly used for intermediate casing and can represent a conceptual point below which a large selection of conventional apparatus are available for combinations of subterranean pressures, apparatus diameters, and apparatus cross-sectional areas. However, with the use of outside diameter conduits above 13⅜ inch, conduit pressures applied to larger cross-sectional areas generally result in large forces that limit the availability of conventional apparatus.

The construction method embodiment (CS8) of the present invention provides a secondary barrier (148), that can support conduits and space arrangements usable for selectively controlling pressurized subterranean fluid-mixture flow streams, should the primary barrier conduits (149) fail. For example, within the hanger and packer arrangements of FIG. 3, 6 or 12 or the chamber junctions of FIGS. 59-62, 66-67 and 71, wherein pressures applied across large cross-sectional areas are controllable with conduits (150) usable as solid or conduit type connectors to secure conduit assemblies, with large cross-sectional areas, to act as pressure equalization passageways for preventing application of pressure across large cross-sectional areas. In addition, these large cross-sectional areas can act as pressure relief passageways, in the event of a primary barrier (149) breach, to limit pressures placed on the secondary barrier by, for example, connecting the conduits to a subterranean formation with a fracture gradient, that is less than the secondary barrier, to form a subterranean strata pressure relief mechanism.

The smaller diameters and associated higher pressure ratings of pressure relieving conduits (150) of the construction method (CS8) can be usable with plates, fluidly separating the passageway between conduits (149, 150) and the inside diameter of the secondary barrier (148). Integral plates can be usable to reinforce and improve the pressure integrity of the large diameter secondary barrier (148), with the pressure relief conduits (150) communicating fluid pressure to pressure relief flow controlling devices, in the event of a primary barrier breach to a pressure absorbing reservoir or pressure equalization mechanism to, in use, prevent breaching the secondary barrier prior to repairing the primary barrier.

Referring now to FIGS. 71, 72, 73 and 74, the Figures include a manifold crossover (23V) embodiment depicted in plan, elevation cross-sectional, isometric projection and magnified detail views, respectively, with break lines showing removed portions in FIG. 72 cross-section, along line W-W of FIG. 71, projected to form the isometric view of FIG. 73, with the portion within detail line X magnified in FIG. 74. The depicted manifold crossover (23V) embodiment is adapted from the chamber junction manifold (23T) of FIGS. 54-58. The Figures illustrate a construction method (CS8) with an additional concentric conduit (2D of FIG. 71) shown as a dashed line, usable as a secondary barrier to form a concentric passageway (24C) about primary barriers. As shown the primary barriers comprise the conduit (2C), forming a concentric passageway (24B) about the concentric conduit (2B), which forms an intermediate concentric passageway (24A) about the concentric conduit (2A), which surrounds the intermediate concentric passageway (24) disposed about the innermost conduit (2) and innermost passageway (25). The upper ends (90) of the conduits are shown engagable with concentric conduits of a single main bore while the lower ends (90) are shown engagable with, for example, conduits of a junction of wells or other conduits of a single main bore, such as that depicted in FIG. 68.

The innermost upper end concentric conduits (2, 2A) can engage with the chamber (41) junction (43) forming lower end exit bore conduits (39) that can fluidly communicate through a radial passageway (75) with the intermediate concentric passageway (24) disposed about the innermost conduit (2). The outermost concentric conduits (2B, 2C), fluidly separating concentric passageways (24A, 24B), can transition to lower end fluidly separated radially disposed pressurized fluid communication conduits (150).

As demonstrated in FIGS. 3, 6, 9-14 and 17-73, embodiments of the present invention thereby provide methods and manifold string (70, 76) arrangements of manifold crossovers (23), valves (74), flow control devices (61) and controlling and/or measurement lines (79) that can be usable in any configurable arrangement and placeable within a single main bore. and/or orientated to selectively control pressurized fluid mixture flow streams of one or more substantially hydrocarbon and/or substantially water wells from a single main bore, during well construction and/or operations.

Referring now to FIG. 74, the Figure depicts an elevation view cross-sectional slice through subterranean strata of a liquid underground cavern storage and surface brine pond arrangement. The Figure shows concentric conduits (2, 2A) passing through a passageway through subterranean strata (52), comprised of casings and a strata bore forming a chimney above the cavern with walls (1A), that are formed in a salt deposit (5). The conduit strings are usable to transfer brine to and from a pond for storage and displacement of the fluids to and from the cavern; wherein, after initial dewatering of a cavern, conventional practice is to only displace stored liquids with brine.

Surface and subterranean components, comprising the passageway through subterranean strata (52) extending to a salt deposit (5), are later described for a conventional solution mining design (CM3 of FIG. 80) and a gas storage conventional completion design (CM4 of FIG. 79).

Storage fluids can be injected (31) into the upper space within the cavern walls (1A) to displace (34) brine from the lower end space, below a substantially water interface (117) to a brine pond (152) or other brine storage facility, such as another underground storage cavern.

In comparison, conventional practice may involve storage of saturated brine within an underground cavern after liquid storage displacement. However, brine generation for displacement (1T) during simultaneous solution mining and storage operations (1S of FIGS. 76, 80 and 81) with, for example, storage of liquids in a brine and storage reservoir cushion and with stored brine functioning as an interface in u-tube fluid communication, with brine at the lower end of a gas storage cushion of a brine and storage reservoir, are not common practices.

Surface pumps and motor arrangements (116), with surface manifolds (155) comprising conduits and valves, can be usable for operating injection or extraction from the spaces within the cavern walls (1A), a brine pond (152), or other storage facility. The Figure illustrates the use of a transfer conduit (153), in communication with the pumps and motors (116), for extracting fluid from the brine pond (152). In addition, FIG. 74 shows the surface pumps and motor arrangements (116) in communication with a storage operations conduit (154), usable for displacing stored fluids.

Storage fluids can be displaced (34) from the upper end space, within the cavern walls (1A), by injecting (31) brine into the lower end space below the substantially water interface (117), from a brine pond (152) or other brine storage space, through the surface manifolds (155) pumps and motors (116).

Referring now to FIGS. 75, 76, and 80-83, the Figures describe embodiments (1T, 157) of the present invention, wherein storage caverns (158) are fluidly engaged with brine reservoirs (159), via a u-tube like conduit arrangement, wherein both comprise brine and storage reservoirs (158, 159). The brine reservoirs (159) can be usable for brine generation during operation of a storage cavern (158) product displacement and brine storage operation, until the brine reservoir (159) and/or storage cavern (158), when under saturated brine is produced, reaches their maximum effective stable diameter; after which, the caverns (158, 159) can be usable for fully saturated brine and/or product storage at depths associated with the maximum effective diameter.

Brine reservoirs (159) can be usable to improve net present value economics of large salt cavern storage developments by providing continuous brine displacement fluid during brine reservoir (159) solution mining operations (1, 1S), for product displacement operation of an underground storage cavern (158), or product displacement of a storage cavern (158) under saturated brine to a brine reservoir (159). Thereafter, brine and storage reservoirs (158, 159) can be interchangably used as storage caverns (158) or brine generating caverns (159) usable with under saturated or fully saturated brine fluids, for separating storage of substantially water brine fluids with substantially hydrocarbon fluids of differing demand cycles, for example, crude oil, diesel and/or gasoline from an opposite demand cycle from, for example, natural gas.

Embodiments of the present invention (1T) can be usable with other apparatus (for example 21, 23, 23F and 70R of FIG. 80) and methods (for example CO3, CS4, CO6 and CO7 of FIGS. 80 and 81) to selectively access fluids between a plurality of fluid interfaces (117 and/or 117A) for providing selective accessibility to various differing specific gravity products, that can be stored within a single or a plurality of underground brine and storage reservoir salt caverns.

FIG. 75 depicts a diagrammatic elevation cross-sectional view of a slice through subterranean strata depicting a method embodiment (1T) for operating a storage cavern (158) with brine from a subterranean brine reservoir (159). The Figure illustrates a u-tube like conduit arrangement between wells, with heavier brine at the lower end of both caverns and located below a substantially water interface (117) transferred from one cavern to the other with working pressure (WP1 to WP2). Dashed lines within the caverns represent the notional u-tube like arrangement, with brine or another heavier storage fluids gravity separated below lighter fluids, with substantially water (117) and/or fluid (117A) interfaces that can be stored in the upper cushion portion of each brine and storage reservoir salt cavern (158, 159).

A brine reservoir (159) is solution mined (1), and/or usable for storage while being solution mining (1S), to produce brine, that can be expelled (34) through a disposal conduit (153A) until, for example, the cavern reaches a desired size to operate an underground storage cavern (159). The brine is produced from the bring reservoir (159) through a transfer conduit (153) and u-tube arrangement, with the salt saturation level, of continuous brine provision, dependent on the temperature, pressure, volume and residence time of water injected (31) through the feed conduit (156) and into the brine reservoir (159), and in this instance, falling to the substantially water interface (117).

During solution mining (1), the water can be provided through the feed conduit (156) with any fluid, for example, compressed air, nitrogen, diesel, salt inert and/or other storable products. The water can be injected (31) through the feeding conduit (156) into the cushion above a substantially water interface (117) or fluid interface (117A) of the brine reservoir (159), during combined mining and storage operations (1S), to exert working pressure (WP1) on the interface (117 or 117A), which, through the u-tube arrangement, expels (34) the brine through a disposal conduit (153A) or injects (31) the brine through the transfer conduit (153), to the lower end of the underground storage cavern (159), which exerts working pressure (WP2) on the fluid interface (117 or 117A) to displace (34) stored fluid from the underground storage cavern (158) to a storage operations conduit (154) or pipeline.

Working pressures (WP1, WP2) can depend upon the hydrostatic and dynamic pressure heads for stationary and moving fluid columns within the caverns, with various possible saturations of brine and liquids or gases that are storable within either cushion, above and below either substantially water or fluid interfaces (117, 117A).

If compressible fluids, for example, air, nitrogen or natural gas, are used to apply working pressure (WP1), then subsequent release of the compressed fluid can be usable to drive, for example, turbines or pneumatic motors, which can be further usable to aid storage operations. Heat transfer (160) from compression of the fluids can be further usable to heat the cavern and partially offset temperature reductions associated with solution mining and/or compressed fluid expansion.

If one or more lighter specific gravity fluids and/or stored products are placed within a cavern, fluids will gravity separate, given sufficient residence time from the heavier brine, u-tubed between the lower ends of both caverns (158, 159), and form one or more lighter specific gravity fluid interfaces (117 or 117A) from, for example, separated fluids of a pipeline pigging operation.

Conventional two string completions (CM5 of FIG. 81) can be usable to operate single substantially water interface (117) arrangements within each cavern. Alternatively, the two string completions can be usable to operate manifold strings (70 of FIG. 80) with concentric manifold strings (2, 2A of FIG. 80), instead of the single strings (2), as shown, to selectively access a plurality of gravity separated fluids between a plurality of fluid interfaces (117 and 117A), with manifold crossovers (21 and 23 of FIG. 80) forming part of a manifold string within either cavern (158, 159).

Water can be injected (31) into the mining and/or storage operations conduit (156) of the brine reservoir (159) with a salt inert fluid, such as nitrogen, hydrocarbon gas or diesel, that can be placed and floated above the injected water to protect the final cemented casing shoe. The water can be used to produce brine through salt dissolution, with methods similar to those described in FIGS. 76, 80 and 81, for displacement of the upper end cushion of the storage cavern (158) during storage retrieval operations.

Gas storage caverns, for example, may retrieve (34) stored gas from a cavern (158) with significantly less temperature drop by displacing to adjust volume, so as to maintain compressed gas pressure with brine produced from a brine reservoir (159) through the connecting conduit (153) u-tube, while filling (31) the brine reservoir with water to produce additional brine.

For liquid or gas storage, brine displacement can be usable during demand cycles, while solution mining a brine reservoir. Brine from the storage cavern (158) can be disposed to, for example, the ocean with subsequent re-filling of the cavern with stored product, while salt dissolution or solution mining continues within the brine reservoir (159), Alternatively, brine can be displaced back to the brine reservoir, displacing the storage cushion (1S) and/or under saturated brine in the brine reservoir.

If compressed air or nitrogen was used to u-tube brine from a brine reservoir (159) into the expel (34) fluids, such as gas from a storage cavern (158), then the compressed air or nitrogen in the brine reservoir (159) can be usable to drive a turbine or pneumatic motor to aid storage operations and can be released to the atmosphere.

A brine reservoir can be usable to form brine continuously during displacement operations, if water is the displacement fluid, with the salt concentration levels being a function of residence time, pressures volumes and temperatures. Partially saturated brine can be usable to minimize salt dissolution in a storage cavern (158) during combined solution mining, and storage operations (1S), provided there is sufficient effective diameter available for such under saturated displacements prior to reaching a critical cavern stability diameter.

Storing (31), for example, crude oil, gasoline or diesel in the right side brine cavern (159) upper end cushion to u-tube brine, that is partially and/or fully saturated, to the storage cavern (158) for displacing gas during high winter seasonal demand and lower seasonal crude oil, gasoline and/or diesel demand, may be followed by subsequent storage cavern (158) dewatering, with compressed natural gas, during spring or summer seasonally low gas demand, by u-tubing the saturated or partially saturated brine back to the brine reservoir (159) for displacing crude oil, gasoline and/or diesel during the spring or summer seasonally high demand cycle.

Displacement of partially saturated brine between salt caverns can be usable until reaching a maximum effective diameter for salt cavern stability at relevant subterranean depths within the brine reservoir (159) usable to store brine and/or products and the storage cavern (158) usable to store brine and/or products. One or more fluid interfaces (117A) may be present between products of differing specific gravities, effectively floating on top of each other. Fluids, between differing fluid interfaces, can be accessible with manifold strings (70 of FIG. 80).

Referring now to FIG. 76, the Figure depicts a diagrammatic elevation view cross-sectional slice through subterranean strata of a method embodiment (1T) for operating a storage cavern with a subterranean brine reservoir. The Figure shows a u-tube arrangement, similar to FIG. 75, that can be usable to operate the storage cavern (158) with brine produced by solution mining (1) and combined operations (1S) within the brine reservoir (159) with one of two conduits (2) in each cavern (158, 159). Pumps (116), turbines, motors and valved manifolds (155) are shown and can be usable for injecting fluids into and urging fluids from a salt cavern.

Various solution mining (1) methods, comprising injecting water to control a substantially water interface (117), usable to extend the cavern roof from a fixed diameter upward (1B to 1C to 1A), increasing the cavern diameter after solution mining by a lesser diameter upward (1B to 1C to 1A), or combinations thereof, can be usable to form intermediate cavern shapes (147) usable for combined operations (1S) of combined solution mining (1) and storage, prior to reaching the final design cavern walls (1A) at the maximum effective diameter for salt cavern stability.

Combined storage and solution mining operations (1S) can occur from increasing the cavern diameter after solution mining a lesser diameter upward (1B to 1C to 1A), for example, comprising injecting (31) water from a supply conduit (156) into the upper end of the cavern below the upper depicted substantially water interface (117) or, for example, from a fixed diameter upward (1B to 1C to 1A) with injected (31) water falling to the lower depicted substantially water interface (117). The combined operations (1S) can be usable to produce brine through salt dissolution, occurring between the intermediate cavern walls (147) and the final cavern walls (1A), to operate the storage cavern (158) with fluid displacement, by producing (34) brine through the brine reservoir (159) lower end inner conduit (2), transfer conduits (153) and surface manifold (155) with the use of surface pumps (116), usable to inject the brine into the lower end of the storage cavern (158), through its inner conduit (2), floating stored product from the cavern above the substantially water (117) or fluid interface (117A). The working pressures (WP2) and pumping (116) can be usable to move the storage cavern (158) substantially water (117) or fluid (117A) interface upward, selectively controlling the working pressure (WP1) with the valve tree, to produce (34) stored fluids from the upper end of the storage cavern (158).

The described method can be reversible by arranging flow from the storage cavern (158) to the brine reservoir (159), wherein product may be moved with transfer (153) or production (154) conduits from the upper or lower end of either cavern to the other. Stored product from the storage cavern (158) upper end is generally usable as a salt inert solution mining cushion at the upper end of a brine reservoir (159), or brine in the storage cavern (158) lower end can be returned to the brine reservoir (159) lower end.

If, for example, compressed air from a wind turbine or other compressible fluids, such as nitrogen from a nitrogen generator, are used to displace brine from a reservoir (159) in the displacement operation of a storage cavern (158), during storage cavern (158) product re-injection (31) the compressed upper end brine reservoir (159) fluids can be releasable to the atmosphere and/or usable to drive, for example, a surface pneumatic motor (116) or to process turbines through a surface manifold (155) to aid storage operations.

Where appropriate, various operation methods, between the brine reservoir (159) and storage cavern (158), can use subterranean heat transfer (160) in storage operations to, for example, maintain temperatures in a gas storage cavern (158), that was displaced with brine thermally heated by the subterranean strata over a period of residence in a brine reservoir (159).

Figure 77:
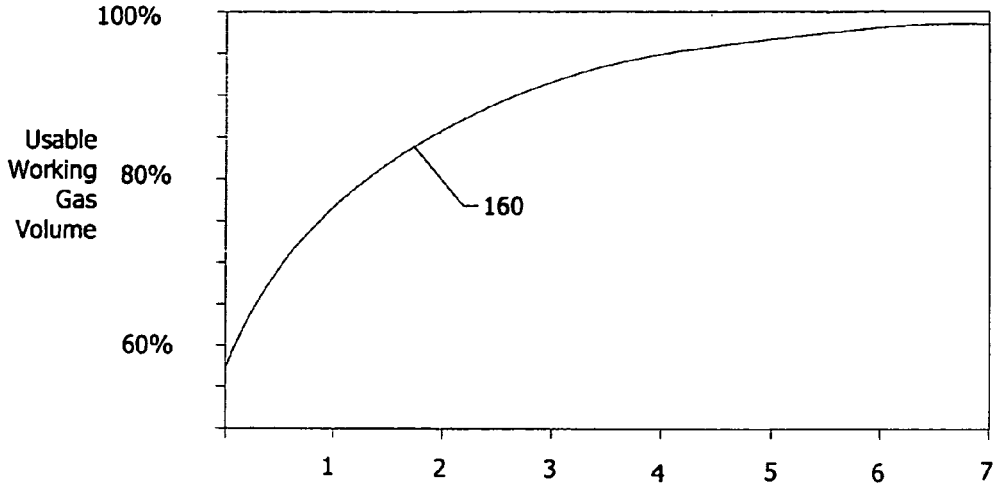
Fig. 77 Prior Art
FIGS. 77 and 78 depict graphs for the conventional concepts of working volume relationships to subterranean reheating of a gas storage cavern, subsequent to solution mining and demand usage cycles.

FIG. 77 depicts an example of a graphical representation of the conventional concept of increasing usable working gas volume from the lower end of the vertical axis upward, over an increasing period of years on the horizontal axis from left to right, resulting from subterranean heat transfer (160) to an underground gas storage cavern. The Figure shows that due to the lower temperatures of water used in solution mining over a period of years, and the chemical process of salt dissolution, the strata around a cavern is cooled below its natural state, and, for this particular example, requires a number of years to return to its original temperature.

While conventional practice for retrieving underground liquid storage can use brine displacement, as described in FIG. 74, it is not conventional practice to use brine displacement to retrieve gas stored underground in a salt cavern. Hence the FIG. 77 graph is usable to explain how the temperature of the cavern can affect the underground salt cavern gas working volumes, and why brine displacement can be usable to increase working volume during earlier years with lower cavern temperatures, when, for example, subsurface safety valves are usable to contain compress gas (CS4 of FIG. 80, CM5 of FIG. 81).

Conventional methods for using working gas volume require increasing volume, by expanding compressed gas, to extract it from a cavern with the ideal gas equation [P1*V1)/T1=(P2*V2)/T2], stating that as the volume increases at a relatively constant pressure, a proportional temperature drop is realized. As conventional gas storage practices expand compressed gases during retrieval, the initial temperature imparted on the compressed gas from a cold cavern shortens the withdrawal period, because the temperature decline of the compressed gas starts from a lower temperature. As the cavern heats up over a number of years, it transfers heat (160) to the compressed gas within causing withdrawal periods to lengthen by starting from a higher compressed gas temperature, thus increasing usable working gas volume as shown in the FIG. 77 graph. Because gas starts decompression from a higher temperature in later years, more of the cavern volume can be usable before reaching the limiting temperature of associated equipment and the final cemented casing shoe, associated with gas decompression.

Gas storage embodiments (1T of FIGS. 75, 76 and 80-83) of the present invention increase the withdrawal period and usable working gas volume within a cold cavern by displacing compressed gas with brine in a manner similar to the conventional method for underground stored liquid retrieval. This is explained by the ideal gas equation [(P1*V1)/T1=(P2*V2)/T2] relationship, which states that retrieval at a relatively constant pressure and volume causes a relatively constant withdrawal temperature. Hence the temperature limits of associated equipment and the casing shoe are not reached as quickly, dependent upon the filling rate of brine and extraction rate of gas, and the usable working gas volume increases in the earlier years when caverns are cold.

In instances where volumes cannot be maintained through brine injection during extraction of gas from storage and the cooling effects of gas expansion are present, withdrawal periods are at least increased thereby increasing the usable working gas volume.

Figure 78:
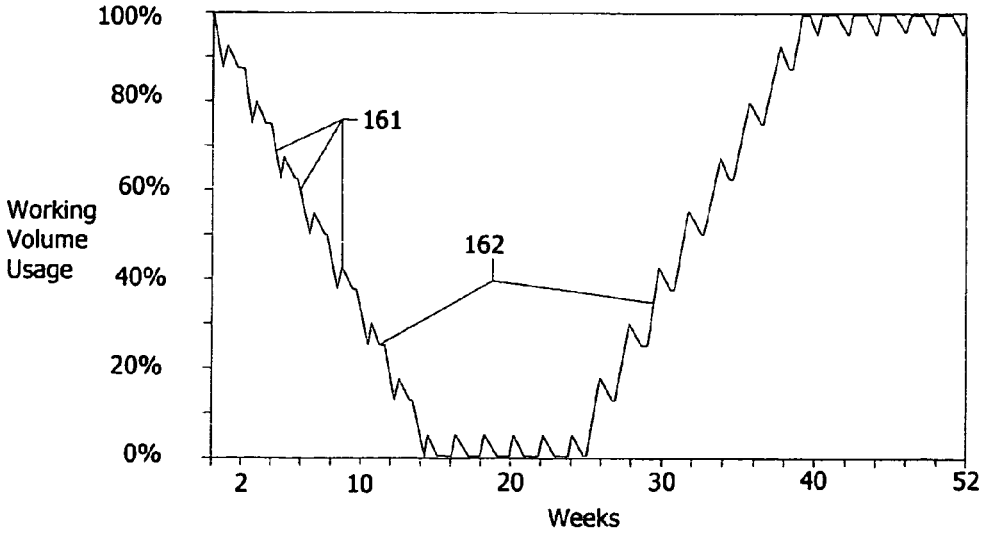
Fig. 78 Prior Art

FIG. 78 depicts an exemplary graphical representation of the conventional concept of working volume usage during short (161) and longer (162) demand cycles, with the vertical axis depicting increasing percentages of usage upwards, and the horizontal axis illustrating an increasing number of weeks over a yearly period, from the left to right. The Figure shows that in the conventional storage operations of this example, a shorter weekly demand leveling requires approximately 10% of the gas cavern working volume, while seasonal swings represent full working volume usage.

During initial years of gas storage in instances where salt deposits are relatively shallow with associated low temperatures, especially after years of solution mining and salt dissolution, short term gas demand leveling requires only a portion of working volume and is less affected by low initial cavern temperatures. However, longer term season supply is significantly affected by lower cavern temperatures because all the working volume is needed, and there is less working volume available, as shown in FIG. 77. As shallow salt caverns are typically at lower temperatures than deeper depleted gas storage sandstone reservoirs, conventional gas supply and demand typically rely on salt caverns for short-term peak gas demand leveling and depleted sandstone gas reservoirs, less affected by temperature limitations, for the season demand swings.

Methods (1T of FIGS. 75, 76 and 80-81) of the present invention can be usable to extend gas withdrawal periods, thus increasing working gas volumes available for seasonal demand through brine displacement, which can remove the need for a sunk cost gas cushion gas to resist salt creep and to maintain salt cavern roof and wall integrity. Increased working gas levels thus provide a means for large gas tight salt cavern storage facilities to supply seasonal demands, conventionally restricted to less than gas tight depleted sandstone reservoir storage facilities, wherein the gas tight integrity of cap rock and spill points cannot be tested.

Figure 79:
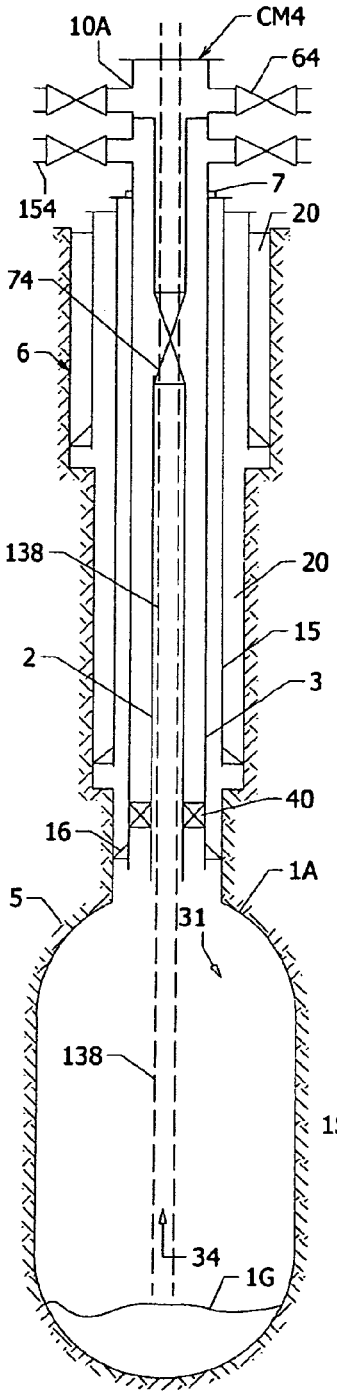
Fig. 79 Prior Art
FIG. 79 diagrammatically shows a gas storage cavern dewatering string through a completion, prior to its removal.
Figure 80:
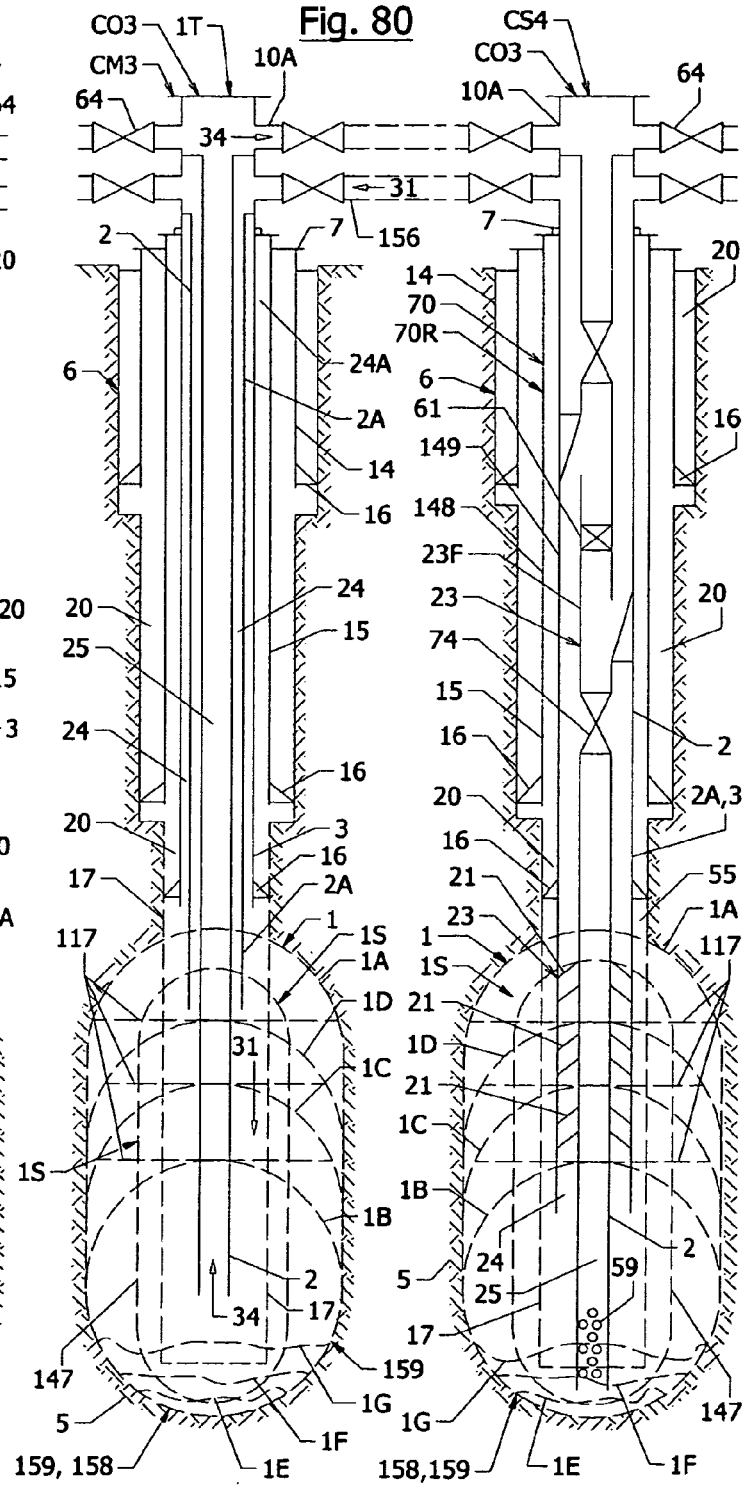
FIG. 80 diagrammatically depicts a method embodiment usable with an underground storage cavern engaged with apparatus and methods to operate underground storage caverns with brine reservoirs of the present invention.

Referring now to the left side cavern and conventional well of FIG. 80 and FIG. 79, the Figures depict the conventional completion method (CM4) of FIG. 79 usable after, for example, the conventional solution mining (1) method (CM3) of the FIG. 80.

Alternatively, the conventional configuration (CM3 of FIG. 80) is usable for both solution mining and conventional liquid storage operation, with brine displacement practices similar to that of FIG. 74.

In conventional liquid storage wells, similar to that of FIGS. 74 and 80, where the stored products do not pose a significant evaporative or expansion escape risk (e.g. crude oil or diesel), generally a subterranean valve (74 of FIG. 79) is not present and a dewatering string (2 of FIG. 74 or FIG. 80 left side well) remains placed through the production casing (2A of FIG. 74, FIG. 80 left side well), with product injected or extracted indirectly through the passageway between the dewatering string and the production casing, and the brine extracted or injected through the dewatering string. Stored liquid products generally displace brine from the space within the cavern walls (1A) during storage or can be retrieved from storage by direct injection of brine from a pond or storage facility, through the dewatering string, to float the lower specific gravity product out of the cavern, as shown in FIG. 74.

FIG. 79 depicts a diagrammatic cross-sectional slice elevation view through subterranean strata of the conventional completion method (CM4) for operating a gas storage salt cavern. The Figure shows a dewatering string (2) as a dashed line placed through a subsurface safety valve (74).

The free hanging leaching strings (2, 2A of FIG. 80 left side well) have been removed and a completion, comprising production casing (2), that can be engaged with a production packer (40), further engaged to the final cemented casing (3), is secured at upper end to a wellhead (7) and valve tree (10A) with surface valves (64), to control injection and extraction of fluids, that have been installed.

In instances of expandable or volatile fluid storage, for example compressed gas storage, a fail safe shut subterranean valve (74) can be generally placed in the production casing (2), through which a dewatering string (138 shown as a dashed line) is placed. Expandable or volatile fluids can then be used to displace brine from the cavern with indirect injection (31) through the passageway, between the dewatering (138) and production casing (2), taking brine, expelled (34) from the cavern, through the dewatering string (138); after which, the dewatering string (138) must be stripped or snubbed out of the well in a relatively high risk operation, where personnel are in close proximity to pressurized barriers, to allow the fail safe safety valve (74) to function.

If the cavern is cold from, for example, after solution mining, the working gas volumes will increase as subterranean thermal transfer heats the cavern, as described in FIG. 77. Conventional practice typically does not place brine back in the cavern, leaving it dry to avoid high risk stripping and snubbing operations, necessary for removal of a dewatering string from across the subsurface safety valve. Conventional dual conduit completions, such as those shown in FIG. 81 can be, however, usable to provide a dewatering string with a subsurface safety valve.

Conventional methods (CM3 of FIG. 80 and CM4) for constructing salt caverns and initializing gas or volatile liquid underground storage are labor intensive and potentially hazardous, taking a number of years to complete before realizing a return on investment. Additionally, conventional practice requires a significant volume of compressed cushion gas, representing a sunk cost, that must be left in the cavern to resist salt creep and degradation of the cavern walls and roof.

FIG. 80 depicts a diagrammatic cross-sectional slice elevation view through subterranean strata of a method embodiment (1T) for operating a storage cavern with a subterranean brine reservoir. The Figure shows a conventionally constructed (CM3) left side well that can be usable for solution mining and/or liquid storage that is engagable to a right hand well (CS4) with apparatuses (21, 23, 23F, 70, 70R) and methods (CO3) of the present inventor that can be usable for dewatering and selective access to liquid and/or gas storage, to replace the conventional gas storage arrangement of FIG. 79 for example, during combined solution mining (1) and storage operations (1S). The wells can be formed with conductors (14), intermediate casings (15), and final cemented casings (3) sealed with a cavern chimney, with a casing shoe (16) below which a strata passageway (17) is bored and strings (2, 2A) are placed for solution mining operations.

In the convention solution mining (1) method of the left side well (CM3), a free hanging inner string (2) is placed within an outer free hanging string (2A), which can be adjusted with the use of a large hoisting capacity rig during the process to reposition the point at which fresh water enters the solution mining region of a salt deposit (5), and/or to provide improved sonar measurements than are possible through casings (2, 2A). A salt inert cushion of nitrogen or diesel is generally displaced between the final cemented casing (3) and outer leaching string (2A) to control the substantially water interface (117) and to protect the final cemented casing (3) shoe (16).

Example apparatuses (21, 23, 23F, 70, 70R) and methods (CO3) of the present invention in the right side well (CS4) provide access through crossovers (21, 23) at the lower end of the inner (2) and outer (2A) strings to access various regions, within intermediate cavern volume (147) usable for combined solution mining (1) and storage (1S) and for final (1A) cavern walls.

Either the right (CS4) or left side (CM3) wells can be usable as a brine reservoir (159) or an underground storage cavern (158), within the method (1T) for brine and storage reservoirs (158, 159).

Solution mining and brine generation (1) can be usable with injected potable water, pond water, ditch water, sea water, and/or other forms of water, generally termed fresh water due an unsaturated salinity level compared to the produced salt saturated brine. The water can be injected through the innermost passageway (25) or the intermediate concentric passageway (24), between the inner (2) and outer (2A) free hanging conduit strings, or vice versa, using direct or indirect circulation with a cushion. The cushion generally comprises diesel or nitrogen. Then, the water can be forced into an additional intermediate concentric passageway (24A), between the outer conduit string (2A) and final cemented casing (3), for the left side well (CM3), or the water can be forced through a passageway (24, 25) of the right side well (CS4) and allowed to float up to the final cemented casing shoe, to control the water interface (117), wherein an initial solution mined space can be formed for insoluble strata to fall through a substantially water fluid to the cavern floor (1E).

Generally, caverns are solution mined (1) from the bottom up by mining a space (1B) with a water interface (117). Then, the water interface (117) can be raised, repeatedly, to create increasing volumetric spaces (1C and 1D) with water insoluble strata falling through fluids and raising (1E, 1F, 1G) the cavern floor, while continuously injecting (31) fresh water and extracting (34) saturated or nearly saturated salt brine, dependent upon the residence time, pressure, volume and temperature conditions of the salt dissolution process.

The method (CO3) can be usable to simultaneously perform storage and solution mining operations (1S) by first forming an initial space within cavern walls (1B, 1C, 147) with direct circulation of fresh water through the innermost passageway (25), and with salt saturated brine returned through the concentric passageway (24), using the lowest water interface (117) above the lower end of the outer string (2A). Alternatively and indirectly, the brine can be returned from the concentric passageway (24) to the innermost passageway (25), using the manifold crossover (23) flow diverter (21), at selected depths, corresponding to various fluid interfaces (117), during which time a salt inert fluid cushion can be periodically injected through one of the passageways (24, 24A, 25) and trapped under the casing shoe (16). Various initial cavern volume shapes can be formed with direct or indirect circulation and adjustment of the salt inert fluid cushion controlling the water interface selectively changed using a manifold crossover (23) and flow diverter (21), for the right hand well (CS4), or the additional concentric passageway (24A) for the left hand well (CM3), to form a volume (147) with lesser effective diameter and volume than the final cavern wall (1A), for simultaneous storage and solution mining operations (1S).

Various initial cavern shapes (147) can be formable by controlling water residence time against the roof, sides and bottom of a cavern at the various salt dissolution rates to simultaneously produce brine from a brine reservoir cavern (159), while fluidly displacing and operating an underground storage cavern (158) with less than fully saturated brine, if the maximum effective cavern diameter of the walls (1A) has not been solution mined or fully saturated the brine after reaching the final cavern wall (1A) effective diameter.

The method (1T) can be usable, for example, with gas storage within gas tight salt caverns to increase the number of working volume turn-overs and for profitability of short term trading, using an intermediate cavern volume (147), until reaching a cavern volume sufficient for seasonal near-full capacity working volume swings.

The left side well (CM3) is usable, for example, as a brine reservoir (159), that can be engaged, through a u-tube like arrangement, to the lower end right side well (CS4) storage cavern (158) for combined storage (1S) and solution mining (1) operations, with a short term trading volume of gas within an upper end cushion, that can be controlled by a valve manifold crossover (23F) above the fluid interface (117). During combined storage and solution mining operations (1S), water can be usable to displace short-term gas trading volumes with subsequent gas product displacement, which can force brine from the cavern before resuming solution mining or during later phases. When the effective diameter of the walls (147) is approaching its maximum (1A), brine, from the brine reservoir (159), can be divertible through the u-tube like arrangement to the lower end of the underground storage cavern (158) for pressure assisting the extraction of the short-term and longer term seasonal trading volumes of gas.

Figure 81:
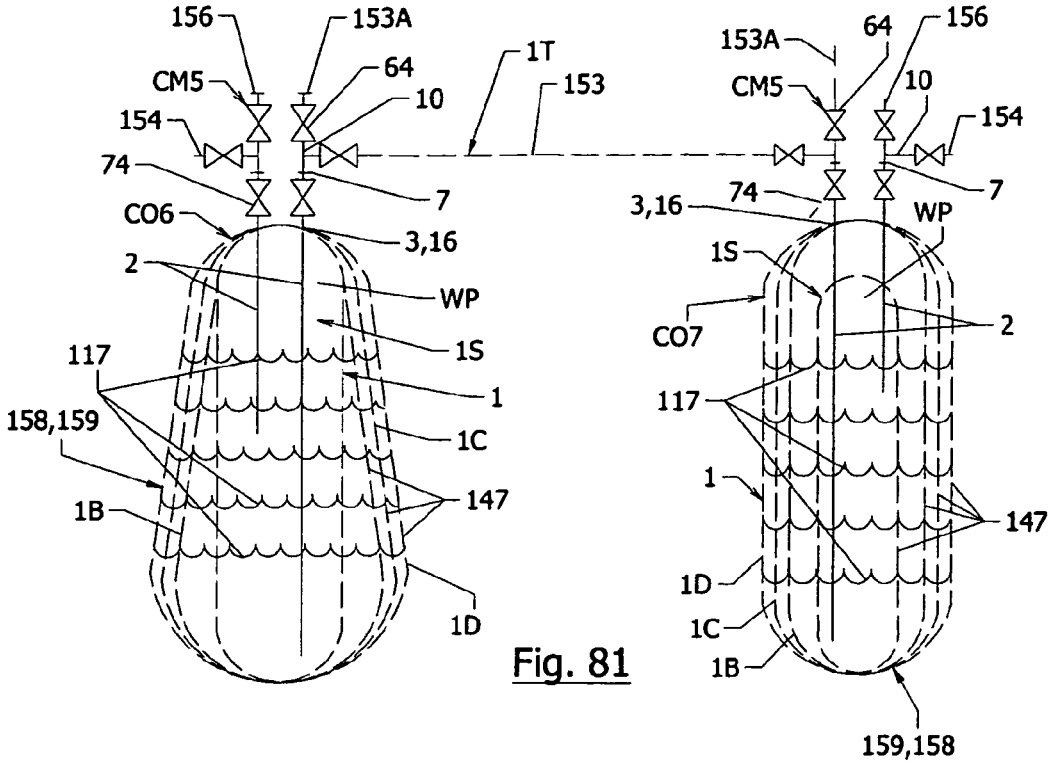
FIG. 81 diagrammatically depicts a method embodiment using dual well underground storage arrangements.

The well construction method (CS4), with manifold crossover (23F) and flow diverters (21), can be usable, for example, to perform both solution mining and storage operations (1S) without rig intervention, which is generally necessary to adjust the outer leaching string (2A) of conventional wells (CM3) or to provide a dual well valve dewatering string arrangement (CM5 of FIG. 81). A smaller cavern volume, formed by first solution mining a smaller diameter cavern axially upward at the faster dissolution rate of the cavern roof, can be usable to form a storage cushion volume (147). Thereafter, the water interface can be lowered by the volume of stored product during, for example, weekend lower gas usage period which displaces the brine. Then, the stored product can be released during daily peak demands, as fresh water is injected to solution mine the cavern walls to a larger diameter, from the bottom up, and wherein stored cushion product extraction and associated pressures are aided by fresh water injection.

FIG. 81 depicts a diagrammatic cross-sectional slice elevation view through subterranean strata of a method embodiment (1T), with conventional dual well valve string arrangements (CM5) usable for operating a storage cavern (158) with brine from a subterranean brine reservoir (159). The Figure depicts smaller cavern cushion storage spaces (147), corresponding to increasing diameters which are less than the maximum effective diameter for cavern stability, solution mined (1) first for the purpose of simultaneous storage operations (1S), and with a working pressure (WP) usable to selectively control the substantially water interfaces (117), during enlargement of the cavern walls (1B, 1C, 1D). Various methods for shaping a cavern can be usable including, for example, notionally vertical cavern walls methods (CO7) or inward sloping cavern wall methods (CO6), providing more roof support and allowing a lower minimum cavern pressure.

Either cavern can be usable as a storage cavern (158). The remaining cavern can be usable as a brine reservoir (159) for solution mining with water supplied through a feeding conduit (156) and valves (64) of a valve tree (10). The brine can be expelled through a disposal conduit (153A) or a transfer conduit (153) forming a u-tube like brine transfer arrangement between cavern lower ends, with product supply through a supply conduit (154) or pipeline to form an upper end cushion that can protect the final cemented casing (3) shoe (16). Escape of the upper end cushion can be controlled by subsurface safety valves (74).

Figure 82:
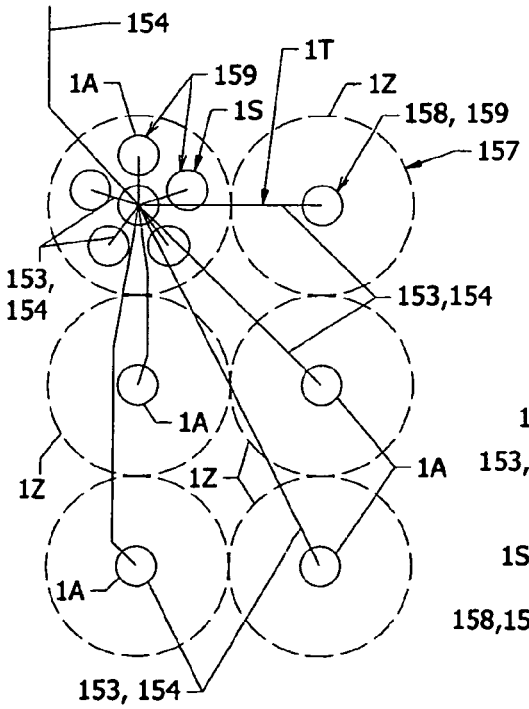
FIGS. 82 and 83 diagrammatically depict plan view method embodiments of cavern arrangements, usable for operating underground storage caverns and brine reservoirs.
Figure 83:
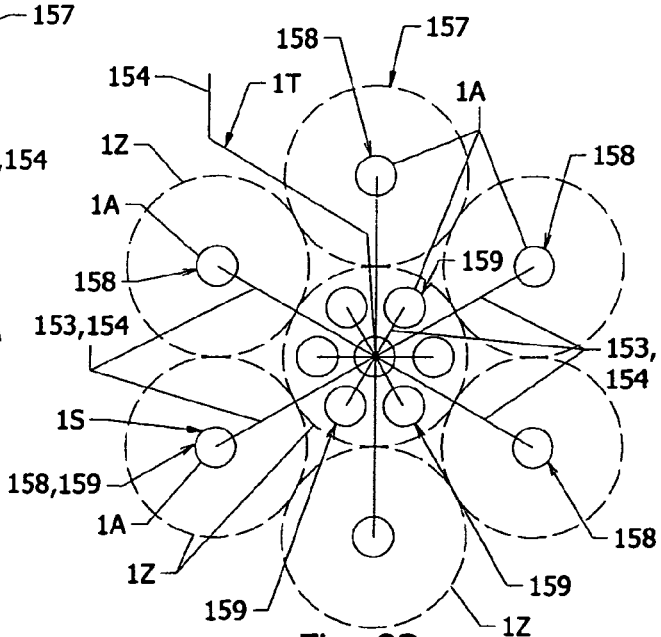

Referring now to FIGS. 82 to 83, various diagrammatic plan view embodiments (157) of underground storage cavern (158) and subterranean brine reservoir (159) arrangements usable with brine and storage reservoir operations methods (1T) and combined solution mining and storage operations (1S), depicting cavern configurations usable to provide salt deposit pillar support, according to the product stored and working pressure variations with cavern exclusion zones (1Z).

Conventional practice is to space caverns, that are mined for their salt, in close proximity, and to potentially use such caverns for solid waste disposal, to remove pressurization requirements. Such close proximity caverns are stable because the hydrostatic pressure of a saturated salt column is generally at least equal to the strata overburden pressure acting to plastically deform the salt deposit. Additional pressure applied through the valve tree and wellhead can over pressure the cavern to prevent degradation of the cavern walls and roof.

Pressure integrity of a cavern generally depends upon the fluid being contained with liquid pressure integrity generally greater than, for example, gas tight integrity within the same cavern, with the capillary and cohesive properties of liquid greater than gas attempting to escape through micro annuli and porous or permeable spaces with the strata.

Brine reservoirs (159), using an upper end liquid cushion with water and having brine below their substantially water interface, are placeable in closer proximity than for example, underground storage caverns (158) with gas product, wherein a higher pressure is maintainable within a liquid storage cavern than a gaseous storage cavern, to maintain cavern stability.

Methods (1S, 1T) of the present invention can be usable for operating a storage cavern (158) with brine from close proximity liquid storage brine reservoirs (159), engaged with stored product (154), and brine transfer (153) conduits to storage caverns (158) arranged with larger cavern exclusion zones (1Z) and associated with more salt deposit overburden pillar support between cavern walls (1A).

Various configurations and orientation arrangements can be usable with the depicted arrangements showing centralized liquid storage brine reservoirs (159), engaged with a supply conduit (154) or pipeline, and further engaged with various other brine reservoirs (159) or underground storage caverns (158) that require larger exclusion zones (1Z) for salt deposit pillar support, with supply (154) and transfer (153) conduits.

Water supply and brine disposal conduits are placeable centrally or individually for each cavern, for example, in an ocean environment where offshore platforms exist above caverns, with water taken and brine disposed to the ocean during solution mining.

Offshore ocean access via pipelines (153, 154) to each platform and/or ship access for loading and unloading of, for example, crude oil within a brine reservoir (159) or storage cavern (158).

As demonstrated in FIGS. 75 to 76 and 80 to 83, embodiments of the present invention provide systems and methods for combined or simultaneous storage and solution mining operation that can be usable in any configuration or arrangement, including with various apparatus and methods that can be placeable in the subterranean strata, onshore or offshore, and that can be engaged with conduits carrying products to be stored, water for salt dissolution, or brine for selectively displacing stored product within another cavern or the cushion between the final cemented casing shoe and a substantially water interface. These systems and methods can be further usable to form a subterranean brine and storage reservoir with salt dissolution, wherein two or more strings having a plurality of passageways and a valve tree can be usable to selectively operate or form one or more subterranean brine storage reservoirs, with salt inert cushion fluid and water for associated operation of one or more other underground storage salt caverns, by selectively communicating fluids between the caverns with pumping, compression and/or pressure equalization.

While various embodiments of the present invention have been described with emphasis, it should be understood that within the scope of the appended claims, the present invention might be practiced other than as specifically described herein.

The invention claimed is:

1. An apparatus for forming a manifold string usable to selectively access and communicate fluid mixture flow streams through a plurality of conduits within or between one or more wells extending from a single main bore for at least one of: hydrocarbon and solution mining and reservoir operations, wherein the apparatus comprises:

at least one manifold crossover apparatus having a first plurality of conduits at an upper end and a second plurality of conduits at a lower end, wherein the first plurality of conduits comprise at least one intermediate passageway disposed about an inner passageway for accessing a reservoir and communicating fluids to and from at least one subterranean fluid control device to enable selective control of fluid communication in said passageways, said plurality of conduits, said one or more wells, or combinations thereof;

a first radial passageway and at least a second radial passageway fluidly separable from the first radial passageway, wherein the first radial passageway and the at least a second radial passageways are in fluid communication with said inner passageway; and said at least one subterranean fluid control device is positionable between said upper end and said lower end to fluidly separate said radial passageways, wherein the at least one subterranean fluid control device diverts at least a portion of said fluid mixture flow streams to another passageway disposed radially inward or outward from a diverted passageway through at least one of said radial passageways of said at least one manifold crossover to form a plurality of pressure barriers to control fluid communication between at least two of: a surrounding passageway, said inner passageway, and said at least one intermediate passageway, to access said reservoir and perform said reservoir operations, or to perform said hydrocarbon and solution mining.

2. The apparatus of claim 1, wherein said at least one intermediate passageway is fluidly separated circumferentially to form a first and at least a second circumferentially disposed axial passageways associated with said first and at least a second radial passageways, wherein said at least one subterranean fluid control device is positioned across said first and said at least a second circumferentially disposed axial passageways to at least partially block fluid communication between said upper end and said lower end and divert fluid through said first and said at least a second radial passageways, wherein said at least one subterranean flow control device causes said flow streams to crossover between said inner passageway and said at least one intermediate passageway between said upper and lower ends.

3. The apparatus of claim 2, further comprising valves engaged to the ends of the inner passageway to selectively control fluid mixture flow streams communicated through said inner passageway, thereby forming a valve controlled manifold crossover assembly.

4. The apparatus of claim 2, further comprising at least one additional string positioned through and fluidly separated from said at least one intermediate passageway, wherein at least one of said radial passageways fluidly communicates between said inner passageway and said at least one additional string.

5. The apparatus of claim 1, further comprising a chamber junction communicating with said inner passageway through said first and said at least a second radial passageways via a first exit bore conduit and at least a second exit bore conduit, respectively, wherein at least one additional radial passageway fluidly communicates between the first exit bore conduit and said at least one intermediate passageway, and wherein a bore selector is usable to selectively communicate said fluid control device through said inner passageway.

6. The apparatus of claim 5, wherein an innermost passageway of the first exit bore conduit is aligned with an axis of the chamber junction, and wherein said first plurality of conduits extend to surround the first exit bore conduit and at least one other exit bore conduit that passes through and is fluidly separated from said at least one intermediate passageway to enable fluid communication with a different intermediate passageway or said surrounding passageway, wherein said bore selector or said at least one subterranean flow control device is usable to selectively control fluid communication through said radial passageways.

7. The apparatus of claim 6, further comprising at least one additional radial passageway in fluid communication between said innermost passageway of the first exit bore conduit and said at least one intermediate passageway, wherein said at least one subterranean flow control device is usable to selectively control fluid communication through said at least one additional radial passageway.

8. The apparatus of claim 1, wherein said first and said at least a second radial passageways comprise a first radial passageway formed by an engaged straddle bore or bore selector axially aligned to said inner passageway and at least a second radial passageway fluidly separated by said straddle from said first radial passageway, wherein said at least a second radial passageway comprises a conduit passing through and fluidly separated from said at least one intermediate passageway (24), wherein said straddle or bore selector is communicated through said inner passageway and is usable to selectively control fluid communication through the radial passageways.

9. The apparatus of claim 1, further comprising an orifice piston fluid control device conveyable through said inner passageway and placeable and removable using differential pressure applied to an axially upward or axially downward aligned piston face, wherein cables or conduits are passable through at least one orifice of said orifice piston device while using said piston faces to divert at least a portion of said fluid mixture flow streams to a passageway other than the inner passageway.

10. A method of forming or using at least one manifold crossover apparatus to form a manifold string for selectively accessing and communicating fluid mixture flow streams through a plurality of conduits within or between one or more wells extending from a single main bore for at least one of: hydrocarbon or solution mining and reservoir operations, comprising the steps of:

providing at least one manifold string comprising a plurality of conduits engaged with a plurality of manifold crossover conduits having at least one intermediate passageway disposed about an inner passageway for accessing a reservoir and communicating fluids to and from at least one subterranean fluid control device;

circulating said fluid mixture flow streams through a first radial passageway and at least a second radial passageway of said manifold crossover conduits, wherein said first radial passageway and said at least a second radial passageway are in communication with said inner passageway; and blocking said inner passageways with said at least one subterranean fluid control device to divert at least a portion of said fluid mixture flow streams to a different passageway disposed radially inward or outward from said at least one intermediate passageways to form a plurality of pressure barriers for selectively controlling fluid communication between at least two of: a surrounding passageway, said inner passageway, and said at least one intermediate passageway, to access said reservoir and perform said reservoir operations or said hydrocarbon and solution mining.

11. The method of claim 10, further comprising using valves engaged to each of the ends of said inner passageway of said at least one manifold crossover to selectively control pressurized fluid communicated through said inner passageway and said at least one intermediate passageway.

12. The method of claim 10, further comprising using said at least one subterranean flow controlling device communicated through said inner passageway and engaged within said manifold string, to selectively control fluid communication by diverting at least a portion of said fluid mixture flow streams.

13. The method of claim 12, further comprising providing an orifice piston fluid controlling device placeable and removable using differential pressure applied to axially upward or axially downward surfaces thereof and placing cables or conduits through said orifice piston fluid controlling device while diverting at least a portion of said fluid mixture flow streams to a passageway other than the inner passageway.

14. The method of claim 10, further comprising selectively controlling fluid communication of fluid mixtures of gases, liquids, solids, or combinations thereof, between said single main bore and a proximal region of said one or more wells to over-balance, balance or under-balance hydrostatic pressures exerted on said proximal region during said fluid communication.

15. The method of claim 10, further comprising providing one or more additional connector conduits for operatively cooperating with said plurality of pressure barriers, wherein said additional connector conduits are arranged concentrically or radially within a secondary pressure bearing conduit.

16. The method of claim 15, further comprising fluidly connecting said one or more additional connector conduits to limit pressure exerted on said plurality of pressure barriers with pressure equalization or pressure relief to a pressure absorbing reservoir.

17. A method (1S, 1T, 157, CO1-CO7) of using a manifold with an apparatus or a reservoir fluid mixture flow streams radial passageway crossover between a wellhead manifold and one or more reservoirs during a plurality of reservoir operations comprising production and injection, wherein the method comprises the steps of:

providing a plurality of conduits disposed through a surrounding casing barrier and casing passageway through subterranean strata for accessing at least one proximal region of one or more reservoirs, wherein a lower end of said plurality of conduits forms a plurality of stationary conduit pressure barriers to concentric reservoir flow through at least one concentric intermediate passageway disposed about at least one inner passageway; and performing the plurality of reservoir operations to access reservoir fluid by crossing over and diverting, through at least one reservoir fluid radial passageway, a plurality of fluid mixture flow streams from at least one of said at least one inner passageway or said at least one concentric intermediate passageway to another of said at least one inner passageway or said at least one concentric intermediate passageway disposed radially inward or outward therefrom using a fluid control device positionable along and selectively disposable across and removable from said at least one inner passageway to, in use, selectively access and communicate the plurality of fluid mixture flow streams to or from said at least one proximal region of said one or more reservoirs during said plurality of reservoir operations.

18. The method of claim 17, wherein said selectively accessing and communicating fluids between the one or more reservoirs comprises separating fluids of differing specific gravity selectively accessible and communicable at two or more depths using said fluid control devices.

19. The method of claim 17, further comprising the step of selectively using said fluid control devices for providing water at two or more depths to said at least one proximal region in a salt deposit to form a substantially hydrocarbon or substantially water brine and storage reservoir with salt inert or stored fluid cushion space above a substantially water or fluid interface usable for controlling salt dissolution, hydrocarbon operations, solution mining operations, or combinations thereof.

20. The method of claim 19, wherein said selectively communicating fluid mixtures between said wellheads manifold and said at least one proximal region comprises selectively communicating fluid to and from said at least one proximal region using said fluid control devices at two or more depths between or below said substantially water or fluid interface to transport stored fluids or brine to or from at least two brine and storage reservoirs.

21. The method of claim 20, further comprising selectively using said fluid control devices for providing water to said substantially water or fluid interface at two or more depths to displace brine at a lower end of a first brine and storage reservoir via a u-tube conduit arrangement to at least one second brine and storage reservoir to generate brine with salt dissolution in said first brine and storage reservoir to minimize salt dissolution in said at least one second brine and storage reservoir during operations.

22. The method of claim 19, further comprising the step of selectively using said fluid control devices for providing salt inert or stored fluids of differing specific gravities at said two or more depths to form a plurality of fluid interfaces comprising cushion spaces for storage operations beneath a final cemented casing shoe and above the substantially water or fluid interface.

23. The method of claim 19, wherein selectively controlling said fluid communication between said wellhead manifold and said at least one proximal region comprises selectively using said fluid control devices at two or more depths for controlling fluid communication of said salt inert or stored fluids, stored and retrieved from said stored fluid cushion space, to affect associated working pressures, volumes and temperatures of fluids stored and retrieved from said brine and storage reservoir.

24. The method of claim 19, further comprising selectively controlling a shape of cavern walls using said fluid control devices at two or more depths to control salt dissolution of said brine and storage reservoir by controlling said substantially water or fluid interface to control working storage volumes, solution mining rates, salt creep rates, or combinations thereof, until reaching a maximum effective diameter for salt cavern stability.

25. The method of claim 24, further comprising storing salt inert fluids within cavern walls between subterranean depths in which said cavern walls have reached the maximum effective diameter for salt cavern stability and selectively accessing and communicating said salt inert fluids at two or more depths using said fluid control devices.

26. The method of claim 19, further comprising arranging and separating one or more reservoirs to provide salt pillar support corresponding to pressures of fluids stored within said one or more reservoirs and effective diameters of said brine and storage reservoirs and selectively accessing and communicating said fluids at two or more depths using said fluid control devices.

27. The method of claim 19, wherein selectively controlling pressurized fluid communication between said wellhead manifold and said at least one proximal region for hydrocarbon operations, solution mining operations, or combinations thereof, comprises using the water and brine absorption capacity of an ocean and using said fluid control devices at two or more depths.

28. The method of claim 19, wherein selectively controlling fluid communication between said wellhead manifold and said at least one proximal region comprises using fluid communication capacity of ships, pipelines or an ocean to operate said brine and storage reservoirs.

29. The method of claim 17, wherein the step of crossing over and diverting through said at least one reservoir fluid radial passageway, at least one portion of the plurality of fluid mixture flow streams, comprises performing radial passage of fluids through a manifold crossover of a manifold string, radial passage of fluids through a reservoir u-tube manifold crossover arrangement, or combinations thereof.

30. The method of claim 17, further comprising the step of engaging and operating one or more wellheads, valve trees, pumps, surface manifolds, or combinations thereof, in communication with said wellhead manifold.

* * * * *